US010274866B2

(12) United States Patent
Koyama et al.

(10) Patent No.: US 10,274,866 B2
(45) Date of Patent: Apr. 30, 2019

(54) TONER CONTAINER, IMAGE FORMING UNIT INCLUDING THE TONER CONTAINER, AND IMAGE FORMING APPARATUS INCLUDING THE TONER CONTAINER

(71) Applicant: Oki Data Corporation, Tokyo (JP)

(72) Inventors: Tetsu Koyama, Tokyo (JP); Shigenori Koido, Tokyo (JP); Atsushi Ota, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/709,432

(22) Filed: Sep. 19, 2017

(65) Prior Publication Data

US 2018/0088490 A1 Mar. 29, 2018

(30) Foreign Application Priority Data

Sep. 26, 2016 (JP) ..... 2016-186809
Nov. 1, 2016 (JP) ..... 2016-214325
Apr. 3, 2017 (JP) ..... 2017-073678

(51) Int. Cl.
*G03G 15/08* (2006.01)
*G03G 21/16* (2006.01)
*G03G 21/18* (2006.01)

(52) U.S. Cl.
CPC ..... *G03G 15/0875* (2013.01); *G03G 15/0863* (2013.01); *G03G 21/1619* (2013.01); *G03G 21/1814* (2013.01); *G03G 21/1885* (2013.01); *G03G 21/1652* (2013.01); *G03G 2215/067* (2013.01); *G03G 2215/068* (2013.01);
(Continued)

(58) Field of Classification Search
CPC ..... G03G 21/1885
See application file for complete search history.

(56) References Cited

U.S. PATENT DOCUMENTS

2008/0279581 A1 11/2008 Shimizu
2013/0164029 A1* 6/2013 Fukui ..... G03G 21/1647 399/111

(Continued)

FOREIGN PATENT DOCUMENTS

EP 2829923 A1 1/2015
EP 2980656 A1 2/2016
JP 2014-228596 A 12/2014

*Primary Examiner* — Victor Verbitsky
(74) *Attorney, Agent, or Firm* — Rabin & Berdo, P.C.

(57) ABSTRACT

A toner container includes: a containing unit that contains a toner; a storage device that stores information; and an attachment unit. The attachment unit includes a cover member, a supporting member, and an insertion member. The cover member has a first projection and an insertion opening. The first projection extends in a first direction. The insertion opening is provided on the first projection and extends in a second direction. The supporting member has a first depression and a through opening. The first depression extends in the first direction and allows the first projection to be inserted into the first depression. The through opening extends in the second direction and is in communication with the first depression. The insertion member is inserted into the through opening and the insertion opening in a state where the storage device is positioned between the cover member and the supporting member.

15 Claims, 24 Drawing Sheets

(52) U.S. Cl.
CPC ..... *G03G 2215/0695* (2013.01); *G03G 2215/0697* (2013.01); *G03G 2221/1823* (2013.01)

(56) References Cited

U.S. PATENT DOCUMENTS

2014/0341606 A1 11/2014 Fujii
2017/0185032 A1* 6/2017 Itabashi ..... G03G 15/0875

* cited by examiner

TONER CONTAINER, IMAGE FORMING UNIT INCLUDING THE TONER CONTAINER, AND IMAGE FORMING APPARATUS INCLUDING THE TONER CONTAINER

CROSS REFERENCE TO RELATED APPLICATIONS

The present application claims priority from Japanese Patent Application No. 2016-186809 filed on Sep. 26, 2016, No. 2016-214325 filed on Nov. 1, 2016, and No. 2017-073678 filed on Apr. 3, 2017, the entire contents of each which are hereby incorporated by reference.

BACKGROUND

The technology relates to a toner container that contains a toner, an image forming unit provided with the toner container, and an image forming apparatus provided with the toner container.

An image forming apparatus using an electrophotographic scheme is in widespread use. One reason for this is that the image forming apparatus using the electrophotographic scheme is able to achieve a high-quality image in a short time, compared with an image forming apparatus using other scheme such as an inkjet scheme.

The image forming apparatus using the electrophotographic scheme includes an image forming unit that forms a latent image (an electrostatic latent image) and attaches a toner to the formed electrostatic latent image. The image forming unit includes a toner container that contains the toner.

In a process of forming an image, the toner attached to the electrostatic latent image is transferred onto a medium, following which the transferred toner is fixed to the medium. As a result, the image is formed on the medium.

Various proposals have been made for a configuration of an image forming apparatus. Specifically, a storage device (a substrate member) that stores information necessary for allowing the image forming apparatus to form an image is used to thereby acquire the information, for example, as disclosed in Japanese Unexamined Patent Application Publication No. 2014-228596. For example, the storage device may store information such as information on a toner.

SUMMARY

In a case of using a storage device, it may be necessary to prevent occurrence of a failure derived from the use of the storage device. Specifically, it may be necessary to prevent the storage device from falling off in order to avoid loss of the storage device, for example.

It is desirable to provide a toner container, an image forming unit, and an image forming apparatus that each prevent a storage device from falling off.

According to one embodiment of the technology, there is provided a toner container including: a containing unit that contains a toner; a storage device that stores information; and an attachment unit that allows the storage device to be attached to the containing unit. The attachment unit includes: a cover member having a first projection and an insertion opening, in which the first projection extends in a first direction, and the insertion opening is provided on the first projection and extends in a second direction that intersects the first direction; a supporting member having a first depression and a through opening, in which the first depression extends in the first direction and allows the first projection to be inserted into the first depression, and the through opening extends in the second direction and is in communication with the first depression; and an insertion member that is inserted into the through opening and the insertion opening in a state where the storage device is positioned between the cover member and the supporting member.

According to one embodiment of the technology, there is provided an image forming unit including: a toner containing unit that contains a toner; and a development processor that forms a latent image and attaches the toner to the latent image. One or both of the toner containing unit and the development processor includes a storage device that stores information, and an attachment unit that allows the storage device to be attached. The attachment unit includes: a cover member having a first projection and an insertion opening, in which the first projection extends in a first direction, and the insertion opening is provided on the first projection and extends in a second direction that intersects the first direction; a supporting member having a first depression and a through opening, in which the first depression extends in the first direction and allows the first projection to be inserted into the first depression, and the through opening extends in the second direction and is in communication with the first depression; and an insertion member that is inserted into the through opening and the insertion opening in a state where the storage device is positioned between the cover member and the supporting member.

According to one embodiment of the technology, there is provided an image forming apparatus including: a developing unit including a toner containing unit and a development processor, in which the toner containing unit contains a toner, and the development processor forms a latent image and attaches the toner to the latent image; a transferring unit that transfers, onto a medium, the toner attached to the latent image; and a fixing unit that fixes, to the medium, the toner transferred onto the medium. One or both of the toner containing unit and the development processor includes a storage device that stores information, and an attachment unit that allows the storage device to be attached. The attachment unit includes: a cover member having a first projection and an insertion opening, in which the first projection extends in a first direction, and the insertion opening is provided on the first projection and extends in a second direction that intersects the first direction; a supporting member having a first depression and a through opening, in which the first depression extends in the first direction and allows the first projection to be inserted into the first depression, and the through opening extends in the second direction and is in communication with the first depression; and an insertion member that is inserted into the through opening and the insertion opening in a state where the storage device is positioned between the cover member and the supporting member.

DETAILED DESCRIPTION

Figure 1:
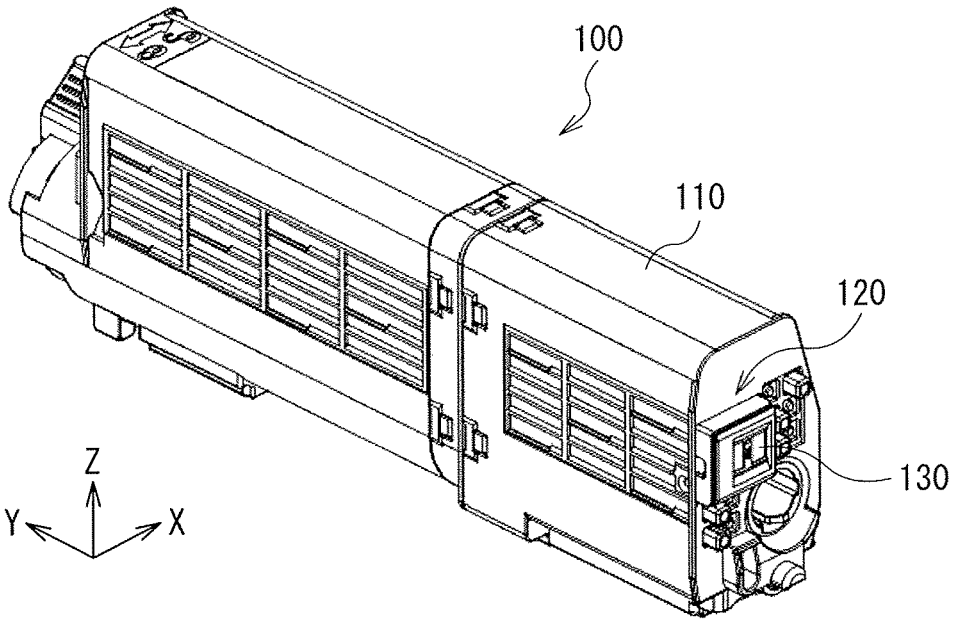
FIG. 1 is a perspective view of a configuration example of a toner container (a toner cartridge) according to a first example embodiment of the technology.

Some example embodiments of the technology are described below in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description is given in the following order.

1. Toner Container (First Example Embodiment)
1-1. Overall Configuration
1-2. Configuration of Attachment Unit
1-3. Configuration of Toner
1-4. Procedure of Attachment of Memory Substrate
1-5. Example Workings and Example Effects
2. Toner Container (Second Example Embodiment)
2-1. Configuration
2-2. Procedure of Attachment of Memory Substrate
2-3. Example Workings and Example Effects
3. Toner Container (Third Example Embodiment)
3-1. Configuration
3-2. Procedure of Attachment of RFID Tag
3-3. Procedure of Detachment of RFID Tag
3-4. Example Workings and Example Effects
4. Image Forming Unit
4-1. Configuration
4-1-1. Configuration Example 1
4-1-2. Configuration Example 2
4-1-3. Configuration Example 3
4-2. Operation
4-3. Example Workings and Example Effects
5. Image Forming Apparatus
5-1. Configuration
5-1-1. Configuration Example 1
5-1-2. Configuration Example 2
5-2. Operation
5-3. Example Workings and Example Effects
6. Modification Examples

1. Toner Container (First Example Embodiment)

A description is given of a toner container according to a first example embodiment of the technology.

<1-1. Overall Configuration>

A description is given first of an overall configuration of a toner cartridge 100 that is an example of the toner container according to the first example embodiment of the technology.

The toner cartridge 100 described below may be used, for example, in a full-color printer using an electrophotographic scheme. The toner cartridge 100 may mainly contain a toner that is to be used to form an image on a surface of a medium. Non-limiting examples of the medium may include paper.

FIG. 1 is a perspective view of the configuration of the toner cartridge 100. The toner cartridge 100 may include a containing unit 110, an attachment unit 120 provided on the containing unit 110, and a memory substrate 130 attached to the containing unit 110 by means of the attachment unit 120, for example. In other words, the memory substrate 130 may be fixed to the containing unit 110 by means of the attachment unit 120. The memory substrate 130 may correspond to a "storage device" in one specific but non-limiting embodiment of the technology.

[Containing Unit]

The containing unit 110 mainly contains a toner. In other words, the containing unit 110 may be a container that contains the toner. The containing unit 110 may include one or more of materials such as a polymer material and a metal material, for example. A type of the toner to be contained in the containing unit 110 is not particularly limited. Therefore, only one type of toner or two or more types of toners may be contained in the containing unit 110. A configuration of the toner will be described later in greater detail.

The containing unit 110 may have a three-dimensional shape that is not particularly limited. In this example, the three-dimensional shape of the containing unit 110 may be a substantially-quadrangular prism that extends in one direction, i.e., a Y-axis direction.

[Attachment Unit]

The attachment unit 120 may be an attachment mechanism that is mainly used to attach the memory substrate 130 to the containing unit 110.

The attachment unit 120 may be provided at a position, in the containing unit 110, which is not particularly limited. In this example, the attachment unit 120 may be provided on an end surface of the containing unit 110 in a longitudinal direction, i.e., the Y-axis direction. A configuration of the attachment unit 120 will be described later in greater detail with reference to FIGS. 2 to 8.

[Memory Substrate]

The memory substrate 130 may mainly store a series of pieces of information that are necessary for an image forming apparatus to form an image with the toner when the toner cartridge 100 is mounted on the image forming apparatus. The image forming apparatus will be described later in greater detail with reference to FIG. 44.

The information stored in the memory substrate 130 may have content that is not particularly limited. For example, the information stored in the memory substrate 130 may include information on the toner cartridge 100 and information on the toner. Non-limiting examples of the information on the toner cartridge 100 may include one or more pieces of information such as a model number of the toner cartridge 100. Non-limiting examples of the information on the toner may include one or more pieces of information such as a color of the toner and a volume of the toner.

The memory substrate 130 may have a planar shape that is not particularly limited. In this example, the planar shape of the memory substrate 130 may be a rectangular shape. The planar shape of the memory substrate 130 may refer to that viewed from the Y-axis direction in this example.

<1-2. Configuration of Attachment Unit>

A description is given below of a configuration of the attachment unit 120.

Figure 2:
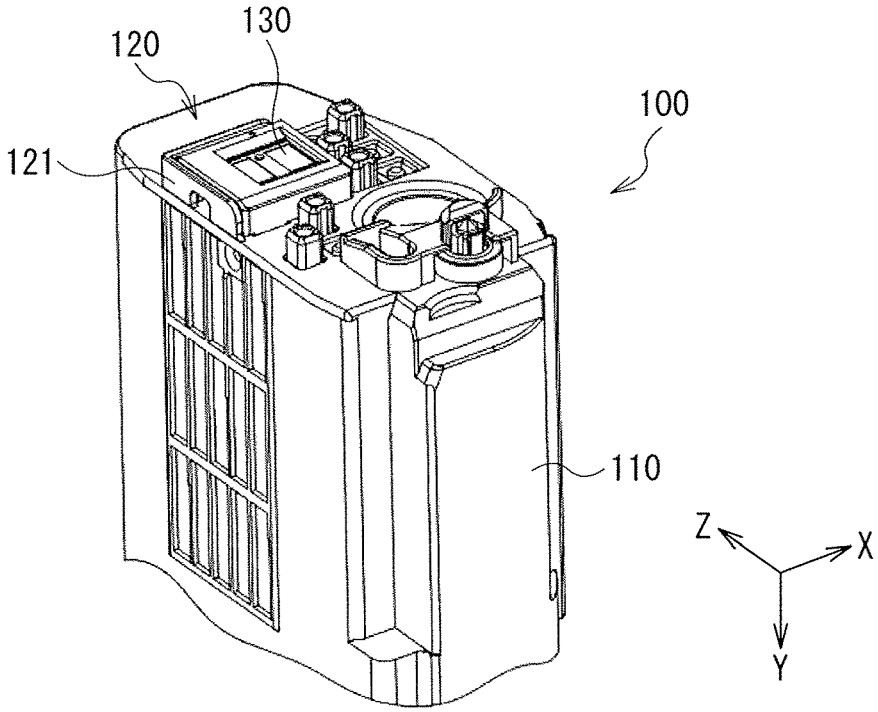
FIG. 2 is a perspective view of a configuration example of a main part of the toner cartridge illustrated in FIG. 1.
Figure 3:
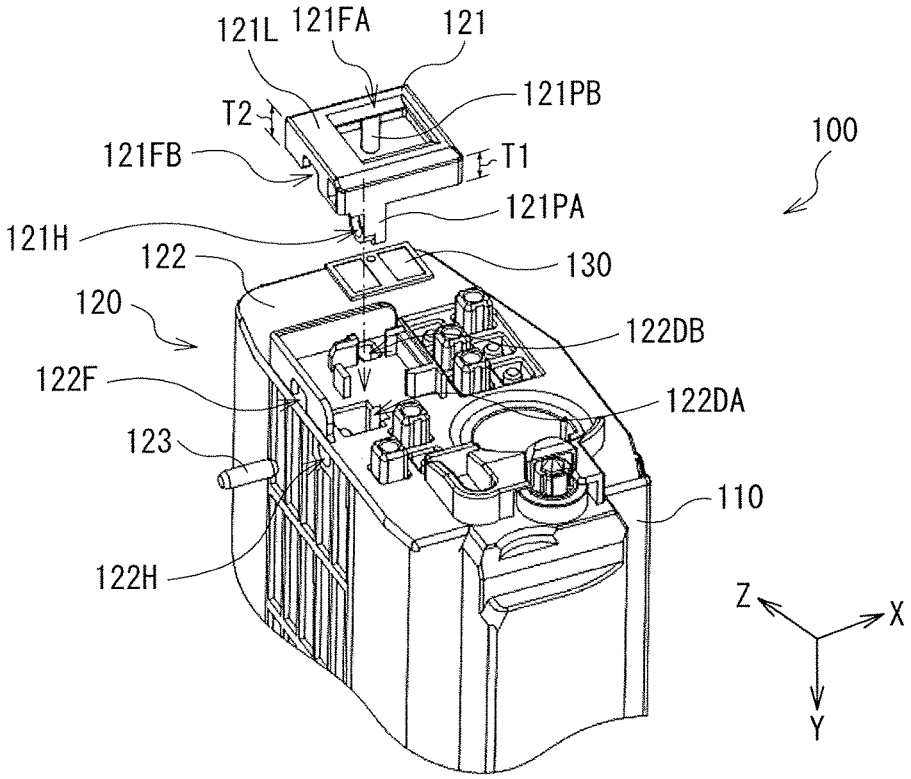
FIG. 3 is a perspective view of another configuration example of the main part of the toner cartridge illustrated in FIG. 1.

FIGS. 2 and 3 are each a perspective view of a configuration of a main part of the toner cartridge 100. FIG. 2 illustrates a state where the members including the memory substrate 130 are attached to the containing unit 110. FIG. 3 illustrates a state where the members including the memory substrate 130 are separated from the containing unit 110 for illustration purpose of a positional relationship between the members including the memory substrate 130.

Figure 4:
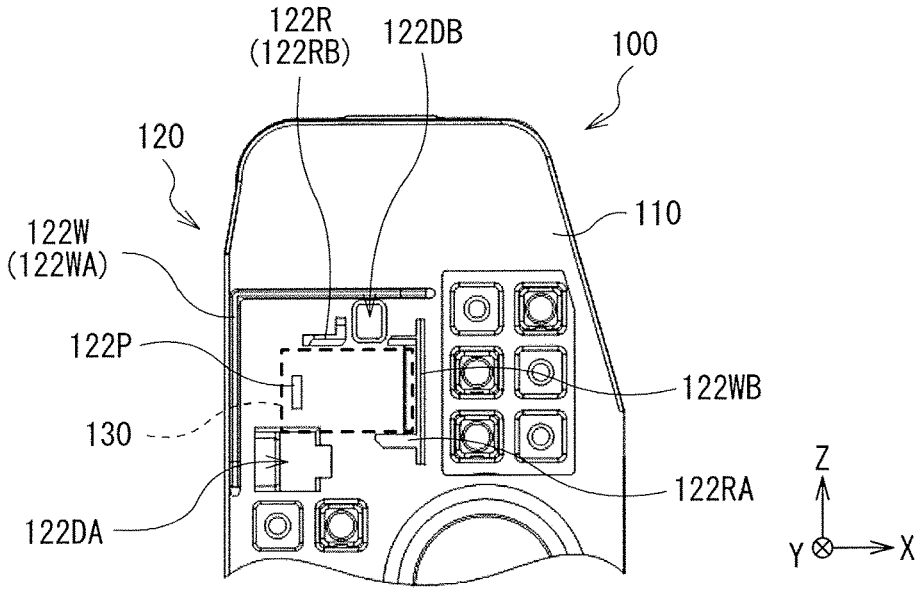
FIG. 4 is a plan view of a configuration example of the main part of the toner cartridge illustrated in FIG. 1.

FIG. 4 illustrates a planar configuration of the toner cartridge 100 in the state where the members including the memory substrate 130 is separated from the containing unit 110. A region in which the memory substrate 130 is to be disposed, i.e., an outline of the memory substrate 130, is illustrated by a dashed line.

Figure 5:
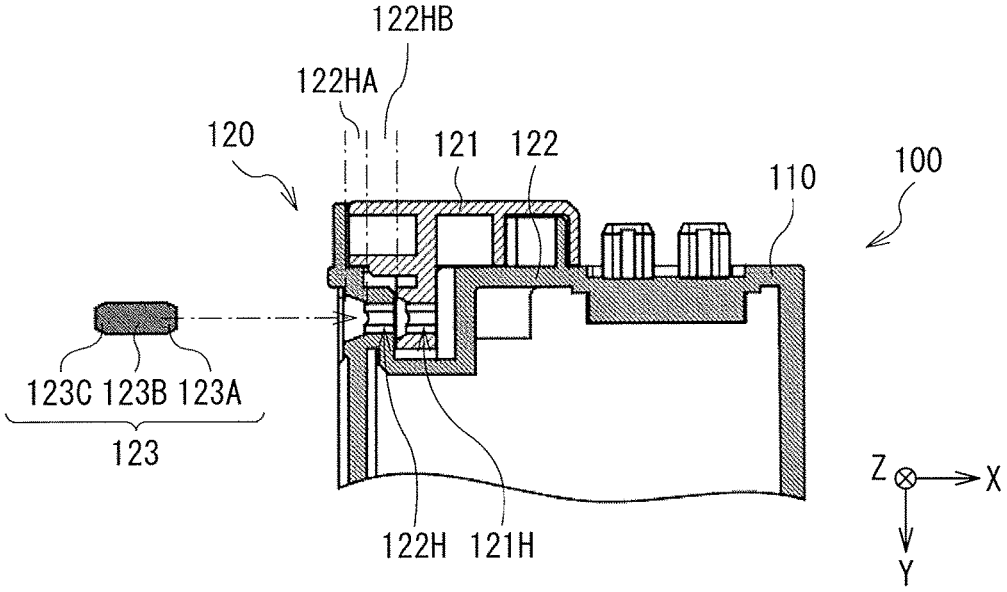
FIG. 5 is an enlarged cross-sectional view of the configuration example of the main part of the toner cartridge illustrated in FIG. 1.
Figure 6:
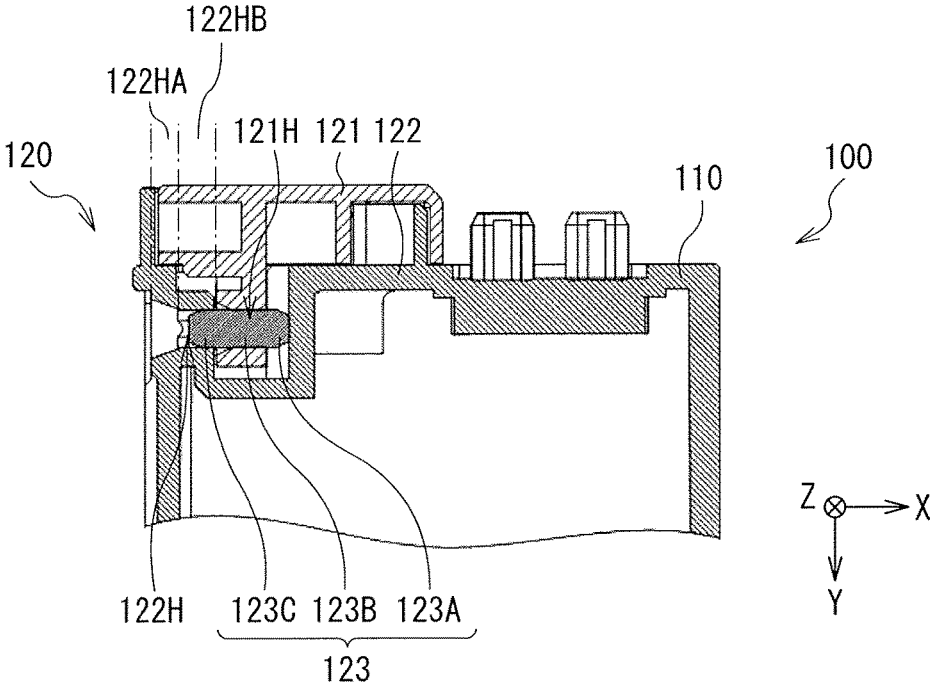
FIG. 6 is an enlarged cross-sectional view of another configuration example of the main part of the toner cartridge illustrated in FIG. 1.

FIGS. 5 and 6 each illustrate a cross-sectional configuration of the main part of the toner cartridge 100 in an enlarged manner. FIG. 5 illustrates a state before insertion of an insertion pin 123. FIG. 6 illustrates a state after the insertion of the insertion pin 123.

Referring to FIGS. 2 and 3, the attachment unit 120 may include a cover 121, a support 122 that is part of the containing unit 110 (the container), and the insertion pin 123, for example. The cover 121, the support 122, and the insertion pin 123 may respectively correspond to a "cover member", a "supporting member", and an "insertion member" in one specific but non-limiting embodiment of the technology.

[Cover]

The cover 121 may mainly cover the memory substrate 130 that is placed on the support 122, i.e., one surface of the containing unit 110.

The cover 121 may have a three-dimensional shape that is not particularly limited. In this example, the three-dimensional shape of the cover 121 may be a substantially-cuboid shape having one open surface facing the support 122, as illustrated in FIGS. 2 and 3. The cover 121 may be so provided with the foregoing substantially-cuboid shape as to surround an upper part and a peripheral part (a side part) of the memory substrate 130. In other words, the three-dimensional shape of the cover 121 may be a substantially-box-like shape that includes one top surface and four side surfaces, for example.

In one example, the cover 121 may include one or more beams in order to improve physical strength of the cover 121 as illustrated in FIGS. 5 and 6. For example, the one or more beams may be disposed inside a space surrounded by the one top surface and the four side surfaces and coupled to each of the top surface and the four side surfaces, when the three-dimensional shape of the cover 121 is the substantially-box-like shape.

Referring to FIG. 3, the cover 121 may include a projection 121PA. The projection 121PA may extend in a predetermined direction. Specifically, the projection 121PA may extend in a direction of being closer to the support 122, i.e., the Y-axis direction. The projection 121PA may correspond to a "first projection" in one specific but non-limiting embodiment of the technology. The Y-axis direction may correspond to a "first direction" in one specific but non-limiting embodiment of the technology.

One reason that the cover 121 may include the projection 121PA is that insertion of the projection 121PA into a depression 122DA in the support 122 allows for easier alignment of the cover 121 with respect to the support 122 and easier temporal fixation of the cover 121 to the support 122. The temporal fixation of the cover 121 to the support 122 may refer to a state before the insertion of the insertion pin 123 where the cover 121 is temporarily fixed to the support 122 and it is therefore difficult for a position of the cover 121 to be shifted greatly.

The projection 121PA may have a cross-sectional shape that is not particularly limited. In this example, the cross-sectional shape of the projection 121PA may be a rectangular shape as illustrated in FIGS. 2 and 3. The cross-sectional shape of the projection 121PA may refer to that along an X-Z plane in this example.

Referring to FIGS. 3, 5, and 6, the projection 121PA may be provided with a through opening 121H. The through opening 121H may extend in a direction (an X-axis direction) intersecting a direction (the Y-axis direction) in which the projection 121PA extends. The through opening 121H may correspond to an "insertion opening" in one specific but non-limiting embodiment of the technology. The X-axis direction may correspond to a "second direction" that intersects the "first direction" in one specific but non-limiting embodiment of the technology.

One reason that the projection 121PA may have the through opening 121H is that insertion of the insertion pin 123 into the through opening 121H allows for full fixation of the cover 121 to the support 122, as will be described later in greater detail. The full fixation of the cover 121 to the support 122 may refer to a state after the insertion of the insertion pin 123 where the cover 121 is firmly fixed to the support 122 and it is therefore difficult for the cover 121 to be away from the support 122.

The through opening 121H may have an opening shape that is not particularly limited. In this example, the opening shape of the through opening 121H may be a circular shape as illustrated in FIG. 3. The opening shape of the through opening 121H may refer to that viewed from the X-axis direction in this example.

The through opening 121H may have an inner diameter that is not particularly limited. The inner diameter of the through opening 121H may be therefore constant or varied in a direction in which the through opening 121H extends. In this example, the inner diameter of the through opening 121H may be constant in the direction in which the through opening 121H extends. The term "constant" related to the inner diameter encompasses the meaning of "almost constant", and does not necessarily refer to a state where the inner diameter is strictly constant. Specifically, the term "constant" may refer to a state involving a manufactural error for accuracy in setting the inner diameter. For example, the description that "the inner diameter of the through opening 121H is constant" is given in consideration of a manufactural error of the through opening 121H for accuracy in setting the inner diameter of the through opening 121H. This definition of the term "constant" is similarly applicable hereinafter.

Referring to FIG. 3, the cover 121 may include a projection 121PB together with the foregoing projection 121PA, for example. The projection 121PB may extend in a direction along the direction in which the projection 121PA extends, for example. The projection 121PB may therefore extend in the direction similar to the direction in which the projection 121PA extends, i.e., the Y-axis direction. The projection 121PB may correspond to a "second projection" in one specific but non-limiting embodiment of the technology.

When the cover 121 includes the projections 121PA and 121PB, the cover 121 may be fixed to the support 122 at two points, i.e., the projections 121PA and 121PB. In this case, it is more difficult for the cover 121 to be rotated around the projection 121PA as a rotation axis, compared with a case where the cover 121 is fixed to the support 122 at only one point, i.e., the projection 121PA. Accordingly, this allows the cover 121 to be aligned more easily and to be temporarily fixed more firmly to the support 122.

The projection 121PB may not be particularly limited in its number. Therefore, only one projection 121PB may be provided. Alternatively, two or more projections 121PB may be provided. In this example, one projection 121PB may be provided. One reason for this is that provision of at least one projection 121PB makes it more difficult for the cover 121 to be rotated, as described above.

The projection 121PB may have a cross-sectional shape that is not particularly limited. In this example, the cross-sectional shape of the projection 121PB may be a rectangular shape having four rounded corners, as illustrated in FIGS. 3 and 4. The cross-sectional shape of the projection 121PB may refer to that taken along the X-Z plane in this example.

The cover 121 may further include a lid part 121L that covers the memory substrate 130, as illustrated in FIG. 3, for example. The lid part 121L may be coupled to the projection 121PA. The lid part 121L may have a three-dimensional shape that is a substantially-box-like shape including one top surface and four side surfaces, for example. The lid part 121L may be so provided with the forgoing substantially-box-like shape as to surround the upper part and the peripheral part of the memory substrate 130 as described above. In a case where the cover 121 includes the projection 121PB, the projection 121PB may also be coupled to the lid part 121L, for example.

The lid part 121L may have a configuration that is not particularly limited. Specifically, the lid part 121L may have a thickness that is not particularly limited. The thickness of the lid part 121L may be constant or varied, for example.

In this example, the thickness of the lid part 121L may be varied. Specifically, the lid part 121L may have a thickness T1 on side closer to the projection 121PA and have a thickness T2 on side away from the projection 121PA, for example. The thickness T1 may be smaller than the thickness T2, for example. More specifically, the thickness of the lid part 121L may be decreased gradually toward the projection 121PA in a direction (a Z-axis direction) that intersects the direction (the Y-axis direction) in which the projection 121PA extends, for example.

When the thickness of the lid part 121L is decreased gradually toward the projection 121PA, it is easier to insert the insertion pin 123 into the through opening 121H provided on the projection 121PA. More specifically, the thickness of the lid part 121L may be different between a portion on the side closer to the projection 121PA and a portion on the side away from the projection 121PA, when the thickness of the lid part 121L is decreased gradually toward the projection 121PA. In this case, it is possible to easily vary an angle at which the cover 121 is inclined by utilizing the difference in the thickness of the lid part 121L. Specifically, it is possible to easily vary the angle at which the cover 121 is inclined, by slightly moving the portion, of the lid part 121L, on the side closer to the projection 121PA in a top-bottom direction while bringing the part on the side away from the projection 121PA in contact with a surface of the support 122. In other words, it is possible to finely adjust a position of the through opening 121H in the cover 121 in the top-bottom direction by utilizing the movement of the cover 121 in the top-bottom direction described above. In some cases, it may be difficult to insert the insertion pin 123 into the through opening 121H when the insertion pin 123 is to be inserted into the through opening 121H after being inserted into a through opening 122H which will be described later. This difficulty in the insertion of the insertion pin 123 into the through opening 121H may be a result of misalignment between the position of the through opening 121H and a position of the through opening 122H. In such a case, however, the fine adjustment of the position of the through opening 121H makes it easier to align the position of the through opening 121H and the position of the through opening 122H with each other. As a result, it is possible to insert the insertion pin 123 into the through opening 121H more easily.

The lid part 121L may have an opening 121FA as illustrated in FIG. 3, for example. The opening 121FA may allow the memory substrate 130 to be partially exposed in the direction (the Y-axis direction) in which the projection 121PA extends. The opening 121FA may correspond to a "first opening" in one specific but non-limiting embodiment of the technology.

When the lid part 121L has the opening 121FA, the information stored in the memory substrate 130 may be readable through the opening 121FA even in a state where the memory substrate 130 is attached to the containing unit 110 by means of the attachment unit 120.

The opening 121FA may be not particularly limited in its number as long as the information stored in the memory substrate 130 is readable through the opening 121FA. Therefore, only one opening 121FA may be provided. Alternatively, two or more openings 121FA may be provided. In this example, one opening 121FA may be provided.

The opening 121FA may have an opening shape that is not particularly limited. In this example, the opening shape of the opening 121FA may be a rectangular shape. The opening shape of the opening 121FA may refer to that viewed from the Y-axis direction in this example.

The opening 121FA may have a size that is not particularly limited. The size of the opening 121FA, however, may be preferably a size that makes it difficult for the memory substrate 130 contained inside the cover 121 to be released to the outside from the opening 121FA. Accordingly, the opening 121FA may preferably have the opening area that is smaller than the area of the planar shape of the memory substrate 130. The opening area of the opening 121FA may refer to that viewed from the Y-axis direction in this example.

The opening 121FA may have, however, a size that allows the memory substrate 130 to be taken out through the opening 121FA to allow the memory substrate 130 attached to the containing unit 110 to be collected on an as-needed basis, as will be described later in greater detail.

[Support]

The support 122 may mainly support the memory substrate 130. The support 122 may be part of the containing unit 110 as described above.

The support 122 may have a depression 122DA as illustrated in FIGS. 3 and 4. The depression 122DA may be formed by a partial depression of the containing unit 110, for example. In other words, the depression 122DA may extend in a direction (the Y-axis direction) similar to the direction in which the projection 121PA extends. The depression 122DA may allow the projection 121PA to be inserted into the depression 122DA. When the memory substrate 130 is attached to the containing unit 110 by means of the attachment unit 120, the projection 121PA may be inserted into the depression 122DA. The depression 122DA may correspond to a "first depression" in one specific but non-limiting embodiment of the technology.

The depression 122DA may have an opening shape that is not particularly limited as long as the opening shape allows the projection 121PA to be inserted into the depression 122DA. Therefore, the opening shape of the depression 122DA may be the same as the cross-sectional shape of the projection 121PA, or different from the cross-sectional shape of the projection 121PA. The opening shape of the depression 122DA may refer to that viewed from the Y-axis direction in this example.

In this example, referring to FIG. 4, the opening shape of the depression 122DA may be a shape including a wide-width rectangular and a narrow-width rectangular that are coupled to each other. The wide-width rectangular and the narrow-width rectangular may be disposed in order from the side on which the insertion pin 123 is to be inserted into the through opening 121H in a direction (the X-axis direction) that intersects the direction (the Y-axis direction) in which the projection 121PA extends.

The foregoing opening shape of the depression 122DA allows a main part, i.e, a constant outer diameter part 123B, of the insertion pin 123 to be located inside the through opening 121H more easily, as will be described later in greater detail. This leads to an increase in area in which the cover 121 is brought into contact with the insertion pin 123 located inside the through opening 121H. In other words, this leads to an increase in frictional force between the cover 121 and the insertion pin 123 located inside the through opening 121H. As a result, it is more difficult for the insertion pin 123 to be removed from the through opening 121H.

The depression 121DA may be located at a position that is not particularly limited as long as the position does not overlap a region in which the memory substrate 130 is to be disposed as illustrated in FIG. 4, for example.

The support 122 may have the through opening 122H, as illustrated in FIGS. 3 and 4. The through opening 122H may extend in a direction (the X-axis direction) that intersects the direction (the Y-axis direction) in which the projection 121PA extends. Further, the through opening 122H may be in communication with the depression 122DA. In other words, the through opening 122H may be coupled to the depression 122DA, which causes the through opening 122H and the depression 122DA to be joined with each other. The through opening 122H may correspond to a "through opening" in one specific but non-limiting embodiment of the technology.

The through opening 122H may have an opening shape that is not particularly limited. In this example, the opening shape of the through opening 122H may be similar to or the same as the opening shape of the through opening 121H. The opening shape of the through opening 122H may refer to that viewed from the X-axis direction in this example.

The depression 122DA may be provided on one surface, i.e., a surface along the X-Z plane, of the support 122, and the through opening 122H may be provided on another surface, i.e., a surface along the Y-Z plane, of the support 122, for example.

The through opening 122H may have an inner diameter that is not particularly limited. Accordingly, the inner diameter of the through opening 122H may be constant or varied in a direction in which the through opening 122H extends.

In this example, the inner diameter of the through opening 122H may be varied in the direction in which the through opening 122H extends. Specifically, the through opening 122H may have a decreasing inner diameter part 122HA and a constant inner diameter part 122HB that is coupled to the decreasing inner diameter part 122HA, as illustrated in FIGS. 5 and 6, for example. In other words, the through opening 122H may have the decreasing inner diameter part 122HA and the constant inner diameter part 122HB in order from the side on which the insertion pin 123 is to be inserted into the through opening 122H, for example.

The decreasing inner diameter part 122HA may be provided on the side away from the through opening 121H, and have an inner diameter that is decreased gradually toward the through opening 121H, for example. The constant inner diameter part 122HB may be provided on the side closer to the through opening 121H, and have an inner diameter that is constant, for example. The term "constant" is defined as described above.

In a case where the through opening 122H has the decreasing inner diameter part 122HA and the constant inner diameter part 122HB, the area of an entrance part, of the through opening 122H, into which the insertion pin 123 is to be inserted first is greater even when the constant inner diameter part 122HB has a small inner diameter, compared with a case where the through opening 122H has only the constant inner diameter 122HB. The greater area of the entrance part of the through opening 122H allows for easier insertion of the insertion pin 123 into the through opening 122H, particularly, easier insertion of the insertion pin 123 into a main part, i.e., the constant inner diameter part 122HB, of the through opening 122H.

When the cover 121 includes the projection 121PB, the support 122 may have a depression 122DB as illustrated in FIGS. 3 and 4, for example. The depression 122DB may extend in a direction (the Y-axis direction) similar to the direction in which the projection 121PB extends. The depression 122DB may allow the projection 121PB to be inserted into the depression 122DB. When the memory substrate 130 is attached to the containing unit 110 by means of the attachment unit 120, the projection 121PB may be inserted into the depression 122DB. The depression 122DB may correspond to a "second depression" in one specific but non-limiting embodiment of the technology.

The depression 122DB may have an opening shape that is not particularly limited as long as the opening shape allows the projection 121PB to be inserted into the depression 122DB. The opening shape of the depression 122DB may be therefore the same as the cross-sectional shape of the projection 121PB, or different from the cross-sectional shape of the projection 121PB. The opening shape of the depression 122DB may refer to that viewed from the Y-axis direction in this example. In this example, the opening shape of the depression 122DB may be the same as the cross-sectional shape of the projection 121PB.

The depression 121DB may be located at a position that is not particularly limited as long as the position does not overlap a region in which the memory substrate 130 is to be disposed as illustrated in FIG. 4, for example.

In this example, the depressions 122DA and 122DB may be provided respectively on one side and the other side of the memory substrate 130. The memory substrate 130 may therefore be disposed between the depressions 122DA and 122DB, for example.

When the memory substrate 130 is disposed between the depressions 122DA and 122DB, the memory substrate 130 may be sandwiched between the projection 121PA inserted in the depression 122DA and the projection 121PB inserted in the depression 122DB. This allows for easier alignment of the memory substrate 130 and for easier temporal fixation of the memory substrate 130.

In a case where the memory substrate 130 is disposed between the depressions 122DA and 122DB, a positional relationship between the depressions 122DA and 122DB is not particularly limited. In this example, in a case where the memory substrate 130 has the planar shape that is the rectangular shape having four corners, the depression 122DA may be located in the vicinity of one of the four corners, and the depression 122DB may be located in the vicinity of another of the four corners that is located diagonally to the corner in the vicinity of which the depression 122DA may be located. One reason for this is that such a positional relationship allows for easier alignment of the memory substrate 130, and for easier fixation of the memory substrate 130.

The support 122 may further include a rib 122R that defines the region in which the memory substrate 130 is to be disposed as illustrated in FIG. 4, for example. The rib 122R may be disposed in a region other than the region in which the memory substrate 130 is to be disposed. The rib 122R may correspond to a "third projection" in one specific but non-limiting embodiment of the technology.

The rib 122R is not particularly limited in its number. Therefore, only one rib 122R may be provided. Alternatively, two or more ribs 122R may be provided. Further, the rib 122R may be located at a position that is not particularly limited as long as the position is in the region other than the region in which the memory substrate 130 is to be disposed and allows the rib 122R to define the region in which the memory substrate 130 to be disposed.

In this example, the support 122 may have two ribs 122R, i.e., a rib 122RA and a rib 122RB, as illustrated in FIG. 4. The ribs 122RA and 122RB may be disposed respectively on one side and the other side of the region in which the memory substrate 130 is to be disposed. Specifically, the rib 122RA may be disposed next to the depression 122DA, and the rib 122RB may be disposed next to the depression 122DB, for example. The memory substrate 130 may thereby be disposed between the ribs 122RA and 122RB.

When the support 122 includes the ribs 122RA and 122RB and the memory substrate 130 is disposed between the thus-disposed ribs 122RA and 122RB, the position of the memory substrate 130 may be defined by the ribs 122RA and 122RB even before the insertion of the projection 121PA into the depression 122DA and the insertion of the projection 121PB into the depression 122DB. This allows for easier alignment of the memory substrate 130. This also makes it more difficult for the position of the memory substrate 130 to be shifted after the alignment of the memory substrate 130.

Moreover, the support 122 may include a wall 122W that is provided along part of the cover 121, as illustrated in FIGS. 3 and 4, for example. The wall 122W may not be particularly limited in its number. Therefore, only one wall 122W may be provided. Alternatively, two or more walls 122W may be provided. Further, the wall 122W may have a shape that is not particularly limited.

In this example, when the cover 121 has the rectangular planar shape, the support 122 may include two walls 122W, i.e., a wall 122WA and a wall 122WB, as illustrated in FIGS. 3 and 4, for example.

The wall 122WA may be disposed outside the cover 121 when the cover 121 is temporarily fixed by the insertion of the projection 121PA into the depression 122DA, for example. In other words, the wall 122WA may be disposed along an external wall surface of the cover 121, for example. In this example, the wall 122WA may be provided along two external wall surfaces that are adjacent to each other of four external wall surfaces of the cover 121. The wall 122WA may correspond to a "first wall" in one specific but non-limiting embodiment of the technology.

The wall 122WB may be disposed inside the cover 121 when the cover 121 is temporarily fixed by the insertion of the projection 121PA into the depression 122DA, for example. In other words, the wall 122WB may be disposed along an internal wall surface of the cover 121, for example. In this example, the wall 122WB may be provided along one, of four internal wall surfaces of the cover 121, for example. The one internal wall surface along which the wall 122WB is disposed may face one of the foregoing two external wall surfaces along which the wall 122WA is disposed. The wall 122WB may correspond to a "second wall" in one specific but non-limiting embodiment of the technology.

When the support 122 includes the wall 122WA disposed outside the cover 121 and the wall 122WB disposed inside the cover 121, the position of the cover 121 is defined by the walls 122WA and 122WB. This allows for easier alignment of the cover 121. This also makes it more difficult for the position of the cover 121 to be shifted after the alignment of the cover 121.

When the cover 121 has the opening 121FA, the support 122 may include a projection 122P, as illustrated in FIGS. 3 and 4, for example. The projection 122P may be provided in a region that overlaps the region in which the memory substrate 130 is to be disposed, for example. The projection 122P may therefore lift up the memory substrate 130 toward the opening 121FA. The projection 122P may not be particularly limited in its number. Therefore, only one projection 122P may be provided. Alternatively, two or more projections 122P may be provided. FIGS. 3 and 4 each illustrate an example case where one projection 122P is provided. The projection 122P may correspond to a "fourth projection" in one specific but non-limiting embodiment of the technology.

When the support 122 includes the projection 122P, the memory substrate 130 may be lifted up toward the opening 121FA by the projection 122P, as described above. The memory substrate 130 may be therefore held closer to the opening 121FA. This allows the information stored in the memory substrate 130 to be readable more easily through the opening 121FA.

The projection 122P may have a three-dimensional shape that is not particularly limited as long as the projection 122P is able to lift up the memory substrate 130.

In particular, the projection 122P may preferably have a shape that is easily broken upon application of external force, to allow the memory substrate 130 to be collected on an as-needed basis after the memory substrate 130 attached to the containing unit 110 by means of the attachment unit 120. Specifically, the three-dimensional shape of the projection 122P may be a plate-like shape, for example. More specifically, the projection 122P may have a plate-like shape that extends along the Y-Z plane, to allow the projection 122P to be easily broken upon application of external force through openings 121FB and 122F which will be described later in greater detail, for example.

In accordance thereto, the lid part 121L may have the opening 121FB, as illustrated in FIG. 3, for example, to allow for the application of the external force from the outside to the projection 122P even in the state where the memory substrate 130 is attached to the containing unit 110 by means of the attachment unit 120. The opening 121FB may correspond to a "second opening" in one specific but non-limiting embodiment of the technology.

The opening 121FB may be provided at a position that overlaps the projection 122P in the direction (the X-axis direction) intersecting the direction (the Y-axis direction) in which the projection 121PA extends, for example. The opening 121FB may be so provided at such a position as to allow for the application of the external force to the projection 122P through the opening 121FB. Specifically, the opening 121FB may be provided on a side surface of the lid part 121L, for example. The opening 121FB may be a through opening or a non-through opening. FIG. 3 illustrates an example case where the opening 121FB is the non-through opening.

The opening 121FB may have an opening shape that is not particularly limited. In this example, the opening shape of the opening 121FB may be a rectangular shape having two rounded corners that are adjacent to each other.

Moreover, when the support 122 includes the wall 122WA, the wall 122A may have the opening 122F as illustrated in FIGS. 2 to 4, for example. The wall 122A may have the opening 122F so as to allow for the application of the external force to the projection 122P from the outside even in the state where the memory substrate 130 is attached to the containing unit 110 by means of the attachment unit 120. The opening 122F may correspond to a "third opening" in one specific but non-limiting embodiment of the technology.

The opening 122F may be provided at a position that overlaps each of the projection 122P and the opening 121FB in the direction (the X-axis direction) intersecting the direction (the Y-axis direction) in which the projection 121PA extends, for example. The opening 122F may be provided at such a position so as to allow for the application of the external force to the projection 122P through the openings 121FB and 122F.

The opening 122F may have an opening shape that is not particularly limited. The opening 122F may therefore have a shape that is the same as the opening shape of the opening 121FB, or a shape that is different from the opening shape of the opening 121FB. FIGS. 2 and 3 each illustrate an example case where the opening shape of the opening 122F may be the same as the opening shape of the opening 121FB.

[Insertion Pin]

The insertion pin 123 may be a rod-like member that is insertable into the through openings 122H and 121H in this order.

When the memory substrate 130 is to be attached to the containing unit 110 by means of the attachment unit 120, insertion of the projection 121PA into the depression 122DA may cause the insertion pin 123 to be inserted into the through openings 122H and 121H in this order, in a state where the memory substrate 130 is sandwiched between the cover 121 and the support 122. Specifically, the insertion pin 123 may be inserted into the through opening 122H provided on the support 122 and thereafter inserted into the through opening 121H provided on the cover 121.

The insertion pin 123 may include one or more of materials such as a metal material and a polymer material, for example.

When the through opening 122H has the decreasing inner diameter part 122HA and the constant inner diameter part 122HB, it may be preferable that an end of the insertion pin 123 on the side farther from the through opening 121H, i.e., a rear end of the insertion pin 123, be located inside the constant inner diameter part 122HB as illustrated in FIG. 6, in a state where the insertion pin 123 is inserted into the through openings 122H and 121H in this order, for example. In other words, it may be preferable that the insertion pin 123 be pressed into the through opening 122H sufficiently enough for the rear end of the insertion pin 123 to be located inside the constant inner diameter part 122HB, when the insertion pin 123 is inserted into the through opening 122H.

It is more difficult for the insertion pin 123 to be removed from the through opening 122H, when the rear end of the insertion pin 123 is located inside the constant inner diameter part 122HB.

In greater detail, when the rear end of the insertion pin 123 is located inside the decreasing inner diameter part 122HA, a large gap may be present between the support 122 and the insertion pin 123. Therefore, it is easier to hold a part, of the insertion pin 123, in the vicinity of the rear end of the insertion pin 123 with a tool by inserting the tool in the large gap between the support 122 and the insertion pin 123. Non-limiting examples of the tool may include pliers. This makes it easier for the insertion pin 123 to be pulled out from the inside of the through opening 122H after the insertion pin 123 is inserted into the through opening 122H. Hence, the insertion pin 123 may be possibly removed unintentionally.

In contrast, when the rear end of the insertion pin 123 is located inside the constant inner diameter part 122HB, little gap is present between the support 122 and the insertion pin 123. Therefore, the part, of the insertion pin 123, in the vicinity of the rear end of the insertion pin 123 may be made more difficult to be held with a tool such as pliers. This makes it more difficult for the insertion pin 123 to be pulled out from the inside of the through opening 122H after the insertion pin 123 is inserted into the through opening 122H. Hence, the insertion pin 123 is prevented from being removed unintentionally.

The insertion pin 123 may have a three-dimensional shape that is not particularly limited as long as the insertion pin 123 has a rod-like shape that extends in a direction (the X-axis direction) in which the insertion pin 123 is inserted into the through openings 121H and 122H. In this example, the insertion pin 123 may include an increasing outer diameter part 123A and a constant outer diameter part 123B coupled to the increasing outer diameter part 123A in order from one end of the insertion pin 123, as illustrated in FIGS. 3, 5, and 6, for example. In other words, the insertion pin 123 may include the increasing outer diameter part 123A and the constant outer diameter part 123B in order from the side on which the insertion pin 123 is inserted into the through openings 121H and 122H, for example.

The increasing outer diameter part 123A may have an outer diameter that is increased gradually in a rearward direction from the one end of the insertion pin 123. The constant outer diameter part 123B may have a constant outer diameter, for example. The term "constant" related to the outer diameter is similar in its definition to the term "constant" related to the inner diameter described above.

In a case where the insertion pin 123 includes the increasing outer diameter part 123A, a tip of the insertion pin 123 is thinner, compared with a case where the insertion pin 123 does not include the increasing outer diameter part 123A. The thinner tip of the insertion pin 123 allows for easier insertion of the insertion pin 123 into the through openings 122H and 121H in this order. In this case, the insertion of the insertion pin 123 into the through opening 122H may be further easier when the through opening 122H has the decreasing inner diameter part 122HA.

The insertion pin 123 may further include a decreasing outer diameter part 123C together with the increasing outer diameter part 123A and the constant outer diameter part 123B, as illustrated in FIGS. 3, 5, and 6, for example. The decreasing outer diameter part 123C may be coupled to the constant outer diameter part 123B. The decreasing outer diameter part 123C may have an outer diameter that is decreased gradually in a direction of being away from the constant outer diameter part 123B.

In a case where the insertion pin 123 includes the decreasing outer diameter part 123C, the tip of the insertion pin 123 on one side is thinner and a tip of the insertion pin 123 on the other side is also thinner. The thinner tips of the insertion pin 123 on both side allow for easier insertion of the increasing outer diameter part 123A of the insertion pin 123 into the through opening 122H and allow for easier insertion of the decreasing outer diameter part 123C of the insertion pin 123 into the through opening 122H. Hence, the insertion of the insertion pin 123 into the through opening 122H is performed more easily, independently of the orientation of the insertion pin 123.

In the state where the insertion pin 123 is inserted into the through openings 122H and 121H in this order, it may be preferable that an end, of the insertion pin 123, that is on the side closer to the through opening 121H, i.e., a front end of the insertion pin 123, be located outside the through opening 121H, as illustrated in FIG. 6, for example. In other words, it may be preferable that the insertion pin 123 be pressed into the through opening 121H sufficiently enough for the front end of the insertion pin 123 to be located outside the through opening 121H, when the insertion pin 123 is inserted into the through opening 121H.

It is more difficult for the insertion pin 123 to be removed from the through opening 121H, when the front end of the insertion pin 123 is located outside the through opening 121H.

In greater detail, when the front end of the insertion pin 123 is located inside the through opening 121H, the increasing outer diameter part 123A may be located inside the through opening 121H. In this case, a gap may be present between the cover 121 and the insertion pin 123, making small the area in which the cover 121 and the insertion pin 123 are brought into contact with each other. This may lead to a decrease in frictional force between the through opening 121H and the insertion pin 123 that is generated when the insertion pin 123 is to be pulled out from the through opening 121H. Hence, the insertion pin 123 may be possibly removed from the through opening 121H more easily after the insertion pin 123 is inserted into the through opening 121H.

In contrast, when the front end of the insertion pin 123 is located outside the through opening 121H, the constant outer diameter part 123B may be located inside the through opening 121H. In this case, it may be more difficult for a gap to be present between the cover 121 and the insertion pin 123, compared with a case where the increasing outer diameter part 123A is located inside the through opening 121H. This may make large the area in which the cover 121 and the insertion pin 123 are brought into contact with each other. This may lead to an increase in frictional force between the through opening 121H and the insertion pin 123 that is generated when the insertion pin 123 is to be pulled out from the through opening 121H. Hence, it is more difficult for the insertion pin 123 to be removed from the through opening 121H after the insertion pin 123 is inserted into the through opening 121H.

In particular, it may be preferable that the increasing outer diameter part 123A be located outside the through opening 121H when the front end of the insertion pin 123 is located outside the through opening 121H. One reason for this is that the area in which the cover 121 and the insertion pin 123 are brought into contact with each other may be increased, i.e., the frictional force between the cover 121 and the insertion pin 123 may be increased owing to the arrangement in which the increasing outer diameter part 123A is not located inside the through opening 121H and the constant outer diameter part 123B is located inside the through opening 121H. Hence, it is further more difficult for the insertion pin 123 to be removed from the through opening 121H.

A relationship between the configuration of the insertion pin 123 and the configuration of the through openings 121H and 122H may not be particularly limited as long as the insertion pin 123 is insertable into the through opening 122H. Non-limiting examples of the foregoing configuration of the insertion pin 123 may include the outer diameter of the insertion pin 123. Non-limiting examples of the foregoing configuration of the through openings 121H and 122H may include the inner diameters of the through openings 121H and 122H.

Figure 7:
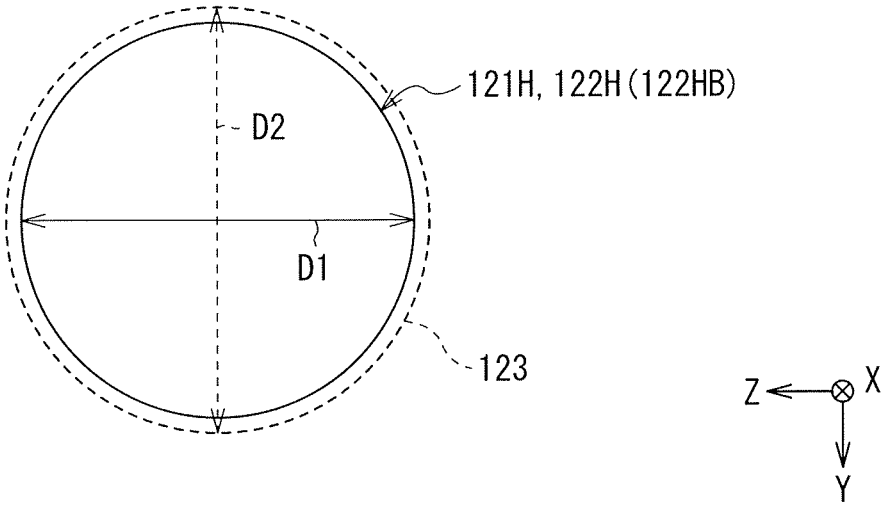
FIG. 7 is a plan view of a configuration example of an insertion member.
Figure 8:
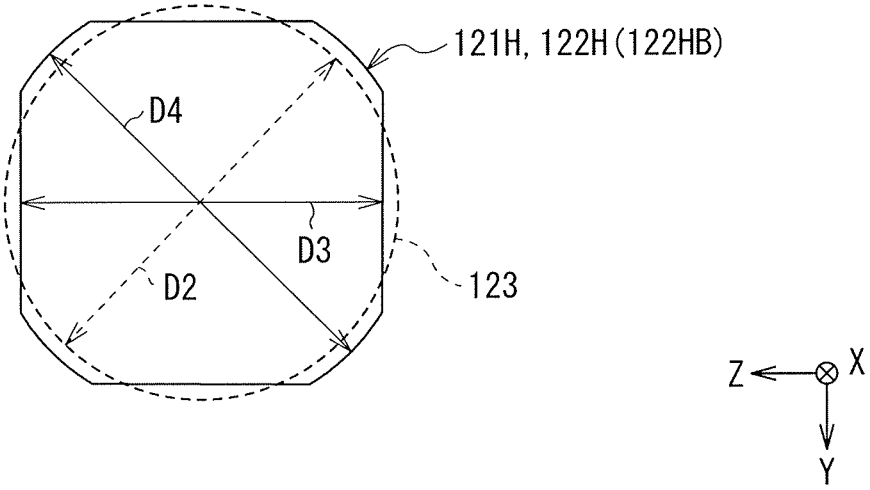
FIG. 8 is a plan view of another configuration example of the insertion member.

FIGS. 7 and 8 each describe a relationship between the outer diameter of the insertion pin 123 and the inner diameter of each of the through opening 121H and the through opening 122H, specifically, the constant inner diameter part 122HB. Specifically, FIGS. 7 and 8 each illustrate an outline of the outer diameter of the insertion pin 123 and an outline of the inner diameter of each of the through opening 121H and the constant inner diameter part 122HB viewed from the X-axis direction with a dashed line and a solid line, respectively.

The insertion pin 123 may be modifiable by means of contraction or compression in accordance with external force, for example. In other words, the insertion pin 123 may include a material that is modified easily in accordance with the external force, for example. More specifically, the insertion pin 123 may include one or more of materials such as a modifiable polymer material. In contrast, the support 122 provided with the constant inner diameter part 122HB may include a material that is more difficult to be modified than the material of the insertion pin 123, for example. More specifically, the support 122 may include one or more of materials such as a rigid metal material.

When the insertion pin 123 that is modifiable by means of contraction in accordance with the external force is used, the outer diameter of the insertion pin 123, i.e., an outer diameter D2 of the insertion pin 123 illustrated in FIG. 7 as a whole may be greater than the inner diameter of the constant inner diameter part 122HB, i.e., an inner diameter D1 of the constant inner diameter part 122HB illustrated in FIG. 7, for example. The insertion pin 123 may have the outer diameter D2 that is even, for example.

In a process of the insertion of the insertion pin 123 into the constant inner diameter part 122HB in this case, the insertion pin 123 may be inserted into the constant inner diameter part 122HB while the insertion pin 123 is modified as a whole by means of contraction, i.e., while the insertion pin 123 as a whole is squeezed into the constant inner diameter part 122HB. This allows the support 122 as a whole, i.e, the inner wall surface of the constant inner diameter part 122HB, and the insertion pin 123 as a whole to be attached to each other more firmly, therefore increasing the frictional force between the support 122 and the insertion pin 123. Hence, it is more difficult for the insertion pin 123 to be removed from the constant inner diameter part 122HB.

The foregoing relationship between the outer diameter D2 of the insertion pin 123 and the inner diameter D1 of the constant inner diameter part 122HB may be similarly applicable to a relationship between the outer diameter D2 of the insertion pin 123 and the inner diameter D1 of the through opening 121H, for example. Specifically, the cover 121 provided with the through opening 121H may include one or more of materials such as a modifiable polymer material, and the outer diameter D2 of the insertion pin 123 as a whole may be greater than the inner diameter D1 of the through opening 121H. This makes it more difficult for the insertion pin 123 to be removed from the through opening 121H. The inner diameter D1 of the constant inner diameter part 122HB and the inner diameter D1 of the through opening 121H may be the same as each other or may be different from each other.

It is to be noted that the relationship between the outer diameter D2 of the insertion pin 123 and the inner diameter D1 of each of the through opening 121H and the constant inner diameter part 122HB is not limited to the relationship in which the outer diameter D2 of the insertion pin 123 as a whole is greater than the inner diameter D1 of each of the through opening 121H and the constant inner diameter part 122HB. Alternatively, the outer diameter D2 of the insertion pin 123 as a whole may be greater than only the inner diameter D1 of the through opening 121H. Alternatively, the outer diameter D2 of the insertion pin 123 as a whole may be greater than only the inner diameter D1 of the constant inner diameter part 122HB. In the case where the outer diameter D2 of the insertion pin 123 as a whole is greater than only the inner diameter D1 of the through opening 121H, the inner diameter D1 of the constant inner diameter part 122HB may be almost the same as the outer diameter D2 of the insertion pin 123, for example. In the case where the outer diameter D2 of the insertion pin 123 as a whole is greater than only the inner diameter D1 of the constant inner diameter part 122HB, the inner diameter D1 of the through opening 121H may be almost the same as the outer diameter D2 of the insertion pin 123, for example.

When the insertion pin 123 that is modifiable by means of contraction in accordance with the external force is used, the outer diameter D2 of the insertion pin 123 may be partially greater than the inner diameter of the constant inner diameter part 122HB, i.e., inner diameters D3 and D4 of the constant inner diameter part 122HB illustrated in FIG. 8, for example. Specifically, the constant inner diameter part 122HB may have the inner diameter D4 that is relatively great, and the inner diameter D3 that is relatively small, for example. More specifically, the inner diameter of the constant inner diameter part 122HB may be greater than the outer diameter D2 of the insertion pin 123 at one or more locations, i.e., one or more locations having the inner diameter D4, and may be smaller than the outer diameter D2 of the insertion pin 123 at other one or more locations, i.e., one or more locations having the inner diameter D3, for example. It is to be noted that the inner diameter of the constant inner diameter part 122HB may be the same as the outer diameter D2 of the insertion pin 123 at one or more locations other than the foregoing locations, for example.

In this example, the outer diameter D2 of the insertion pin 123 may be greater than the inner diameter D3 of the constant inner diameter part 122HB at four locations that are away from each other, and may be smaller than the inner diameter D4 of the constant inner diameter part 122HB at other four locations that are away from each other.

In a process of the insertion of the insertion pin 123 into the constant inner diameter part 122HB in this case, the insertion pin 123 may be inserted into the constant inner diameter part 122HB while the insertion pin 123 is modified partially by means of contraction. This allows the support 122, i.e, the inner wall surface of the constant inner diameter part 122HB, and the insertion pin 123 to be attached partially to each other more firmly, therefore increasing the frictional force between the support 122 and the insertion pin 123. Hence, it is more difficult for the insertion pin 123 to be removed from the constant inner diameter part 122HB. In addition thereto, the outer diameter D2 of the insertion pin 123 as a whole may be greater than the inner diameter D1 of the constant inner diameter part 122HB in this case. Therefore, the insertion of the insertion pin 123 into the constant inner diameter part 122HB may be easier, compared with a case illustrated in FIG. 7 where the insertion pin 123 is inserted into the constant inner diameter part 122HB while the insertion pin 123 as a whole is modified by means of contraction.

The foregoing relationship between the outer diameter D2 of the insertion pin 123 and the inner diameters D3 and D4 of the constant inner diameter part 122HB may be similarly applicable to a relationship between the outer diameter D2 of the insertion pin 123 and inner diameters D3 and D4 of the through opening 121H, for example. Specifically, the outer diameter D2 of the insertion pin 123 may be partially greater than the inner diameters D3 and D4 of the through opening 121H. This makes it more difficult for the insertion pin 123 to be removed from the through opening 121H.

It is to be noted that the relationship between the outer diameter D2 of the insertion pin 123 and the inner diameters D3 and D4 of each of the through opening 121H and the constant inner diameter part 122HB is not limited to the relationship in which the outer diameter D2 of the insertion pin 123 is partially greater than the inner diameters D3 and D4 of each of the through opening 121H and the constant inner diameter part 122HB. Alternatively, the outer diameter D2 of the insertion pin 123 may be partially greater than only the inner diameters D3 and D4 of the through opening 121H. Alternatively, the outer diameter D2 of the insertion pin 123 may be partially greater than only the inner diameters D3 and D4 of the constant inner diameter part 122HB. In the case where the outer diameter D2 of the insertion pin 123 is partially greater than only the inner diameters D3 and D4 of the through opening 121H, the inner diameters D3 and D4 of the constant inner diameter part 122HB may be almost the same as the outer diameter D2 of the insertion pin 123, for example. In the case where the outer diameter D2 of the insertion pin 123 is partially greater than only the inner diameters D3 and D4 of the constant inner diameter part 122HB, the inner diameters D3 and D4 of the through opening 121H may be almost the same as the outer diameter D2 of the insertion pin 123, for example.

<1-3. Configuration of Toner>

A configuration of the toner is described below.

The toner cartridge 100 may contain one type of toner, i.e., one color of toner, for example. The type, i.e., the color of the toner contained in the toner cartridge 100 may be as follows, for example.

For example, four types, i.e., four colors, of toners may be used to form a full-color image on a surface of a medium. The four types of toners may include a yellow toner, a magenta toner, a cyan toner, and a black toner, for example.

The toner cartridge 100 designed to be used for the formation of a yellow image may contain the yellow toner. The toner cartridge 100 designed to be used for the formation of a magenta image may contain the magenta toner. The toner cartridge 100 designed to be used for the formation of a cyan image may contain the cyan toner. The toner cartridge 100 designed to be used for the formation of a black image may contain the black toner.

The yellow toner may include materials such as a yellow coloring agent, a binder, an external additive, a release agent, and an electric charge control agent, for example. The yellow coloring agent may include one or more of materials such as a yellow pigment and a yellow dye. Non-limiting examples of the yellow pigment may include Pigment Yellow 74. Non-limiting examples of the yellow dye may include C.I. Pigment Yellow 74 and cadmium yellow.

The magenta toner may have a configuration similar to the configuration of the yellow toner except that the magenta toner includes a magenta coloring agent instead of the yellow coloring agent. The magenta coloring agent may include one or more of materials such as a magenta pigment and a magenta dye, for example. Non-limiting examples of the magenta pigment may include quinacridone. Non-limiting examples of the magenta dye may include C.I. Pigment Red 238.

The cyan toner may have a configuration similar to the configuration of the yellow toner except that the cyan toner includes a cyan coloring agent instead of the yellow coloring agent. The cyan coloring agent may include one or more of materials such as a cyan pigment and a cyan dye, for example. Non-limiting examples of the cyan pigment may include phthalocyanine blue such as C.I. Pigment Blue 15:3. Non-limiting examples of the cyan dye may include Pigment Blue 15:3.

The black toner may have a configuration similar to the configuration of the yellow toner except that the black toner includes a black coloring agent instead of the yellow coloring agent. The black coloring agent may include one or more of materials such as a black pigment and a black dye, for example. Non-limiting examples of the black pigment may include carbon. Non-limiting examples of the black dye may include carbon black. Non-limiting examples of the carbon black may include furnace black and channel black.

<1-4. Procedure of Attachment of Memory Substrate>

A description is given below of a procedure of the attachment of the memory substrate 130 with reference to FIGS. 1 to 8.

The memory substrate 130 may be attached to the containing unit 110 by means of the attachment unit 120 by the following procedure, for example. The description below is given on the premise that the cover 121 and the memory substrate 130 are separated from the containing unit 110.

When the memory substrate 130 is to be attached to the containing unit 110 by means of the attachment unit 120, first, the memory substrate 130 may be placed on the support 122 as illustrated in FIGS. 3 and 4.

Upon placing the memory substrate 130 on the support 122, the memory substrate 130 may be disposed between the depressions 122DA and 122DB by placing the memory substrate 130 between the ribs 122RA and 122RB. The memory substrate 130 may be thereby held in a state where the memory substrate 130 is lifted up by the projection 122P.

Thereafter, the cover 121 may be attached to the support 122 as illustrated in FIGS. 3 and 5. The memory substrate 130 may be thereby covered by the cover 121. Accordingly, the memory substrate 130 may be contained inside the cover 121.

Upon attaching the cover 121 to the support 122, the projection 121PA may be inserted into the depression 122DA, and the projection 121PB may be inserted into the depression 122DB. Further, the wall 122WA may be caused to be located outside the cover 121, and the wall 122WB may be caused to be located inside the cover 121. Further, the position of the opening 121FB and the position of the opening 122F may be caused to be coincident with each other. This may cause the cover 121 to be aligned with the support 122, and cause the memory substrate 130 to be sandwiched between the cover 121 and the support 122. The memory substrate 130 may be thereby temporarily fixed to the containing unit 110.

Lastly, the insertion pin 123 may be inserted into the through openings 122H and 121H in this order as illustrated in FIGS. 5 to 8.

Upon the insertion of the insertion pin 123 into the through openings 122H and 121H in this order, the insertion pin 123 may be inserted into the through opening 122H, and thereafter, the insertion pin 123 may be also inserted into the through opening 121H, as illustrated in FIG. 6. Further, the front end of the insertion pin 123 may be caused to be located outside the through opening 121H, and the rear end of the insertion pin 123 may be caused to be located inside the constant inner diameter part 122HB, after completion of the insertion of the insertion pin 123. In this case, the insertion pin 123 may be pressed enough for the increasing outer diameter part 123A to be disposed outside the through opening 121H in particular.

When the position of the through opening 121H and the position of the through opening 122H are shifted from each other, the insertion pin 123 inserted into the through opening 122H may be difficult to be inserted into the through opening 121H in some cases. When the insertion of the insertion pin 123 involves such a difficulty, the insertion pin 123 may be inserted into the through opening 121H by utilizing the difference between the thicknesses T1 and T2 of the lid part 121L to finely adjust the position of the through opening 121H provided on the projection 121PA in the top-bottom direction.

The insertion pin 123 may be thereby inserted into the through openings 122H and 121H in this order in the state where the memory substrate 130 is sandwiched between the cover 121 and the support 122 as illustrated in FIGS. 1 and 2. This allows for full fixation of the memory substrate 130 to the containing unit 110. As a result, the attachment of the memory substrate 130 by means of the attachment unit 120 may be completed.

In a state where the attachment of the memory substrate 130 is completed, the memory substrate 130 may be fixed to the containing unit 110. This makes it more difficult for the memory substrate 130 to fall off upon the use of the toner cartridge 100. In addition, it may be difficult to pull out the insertion pin 123 from each of the through openings 121H and 122H with a tool such as pliers, owing to the insertion of the insertion pin 123 into each of the through openings 121H and 122H. Hence, it is difficult to remove the insertion pin 123.

In some cases, the memory substrate 130 may have to be collected after the completion of its attachment on an as-needed basis for a reason such as mistakenly-performed attachment of a memory substrate 130 which has not been intended to be attached. Upon the necessity of collecting the attached memory substrate 130, the projection 122P that lifts up the memory substrate 130 may be broken. Specifically, the projection 122P may be broken by inserting a tool inside the cover 121 through the openings 121FB and 122F and utilizing external force derived from the insertion of the tool, as illustrated in FIGS. 2 to 4, for example. Non-limiting examples of the tool may include a driver. Upon breaking the projection 122P, the projection 122P may be bent, or may be taken away from the support 122.

The breaking of the projection 122P may cause the position of the memory substrate 130 to be shifted downward inside the cover 121, thereby providing an extra space between the memory substrate 130 and the opening 121FA. As a result, it is possible to collect the memory substrate 130 contained inside the cover 121 through the opening 121FA with a tool such as tweezers.

<1-5. Example Workings and Example Effects>

In the foregoing toner cartridge 100, the insertion pin 123 may be inserted into the through openings 122H and 121H in this order in a state where the projection 121PA is inserted into the depression 122DA and the memory substrate 130 is thereby sandwiched between the cover 121 and the support 122 in the attachment unit 120. In this case, the cover 121 may be fixed to the support 122 in a state where the memory substrate 130 is contained inside the cover 121 as described above. The memory substrate 130 may be therefore fixed to the support 122. This makes it more difficult for the memory substrate 130 to fall off after the completion of the attachment of the memory substrate 130. Hence, it is also possible to prevent the memory substrate 130 from falling off. In addition, the cover 121 is more difficult to be removed after the completion of the attachment of the memory substrate 130. Hence, it is possible to prevent the memory substrate 130 from being removed.

In particular, when the through opening 122H has the decreasing inner diameter part 122HA and the constant inner diameter part 122HB, insertion of the insertion pin 123 into the through opening 122H is easier, and insertion of the insertion pin 123 into the main part of the through opening 122H, i.e., the constant inner diameter part 122HB, is easier. Hence, it is possible to easily perform the attachment of the memory substrate 130.

In addition, when the rear end of the insertion pin 123 is located inside the constant inner diameter part 122HB, the insertion pin 123 is more difficult to be pulled out from the through opening 122H. Hence, it is possible to achieve higher effects.

Further, when the insertion pin 123 includes the increasing outer diameter part 123A, insertion of the insertion pin 123 into each of the through openings 121H and 122H is easier. Hence, it is possible to perform the attachment of the memory substrate 130 more easily.

In addition, when the front end of the insertion pin 123 is located outside the through opening 121H, the area in which the cover 121 and the insertion pin 123 are brought into contact with each other may be increased, i.e., the frictional force between the cover 121 and the insertion pin 123 may be increased. Further, when the increasing outer diameter part 123A of the insertion pin 123 is located outside the through opening 121H, the area in which the cover 121 and the insertion pin 123 are brought into contact with each other may be further increased, i.e., the frictional force between the cover 121 and the insertion pin 123 may be further increased. This makes it more difficult for the insertion pin 123 to be pulled out from the through opening 121H. Hence, it is possible to achieve higher effects.

Moreover, in a case where the insertion pin 123 is modifiable by means of contraction in accordance with external force, when the outer diameter of the insertion pin 123 as a whole is greater than the inner diameter of the through opening 121H or when the outer diameter of the insertion pin 123 is partially greater than the inner diameter of the through opening 121H, the attachment force, i.e., the frictional force, between the cover 121 and the insertion pin 123 may be increased. This makes it more difficult for the insertion pin 123 to be pulled out from the through opening 121H. Hence, it is possible to achieve higher effects. The effects are achievable in a similar or the same manner also when the outer diameter of the insertion pin 123 as a whole is greater than the inner diameter of the constant inner diameter part 122HB, or when the outer diameter of the insertion pin 123 is partially greater than the inner diameter of the constant inner diameter part 122HB.

Moreover, when the cover 121 includes the projection 121PB and the support 122 has the depression 122DB, the cover 121 may be more difficult to be rotated, owing to insertion of the projection 121PB into the depression 122DB. This allows for easier alignment of the cover 121 and easier fixation of the cover 121. Hence, it is possible to perform the attachment of the memory substrate 130 more easily.

In addition, when the memory substrate 130 is disposed between the depressions 122DA and 122DB, the memory substrate 130 may be sandwiched between the projection 121PA inserted into the depression 122DA and the projection 121PB inserted into the depression 122DB. This allows for further easier alignment of the memory substrate 130 and further easier temporal fixation of the memory substrate 130. Hence, it is possible to perform the attachment of the memory substrate 130 more easily.

Moreover, when the support 122 includes the rib 122R, the position of the memory substrate 130 may be defined by the rib 122R even before the insertion of the projection 121PA into the depression 122DA and the insertion of the projection 121PB into the depression 122DB. This allows for easier alignment of the memory substrate 130, and makes it more difficult for the position of the memory substrate 130 to be shifted after the alignment of the memory substrate 130. Hence, it is possible to perform the attachment of the memory substrate 130 more easily.

In addition, when the support 122 includes the two ribs 122R, i.e., the ribs 122RA and 122RB, and the memory substrate 130 is disposed between the ribs 122RA and 122RB, the alignment of the memory substrate 130 may be further easier, and the position of the memory substrate 130 may be further more difficult to be shifted after the alignment of the memory substrate 130. Hence, it is possible to perform the attachment of the memory substrate 130 more easily.

Moreover, when the cover 121 includes the lid part 121L, and the thickness T1 of the lid part 121L on the side closer to the projection 121PA is smaller than the thickness T2 of the lid part 121L on the side away from the projection 121PA, it may be easier to finely adjust the position of the through opening 121H provided on the cover 121 in the top-bottom direction. Accordingly, the insertion of the insertion pin 123 into the through opening 121H may be made easier by causing the position of the through opening 121H and the position of the through opening 122H to be coincident with each other. Hence, it is possible to perform the attachment of the memory substrate 130 more easily.

Moreover, when the support 122 includes the wall 122W provided along the cover 121, the position of the cover 121 may be defined by the wall 122W. This allows for easier alignment of the cover 121, and makes it more difficult for the position of the cover 121 to be shifted after the alignment of the cover 121. Hence, it is possible to perform the attachment of the memory substrate 130 more easily.

In addition, when the support 122 includes the two walls 122W, i.e., the wall 122WA that is located outside the cover 121 and the wall 122WB that is located inside the cover 121, the alignment of the cover 121 may be easier, and the position of the cover 121 may be more difficult to be shifted after the alignment of the cover 121. Hence, it is possible to perform the attachment of the memory substrate 130 more easily.

Moreover, when the cover 121 has the opening 121FA, it is possible to read the information stored in the memory substrate 130 through the opening 121FA even in the state where the memory substrate 130 is attached to the containing unit 110 by means of the attachment unit 120.

In addition, when the support 122 includes the projection 122P, the memory substrate 130 may be lifted up by the projection 122P. Hence, it is possible to easily read the information stored in the memory substrate 130 through the opening 121FA.

Moreover, in the case where the support 122 includes the projection 122P, when the cover has the opening 121FB and the wall 122WA has the opening 122F, it is possible to break the projection 122P by applying external force to the inside of the cover 121 through the openings 121FB and 122F on an as-needed basis and utilizing the external force, after the attachment of the memory substrate 130. Hence, it is possible to collect the memory substrate 130 through the opening 121FA on an as-needed basis after the attachment of the memory substrate 130.

2. Toner Container (Second Example Embodiment)

A description is given of a toner container according to a second example embodiment of the technology.

<2-1. Configuration>

A description is given first of a configuration of a toner cartridge 200 that is an example of the toner container according to the second example embodiment of the technology. The toner cartridge 100 and the components of the toner cartridge 100 described above will be referred to in the description below where appropriate.

The toner cartridge 200 may contain a toner, as with the toner cartridge 100. The use of the toner cartridge 200 may be similar to or the same as that of the toner cartridge 100, for example. Details of the toner may be as described above, for example.

Figure 9:
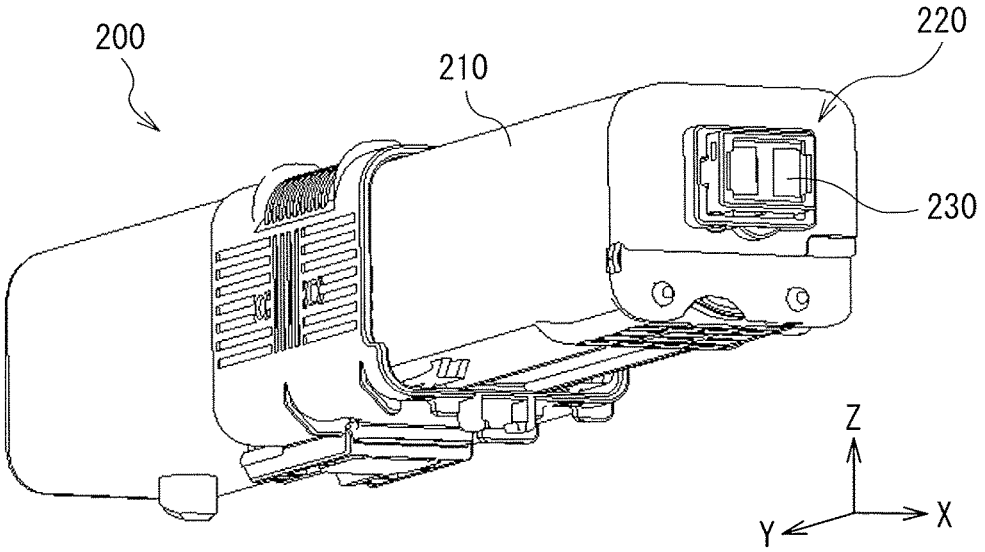
FIG. 9 is a perspective view of a configuration example of a toner container (a toner cartridge) according to a second example embodiment of the technology.

FIG. 9 is a perspective view of the configuration of the toner cartridge 200. The toner cartridge 200 may include a containing unit 210, an attachment unit 220 provided on the containing unit 210, and a memory substrate 230 attached to the containing unit 210 by means of the attachment unit 220, for example. The memory substrate 230 may correspond to the "storage device" in one specific but non-limiting embodiment of the technology.

Details of the containing unit 210 may be similar to or the same as the details of the containing unit 110, for example. Further, details of the memory substrate 230 may be similar or the same as to the details of the memory substrate 130, for example.

The attachment unit 220 may be an attachment mechanism that has a function similar to or the same as the function of the attachment unit 120. The attachment unit 220 is mainly used to attach the memory substrate 230 to the containing unit 210. The attachment unit 220 may be provided at a position, in the containing unit 210, which is not particularly limited. For example, the attachment unit 220 may be provided on an end surface of the containing unit 210 in a longitudinal direction, i.e., the Y-axis direction. A configuration of the attachment unit 220 will be described later in greater detail with reference to FIGS. 10 to 15.

Figure 10:
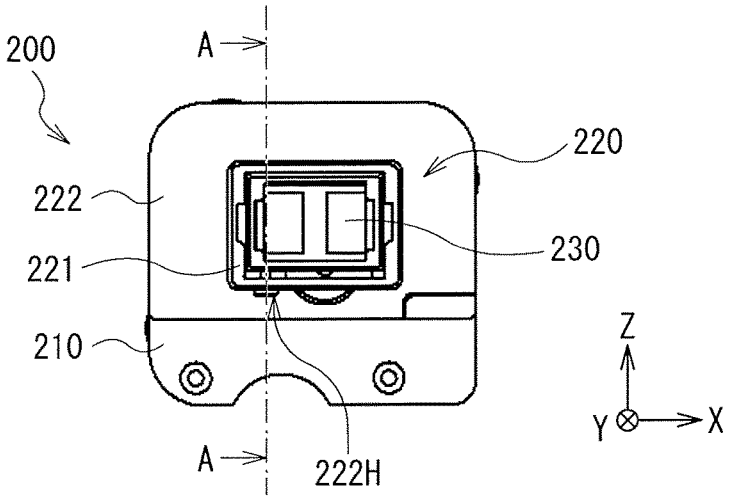
FIG. 10 is a plan view of a configuration example of a main part of the toner cartridge illustrated in FIG. 9.
Figure 11:
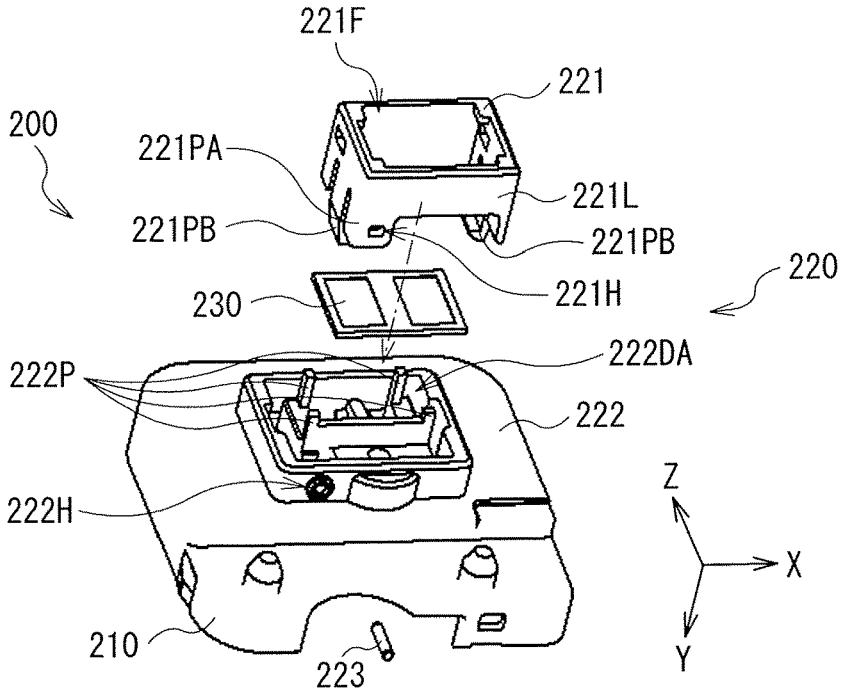
FIG. 11 is a perspective view of the configuration example of the main part of the toner cartridge illustrated in FIG. 9.
Figure 12:
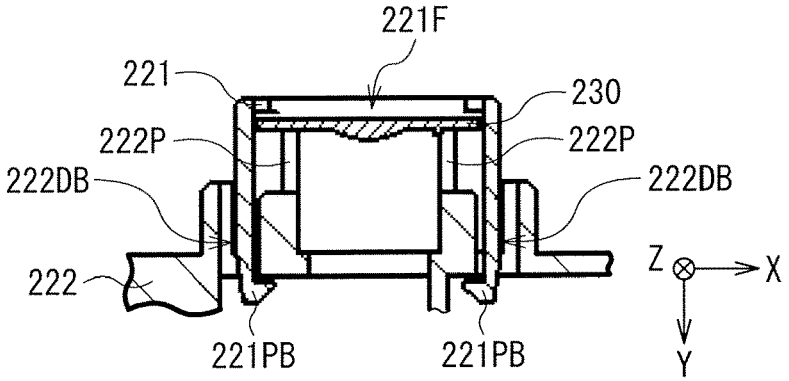
FIG. 12 is a cross-sectional view of the configuration example of the main part of the toner cartridge illustrated in FIG. 9.

FIG. 10 illustrates a planar configuration of a main part of the toner cartridge 200. FIG. 11 is a perspective view of the configuration of the main part of the toner cartridge 200. FIG. 12 illustrates a cross-sectional configuration of the main part of the toner cartridge 200. Each of FIGS. 10 and 12 illustrates a state where the members including the memory substrate 230 is attached to the containing unit 210, whereas FIG. 11 illustrates a state where the members including the memory substrate 230 is separated from the containing unit 210 for illustration purpose of a positional relationship between the members including the memory substrate 230.

Figure 13:
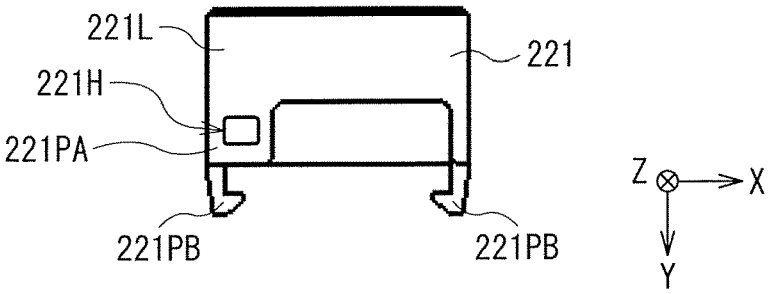
FIG. 13 is a plan view of a configuration example of a cover.
Figure 14:
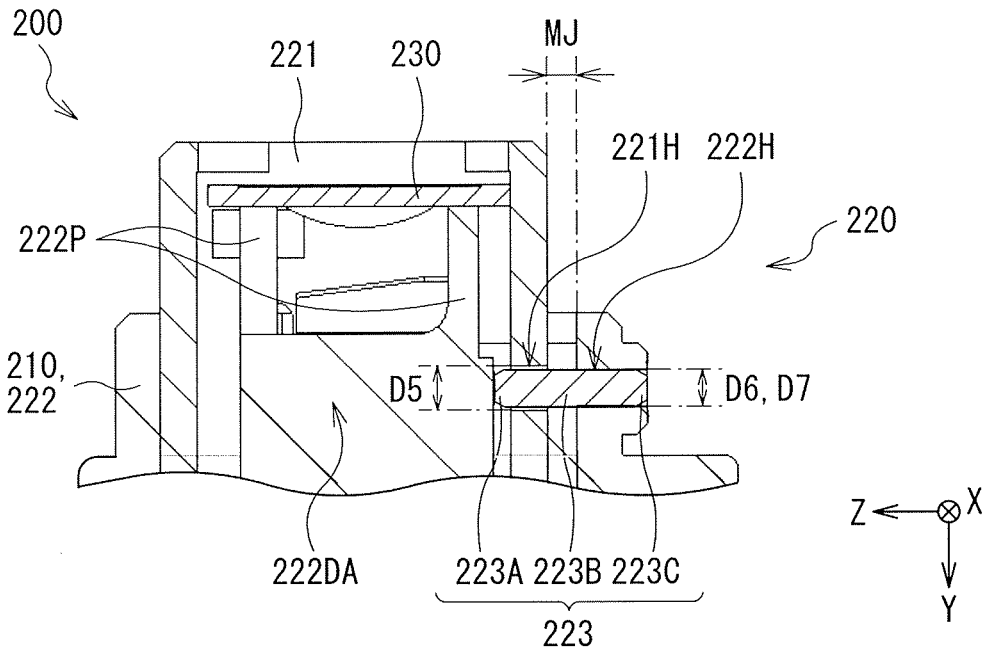
FIG. 14 is an enlarged cross-sectional view of the configuration example of the toner cartridge taken along a line A-A illustrated in FIG. 10.
Figure 15:
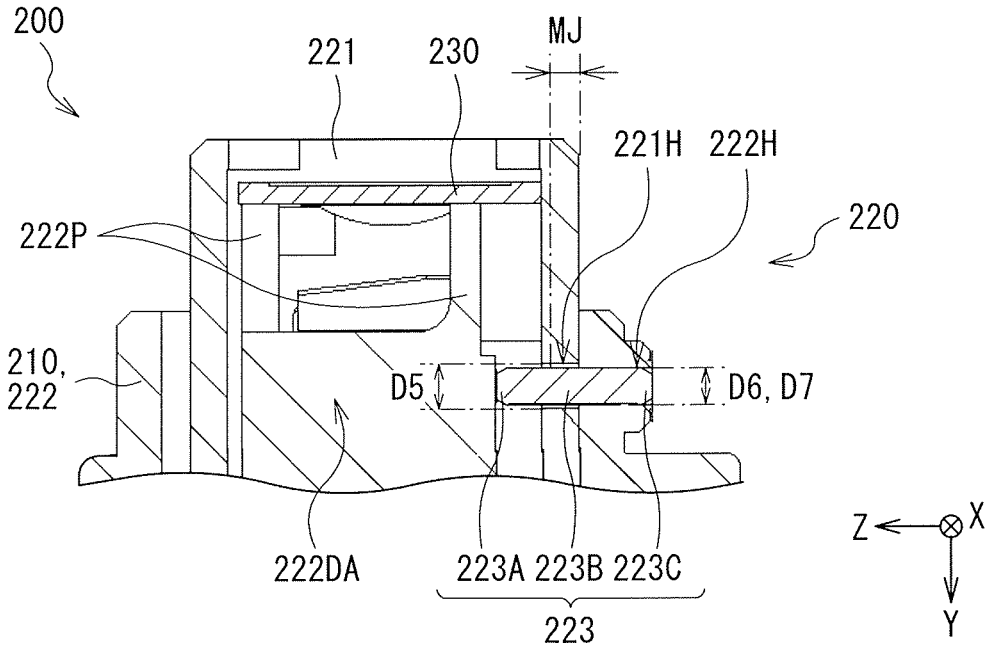
FIG. 15 is an enlarged cross-sectional view of another configuration example of the toner cartridge taken along the line A-A illustrated in FIG. 10.

FIG. 13 illustrates a planar configuration of a cover 221. Each of FIGS. 14 and 15 illustrates an enlarged cross-sectional configuration of the toner cartridge 200 taken along a line A-A illustrated in FIG. 10. FIG. 14 illustrates a state before movement of the cover 221, whereas FIG. 15 illustrates a state after the movement of the cover 221.

Referring to FIGS. 10 to 13, the attachment unit 220 may include the cover 221, a support 222 that is part of the containing unit 210 (the container), and an insertion pin 223, for example. The cover 221, the support 222, and the insertion pin 223 may respectively correspond to the "cover member", the "supporting member", and the "insertion member" in one specific but non-limiting embodiment of the technology.

The cover 221 may mainly cover the memory substrate 230 that is placed on the support 222, i.e., one surface of the containing unit 210. Details of the cover 221 including a three-dimensional shape of the cover 221 may be similar to or the same as the details of the cover 121 including the three-dimensional shape of the cover 121, for example.

Referring to FIG. 11, the cover 221 may include a projection 221PA. The projection 221PA may extend in a predetermined direction. Specifically, the projection 221PA may extend in a direction of being closer to the support 222, i.e., the Y-axis direction. The projection 221PA may have a cross-sectional shape details of which are similar to or the same as the details of the cross-sectional shape of the projection 121PA, for example. The projection 221PA may correspond to the "first projection" in one specific but non-limiting embodiment of the technology. The Y-axis direction may correspond to the "first direction" in one specific but non-limiting embodiment of the technology.

One reason that the cover 221 may include the projection 221PA is that insertion of the projection 221PA into a depression 222DA in the support 222 allows for easier alignment of the cover 221 with respect to the support 222 and easier temporal fixation of the cover 221 to the support 222. The depression 222DA in the support 222 will be described later in greater detail.

Referring to FIGS. 11 and 13, the projection 221PA may be provided with a through opening 221H. The through opening 221H may extend in a direction (the Z-axis direction) intersecting a direction (the Y-axis direction) in which the projection 221PA extends. The through opening 221H may correspond to the "insertion opening" in one specific but non-limiting embodiment of the technology. The Z-axis direction may correspond to the "second direction" that intersects the "first direction" in one specific but non-limiting embodiment of the technology.

One reason that the projection 221PA may have the through opening 221H is that insertion of the insertion pin 223 into the through opening 221H allows for full fixation of the cover 221 to the support 222, as will be described later in greater detail.

The through opening 221H may have an opening shape that is not particularly limited. For example, the opening shape of the through opening 221H may be a rectangular shape with four rounded corners as illustrated in FIGS. 11 and 13. The opening shape of the through opening 221H may refer to that viewed from the Z-axis direction in this example.

The through opening 221H may have an inner diameter that is not particularly limited. The inner diameter of the through opening 221H may be therefore constant or varied in a direction in which the through opening 221H extends. In this example, the inner diameter of the through opening 221H may be constant in the direction in which the through opening 221H extends. Details of the inner diameter of the through opening 221H will be described later.

Referring to FIGS. 11 and 12, the cover 221 may include a projection 221PB together with the foregoing projection 221PA, for example. The projection 221PB may extend in a direction along the direction in which the projection 221PA extends, for example. The projection 221PB may therefore extend in the direction (the Y-axis direction) similar to the direction in which the projection 221PA extends. The projection 221PB may correspond to the "second projection" in one specific but non-limiting embodiment of the technology.

When the cover 221 includes the projections 221PA and 221PB, it may be more difficult for the cover 221 to be rotated around the projection 221PA as a rotation axis. Accordingly, this allows the cover 221 to be aligned more easily and to be temporarily fixed more firmly to the support 222.

The projection 221PB may not be particularly limited in its number. Therefore, only one projection 221PB may be provided. Alternatively, two or more projections 221PB may be provided. In this example, two projections 221PB may be provided. The two projections 221PB may be so disposed as to face each other in a direction (the X-axis direction) that intersects the direction in which the projection 221PA extends, for example.

The projections 221PB may each have a cross-sectional shape that is not particularly limited. In this example, the cross-sectional shape of each of the projections 221PB may be a hook-like shape in which a portion in the vicinity of its tip is bent in a way or any other shape, as illustrated in FIG. 12. The cross-sectional shape of each of the projections 221PB may refer to that taken along the X-Y plane in this example.

Specifically, each of the projections 221PB may include a root portion and a tip portion, for example. The root portion may extend in a direction (the Y-axis direction) similar to the direction in which the corresponding projection 221PB extends, for example. The tip portion may be coupled to the corresponding root portion, and extend in a direction (the X-axis direction) that intersects the direction in which the corresponding root portion extends. The tip portion may have a tip shape that is not particularly limited. For example, the tip portion may have a sharp shape. The tip portion of one of the projections 221PB and the tip portion of the other of the projections 221PB may extend toward each other, for example.

The cover 221 may further include a lid part 221L that covers the memory substrate 230, as illustrated in FIG. 11, for example. The lid part 221L may be coupled to the projection 221PA. The lid part 221L may have a three-dimensional shape details of which are similar to or the same as the details of the three-dimensional shape of the lid part 121L, for example. In a case where the cover 221 includes the projections 221PB, the projections 221PB may also be coupled to the lid part 221L, for example.

The lid part 221L may have a configuration details of which are similar to or the same as the details of the configuration of the lid part 121L, for example. Specifically, the lid part 221L may have a thickness details of which are similar to or the same as the details of the thickness of the lid part 121L, for example.

The lid part 221L may have an opening 221F as illustrated in FIGS. 11 and 12, for example. The opening 221F may allow the memory substrate 230 to be partially exposed in the direction (the Y-axis direction) in which the projection 221PA extends, for example. The opening 221F may be similar or the same as in its number to the number of the opening 121FA in detail, for example. The opening 221F may have an opening shape and a size details of each which are similar to or the same as the details of corresponding one of the opening shape and the size of the opening 121FA, for example. The opening 221F may correspond to the "first opening" in one specific but non-limiting embodiment of the technology.

The support 222 may have the depression 222DA as illustrated in FIG. 11. Unlike the depression 122DA, the depression 222DA may be provided by a partial protrusion of the containing unit 210, for example. In other words, the depression 222DA may extend in a direction (the Y-axis direction) similar to the direction in which the projection 221PA extends. Further, the depression 222DA may allow the projection 221PA to be inserted into the depression 222DA. When the memory substrate 230 is attached to the containing unit 210 by means of the attachment unit 220, the projection 221PA may be inserted into the depression 222DA. The depression 222DA may correspond to the "first depression" in one specific but non-limiting embodiment of the technology.

The depression 222DA may have an opening shape details of which are similar to or the same as the details of the opening shape of the opening 122DA, for example. Further, the depression 222DA may be located at a position details of which are similar to or the same as the details of the position at which the opening 122DA is located, for example. The depression 222DA may have the opening area that is not particularly limited. Therefore, the opening area of the depression 222DA may be the same as the area of insertion of the projection 221PA, or may be greater than the area of insertion of the projection 221PA. FIG. 11 illustrates an example case where the opening area of the depression 222DA is sufficiently greater than the area of the insertion of the projection 221PA.

The support 222 may have a through opening 222H, as illustrated in FIG. 11. The through opening 222H may extend in a direction (the Z-axis direction) that intersects the direction in which the projection 221PA extends. Further, the through opening 222H may be in communication with the depression 222DA. In other words, the through opening 222H may be coupled to the depression 222DA, which causes the through opening 222H and the depression 222DA to be joined with each other. The through opening 222H may have an opening shape details of which are similar to or the same as the details of the opening shape of the through opening 122H, for example. The through opening 222H may correspond to the "through opening" in one specific but non-limiting embodiment of the technology.

The through opening 222H may have an inner diameter that is not particularly limited. Accordingly, the inner diameter of the through opening 222H may be constant or varied in a direction in which the through opening 222H extends. In this example, the inner diameter of the through opening 222H may be constant in the direction in which the through opening 222H extends.

When the cover 221 includes the projection 221PB, the support 222 may have a depression 222DB as illustrated in FIG. 12, for example. The depression 222DB may be provided on one surface of the containing unit 210 inside the depression 222DA, for example. Specifically, the depression 222DB may extend in a direction (the Y-axis direction) similar to the direction in which the projection 221PB extends. Further, the depression 222DB may allow the projection 221PB to be inserted into the depression 222DB. The support 222 may have two depressions 222DB when the cover 221 includes the two projections 221PB, for example. The depression 222DB may have an opening shape details of which are similar to or the same as the details of the opening shape of the depression 122DB, for example. Further, the depression 222DB may be located at a position details of which are similar to or the same as the details of the position at which the opening 122DB is located, for example. The depression 222DB may correspond to the "second depression" in one specific but non-limiting embodiment of the technology.

In the example case where the cross-sectional shape of each of the projections 221PB is the hook-like shape as described above, the tip portion of each of the projections 221PB may be more difficult to be removed from the corresponding depression 222DB as illustrated in FIG. 12, upon the insertion of each of the projections 221PB into the corresponding depression 222DB. This makes it more difficult for each of the projections 221PB as a whole to be detached from the corresponding depression 222DB. This allows for easier alignment of the memory substrate 230 and for easier temporal fixation of the memory substrate 230.

When the cover 221 has the opening 221F, the support 222 may include a projection 222P, as illustrated in FIGS. 11 and 12, for example. The projection 222P may be provided in a region that overlaps the region in which the memory substrate 230 is to be disposed, for example. The projection 222P may therefore lift up the memory substrate 230 toward the opening 221F. The projection 222P may not be particularly limited in its number. Therefore, only one projection 222P may be provided. Alternatively, two or more projections 222P may be provided. FIGS. 11 and 12 each illustrate an example case where four projections 222P are provided. Each of the projections 222P may have a three-dimensional shape details of which are similar to or the same as the details of the three-dimensional shape of the projection 122P, for example. The projection 222P may correspond to the "fourth projection" in one specific but non-limiting embodiment of the technology.

The insertion pin 223 may be insertable into the through openings 222H and 221H in this order. When the memory substrate 230 is to be attached to the containing unit 210 by means of the attachment unit 220, insertion of the projection 221PA into the depression 222DA may cause the insertion pin 223 to be inserted into the through openings 222H and 221H in this order, in a state where the memory substrate 230 is sandwiched between the cover 221 and the support 222. Specifically, the insertion pin 223 may be inserted into the through opening 222H provided on the support 222 and thereafter inserted into the through opening 221H provided on the cover 221. The insertion pin 223 may include a material details of which are similar to or the same as the details of the materials included in the insertion pin 123, for example.

The insertion pin 223 may have a three-dimensional shape that is not particularly limited as long as the three-dimensional shape is a rod-like shape that extends in a direction (the Z-axis direction) in which the insertion pin 223 is to be inserted into the through openings 221H and 222H. In this example, the three-dimensional shape of the insertion pin 223 may be similar to or the same as the three-dimensional shape of the insertion pin 123, for example. Specifically, referring to FIGS. 14 and 15, the insertion pin 223 may include an increasing outer diameter part 223A, a constant outer diameter part 223B, and a decreasing outer diameter part 223C in order from side on which the insertion pin 223 is to be inserted into each of the through openings 221H and 222H, for example. The increasing outer diameter part 223A, the constant outer diameter part 223B, and the decreasing outer diameter part 223C may correspond to the increasing outer diameter part 123A, the constant outer diameter part 123B, and the decreasing outer diameter part 123C, respectively. The insertion pin 223 may have ends, i.e., a front end and a rear end, that are located at respective positions details of which are similar to or the same as the details of the positions of the respective ends, i.e., the front end and the rear end, of the insertion pin 123, for example.

Referring to FIGS. 14 and 15, the through opening 221H may have an inner diameter D5 that is greater than an inner diameter D6 of the through opening 222H, in this example. Accordingly, the inner diameter D5 of the through opening 221H may be greater than an outer diameter (a maximum outer diameter) D7 of the insertion pin 223, for example.

A relationship between the inner diameter D6 of the through opening 222H and the outer diameter D7 of the insertion pin 223 may be similar to or the same as the relationship between the inner diameter of the through opening 122H and the outer diameter (the maximum outer diameter) of the insertion pin 123, for example. Specifically, under a condition that the insertion pin 223 is modifiable by means of contraction in accordance with external force and the support 222 is rigid, the insertion pin 223 may be inserted into the through opening 222H while the insertion pin 223 is squeezed into the through opening 222H. This allows the support 222, i.e, the inner wall surface of the through opening 222H, and the insertion pin 223 to be attached to each other more firmly, therefore increasing frictional force between the support 222 and the insertion pin 223. Hence, it is more difficult for the insertion pin 223 to be removed from the through opening 222H. The insertion pin 223 may be more difficult to be removed from the through opening 222H owing to the increased frictional force as described above. This advantage may be similarly achieved in a case where the support 222 is modifiable by means of contraction in accordance with external force and the insertion pin 223 is rigid. Further, the relationship between the configuration (the outer diameter) of the insertion pin 123 and the configuration (the inner diameter) of the through opening 122H (the constant inner diameter part 122HB) illustrated in FIGS. 7 and 8 may be applied to a relationship between the configuration (the outer diameter) of the insertion pin 223 and the configuration (the inner diameter) of the through opening 222H.

In contrast, the inner diameter D5 of the through opening 221H may be greater than the inner diameter D6 of the through opening 222H (the outer diameter D7 of the insertion pin 223). Therefore, the insertion pin 223 may be inserted into the through opening 221H without being squeezed when the insertion pin 223 is inserted into the through opening 221H, unlike the foregoing case where the insertion pin 223 is inserted into the through opening 222H. In this case, when the inner diameter D5 of the through opening 221H is sufficiently greater than the inner diameter D6 of the through opening 222H (the outer diameter D7 of the insertion pin 223), a gap may be present between the support 222 (the inner wall surface of the through opening 221H) and the insertion pin 223. The cover 221 may be therefore movable without being fixed by the insertion pin 223 also in a state where the insertion pin 223 is inserted into the through opening 221H.

Accordingly, referring to FIG. 14, a gap (a margin distance MJ) may be present between an external wall surface of the cover 221 and an internal wall surface of the depression 222DA when the cover 221 is sufficiently pressed in accordance with the insertion operation of the insertion pin 223 upon the insertion of the insertion pin 223 into the through openings 221H and 222H, for example. This allows for the cover 221 to be movable (slidable) in a direction (the Z-axis direction) in which the insertion pin 223 is inserted even in a state where the insertion pin 223 is inserted into each of the through openings 221H and 222H as illustrated in FIG. 15, for example. A maximum distance at which the cover 221 is to be moved may correspond to the margin distance MJ. The cover 221 may be therefore movable within a range of the margin distance MJ. It is to be noted that FIG. 15 illustrates a state in which the cover 221 is moved by a distance corresponding to the margin distance MJ.

<2-2. Procedure of Attachment of Memory Substrate>

A description is given below of a procedure of the attachment of the memory substrate 230 with reference to FIGS. 9 to 15.

When the memory substrate 230 is to be attached to the containing unit 210 by means of the attachment unit 220, first, the memory substrate 230 may be placed on the support 222 as illustrated in FIG. 11.

When the memory substrate 230 is to be attached to the containing unit 210 by means of the attachment unit 220, the memory substrate 230 may be disposed on inner side of the depression 222DA. The memory substrate 230 may be thereby lifted up by the four projections 222P.

Thereafter, the cover 221 may be attached to the support 222 as illustrated in FIGS. 11 to 13. The memory substrate 230 may be thereby covered by the cover 221. Accordingly, the memory substrate 230 may be contained inside the cover 221.

Upon attaching the cover 221 to the support 222, the projection 221PA may be inserted into the depression 222DA, and the two projections 221PB may be inserted into the respective two depressions 222DB. This may cause the cover 221 to be aligned with respect to the support 222, and cause the memory substrate 230 to be sandwiched between the cover 221 and the support 222. The memory substrate 230 may be thereby temporarily fixed to the containing unit 210.

Lastly, the insertion pin 223 may be inserted into the through openings 222H and 221H in this order as illustrated in FIG. 14. Upon the insertion of the insertion pin 223 into the through openings 222H and 221H in this order, the insertion pin 223 may be inserted into the through opening 222H, and thereafter, the insertion pin 223 may be also inserted into the through opening 221H. Further, the cover 221 may be moved in a direction in which the insertion pin 223 is inserted on an as-needed basis, in the state where the insertion pin 223 is inserted into the through opening 221H. The position of the cover 221 may be thereby adjusted.

The insertion pin 223 may be thereby inserted into the through openings 222H and 221H in this order in the state where the memory substrate 230 is sandwiched between the cover 221 and the support 222 as illustrated in FIGS. 9 and 10. This allows for full fixation of the memory substrate 230 to the containing unit 210. As a result, the attachment of the memory substrate 230 by means of the attachment unit 220 may be completed.

<2-3. Example Workings and Example Effects>

In the foregoing toner cartridge 200, the insertion pin 223 may be inserted into the through openings 222H and 221H in this order in a state where the projection 221PA is inserted into the depression 222DA and the memory substrate 230 is thereby sandwiched between the cover 221 and the support 222 in the attachment unit 220. In this case, the cover 221 may be fixed to the support 222 in a state where the memory substrate 230 is contained inside the cover 221 as described above. The memory substrate 230 may be therefore fixed to the support 222. This makes it more difficult for the memory substrate 230 to fall off after the completion of the attachment of the memory substrate 230. Hence, it is possible to prevent the memory substrate 230 from falling off.

In particular, when the inner diameter D5 of the through opening 221H is greater than each of the inner diameter D6 of the through opening 222H and the outer diameter D7 of the insertion pin 223, the cover 221 may be movable in the direction in which the insertion pin 223 is inserted even in the state where the insertion pin 223 is inserted into the through opening 221H, as described above. Hence, it is possible to adjust the position of the memory substrate 230 on an as-needed basis.

In the case where the cover 221 is movable in the direction in which the insertion pin 223 is inserted, for example, it is possible to prevent the memory substrate 230 from being broken when the toner cartridge 200 is mounted on an image forming apparatus, by utilizing the adjustability of the position of the memory substrate 230 in particular.

Specifically, for example, in the image forming apparatus mounted with the toner cartridge 200, the toner cartridge 200 may be biased toward a photosensitive drum 422 which will be described later in greater detail with reference to FIGS. 41 to 43. In this case, the position of the toner cartridge 200 may be shifted toward the photosensitive drum 422 when the photosensitive drum 422 is worn. Accordingly, the position of the memory substrate 230 mounted on the toner cartridge 200 may be shifted in a direction similar to a direction in which the position of the toner cartridge 200 is shifted. When this shift in position brings the memory substrate 230 into unintentional contact with a member inside the image forming apparatus, the memory substrate 230 may be shaved. Non-limiting examples of the member that may be brought into contact with the memory substrate 230 may include a frame (a so-called drum frame) that holds the photosensitive drum 422.

However, in a case where the position of the memory substrate 230 is adjustable, the position of the cover 221 may be allowed to be so adjusted that the memory substrate 230 is more difficult to be brought into contact with the member inside the image forming apparatus, even when the position of the toner cartridge 200 is shifted due to the worn photosensitive drum 422. This makes it more difficult for the memory substrate 230 to be brought into contact with the member inside the image forming apparatus, making it more difficult for the memory substrate 230 to be shaved. Hence, it is possible to prevent the memory substrate 230 from being broken.

Example workings and example effects related to the toner cartridge 200 other than those described above may be similar to or the same as the example workings and the example effects related to the toner cartridge 100 described above.

3. Toner Container (Third Example Embodiment)

A description is given of a toner container according to a third example embodiment of the technology.

<3-1. Configuration>

A description is given first of a configuration of a toner cartridge 300 that is an example of the toner container according to the third example embodiment of the technology. The toner cartridge 100 and the components of the toner cartridge 100 described above will be referred to in the description below where appropriate.

The toner cartridge 300 may contain a toner, as with the toner cartridge 100. The use of the toner cartridge 300 may be similar to or the same as that of the toner cartridge 100, for example. Details of the toner may be as described above, for example.

Figure 16:
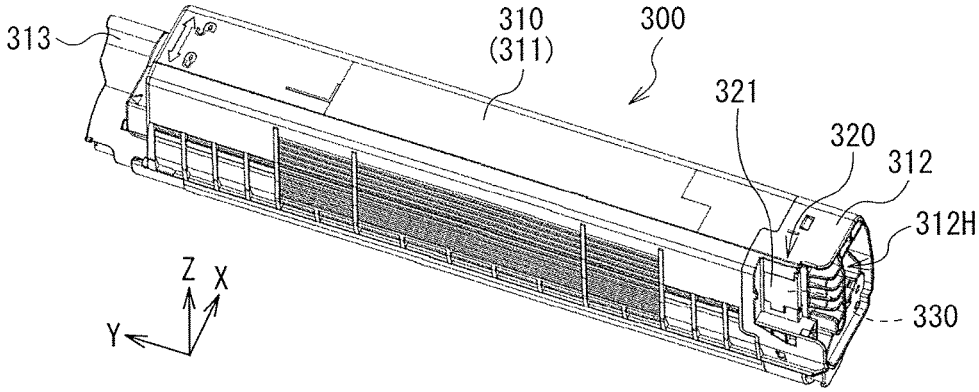
FIG. 16 is a perspective view of a configuration example of a toner container (a toner cartridge) according to a third example embodiment of the technology.
Figure 17:
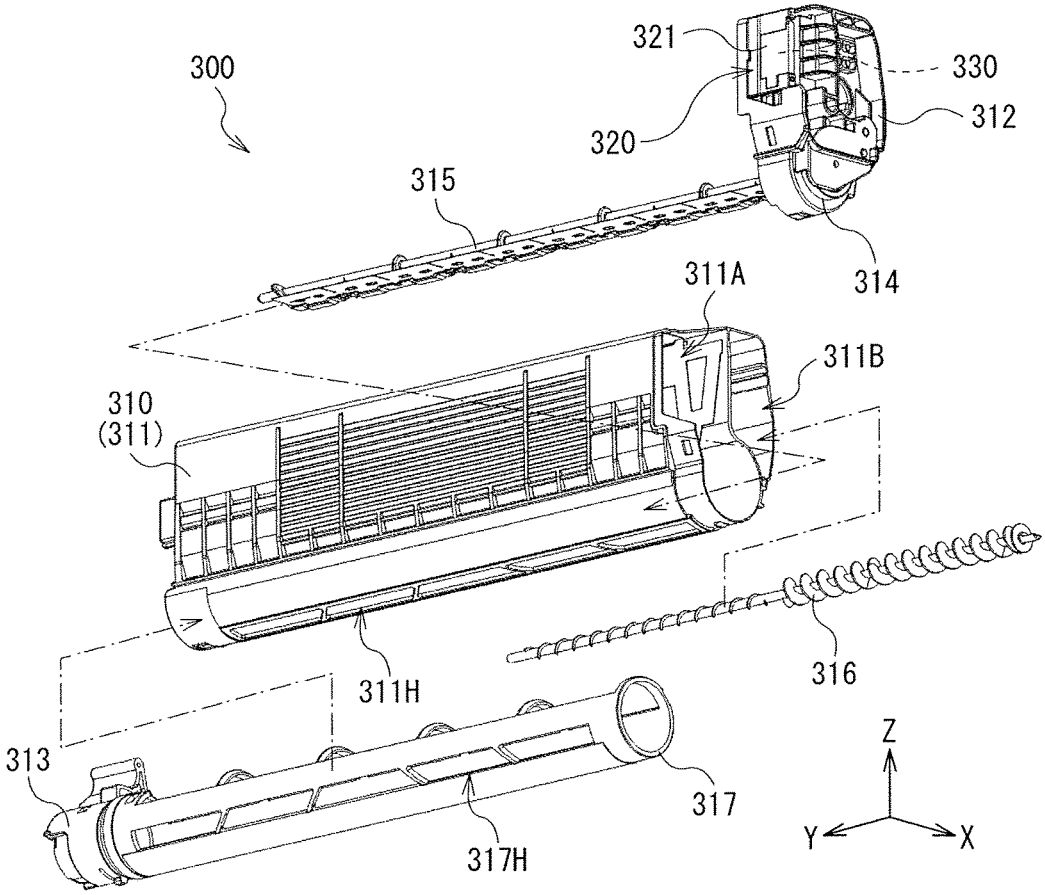
FIG. 17 is an exploded perspective view of the configuration example of the toner cartridge illustrated in FIG. 16.

Each of FIGS. 16 and 17 is a perspective view of the configuration of the toner cartridge 300. FIG. 17 illustrates an exploded state of the toner cartridge 300 illustrated in FIG. 16.

The toner cartridge 300 may include a containing unit 310, an attachment unit 320 provided on the containing unit 310, and a radio frequency identification (RFID) tag 330 attached to the containing unit 310 by means of the attachment unit 320, for example. The RFID tag 330 may correspond to the "storage device" in one specific but non-limiting embodiment of the technology.

Referring to FIGS. 16 and 17, the containing unit 310 may extend in one direction (the Y-axis direction), for example. The containing unit 310 may include an outer frame 311, a side frame 312, and an open-close operation lever 313, for example. The side frame 312 may be attached to one end of the outer frame 311 in a longitudinal direction (the Y-axis direction), for example. The open-close operation lever 313 may be attached to the other end of the outer frame 311 in the longitudinal direction. The side frame 312 may be provided with a waste toner recovery opening 312H that recovers a used toner, for example.

The outer frame 311 may be a tubular member that extends in the longitudinal direction, for example. Further, the outer frame 311 may have two rooms that are separated from each other, i.e., a toner containing room 311A and a waste toner containing room 311B, for example. The toner containing room 311A may contain an unused toner. The waste toner containing room 311B may contain a used toner. The outer frame 311 may be provided with a toner discharge opening 311H from which the toner is to be discharged, for example.

To the side frame 312, a drive transmission gear 314 may be attached, for example. The drive transmission gear 314 may be coupled to a stir-supply member 315, for example. The stir-supply member 315 may extend in the longitudinal direction, for example. The drive transmission gear 314 may be rotatable around a rotation shaft that extends in the longitudinal direction. Accordingly, the stir-supply member 315 may be rotatable in accordance with the rotation of the drive transmission gear 314. The stir-supply member 315 may stir the toner contained in the toner containing room 311A, and supply the stirred toner to the outside from the toner discharge opening 311H. The side frame 312 may be attached to the outer frame 311 in a state where the stir-supply member 315 is inserted into the toner containing room 311A. It is to be noted that a waste toner recovery spiral 316 may be inserted into the waste toner containing room 311B, for example. The waste toner recovery spiral 316 may extend in the longitudinal direction and have a spiral-shape projection, for example. Further, the waste toner recovery spiral 316 may be rotatable in accordance with the rotation of the drive transmission gear 314, as with the stir-supply member 315 described above. The waste toner recovery spiral 316 may recover the used toner, and cause the recovered used toner to be contained inside the waste toner containing room 311B.

The open-close operation lever 313 may be coupled to a cylindrical member 317, for example. The cylindrical member 317 may extend in the longitudinal direction, for example. Further, the cylindrical member 317 may be provided with a plurality of openings 317H that are arranged in the longitudinal direction, for example. The open-close operation lever 313 may be attached to the outer frame 311 in a state where the cylindrical member 317 is inserted into the toner containing room 311A, for example. Further, the open-close operation lever 313 may be rotatable around a rotation shaft that extends in the longitudinal direction. The cylindrical member 317 may be therefore rotatable in accordance with the rotation of the open-close operation lever 313. The cylindrical member 317 may be so rotated in accordance with the rotation of the open-close operation lever 313 that a position of the opening 317H and a position of the toner discharge opening 311H are coincident with each other. The toner contained in the toner containing room 311A may be thereby supplied to the outside from the toner discharge opening 311H. Further, the cylindrical member 317 may be so rotated that the position of the opening 317H and the position of the toner discharge opening 311H are not coincident with each other. This may stop the supply of the toner described above.

Details of the containing unit 310 other than those described above may be similar to or the same as the details of the containing unit 110, for example.

The attachment unit 320 may be an attachment mechanism that has a function similar to or the same as the function of the attachment unit 120. The attachment unit 320 is mainly used to attach the RFID tag 330 to the containing unit 310. The attachment unit 320 may be provided at a position, in the containing unit 310, which is not particularly limited. For example, the attachment unit 320 may be provided on one side surface of the containing unit 310 in the longitudinal direction (the Y-axis direction). More specifically, the attachment unit 320 may be provided on one side surface of the side frame 312 in the longitudinal direction, for example. A configuration of the attachment unit 320 will be described later in greater detail with reference to FIGS. 18 to 32.

The RFID tag 330 may be a contactless storage device using a radio wave. Specifically, the RFID tag 330 may allow for contactless recording of information, and also allow for contactless reading of information stored in the RFID tag 330. Details of the information stored in the RFID tag 330 may be similar to or the same as the details of the information stored in the memory substrate 130, for example.

Figure 18:
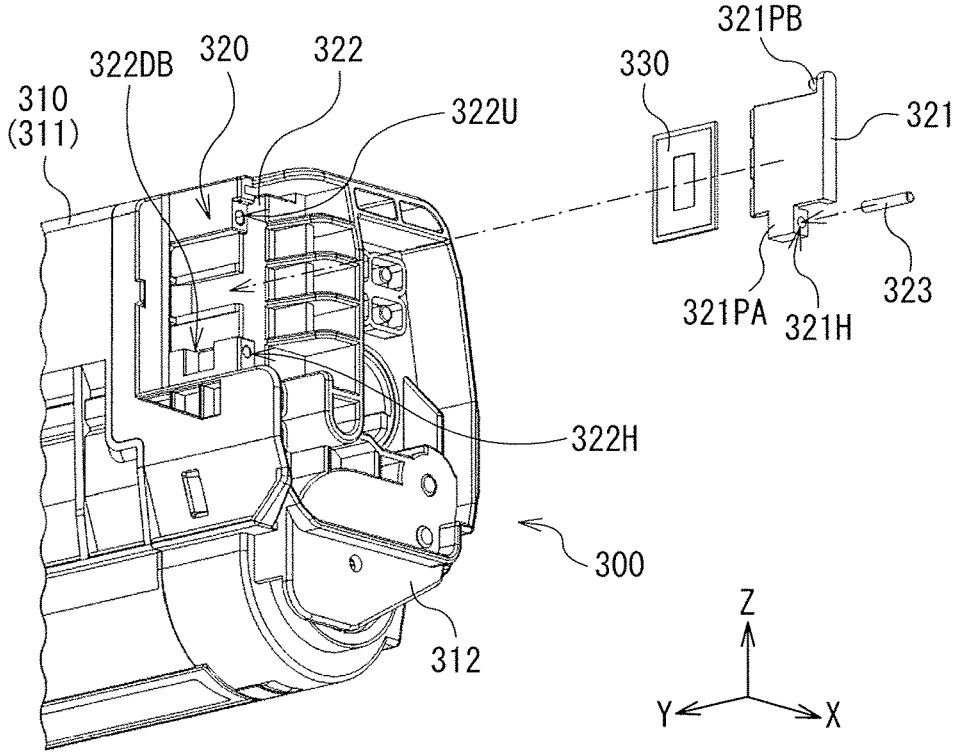
FIG. 18 is a perspective view of a configuration example of a main part of the toner cartridge illustrated in FIG. 16.

FIG. 18 is an enlarged perspective view of a configuration of a main part, i.e., the side frame 312 and the periphery thereof, of the toner cartridge 300 illustrated in FIG. 16. FIG. 18 illustrates a state where the RFID tag 330 is separated from the containing unit 310 for illustration purpose of a positional relationship between the members including the RFID tag 330.

Each of FIGS. 19 to 32 is a perspective view or a cross-sectional view of the configuration of part, i.e., the attachment unit 320 and the periphery thereof, of the toner cartridge 300 illustrated in FIG. 18.

Figure 23:
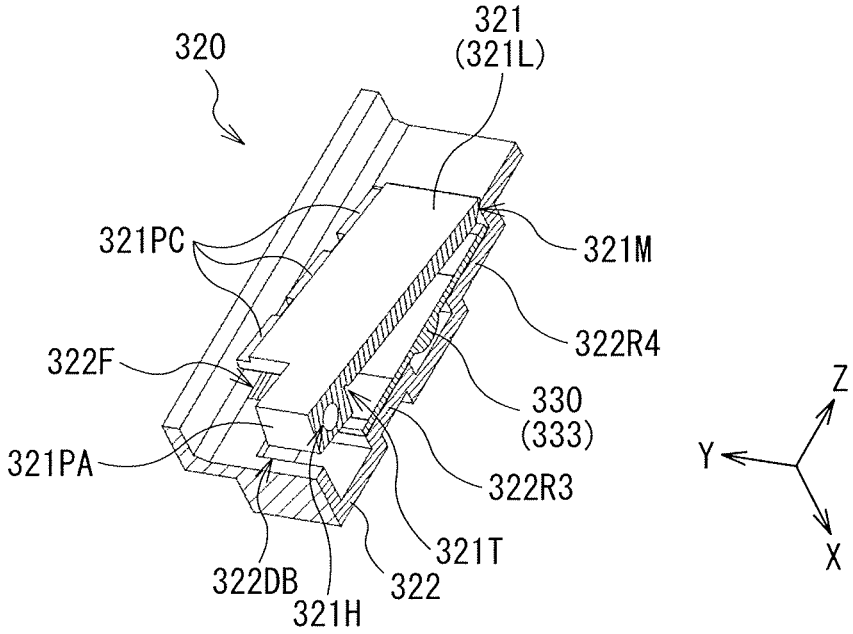
FIG. 23 is a perspective view of a configuration example of a partial cross-section of the toner cartridge illustrated in FIG. 22.
Figure 27:
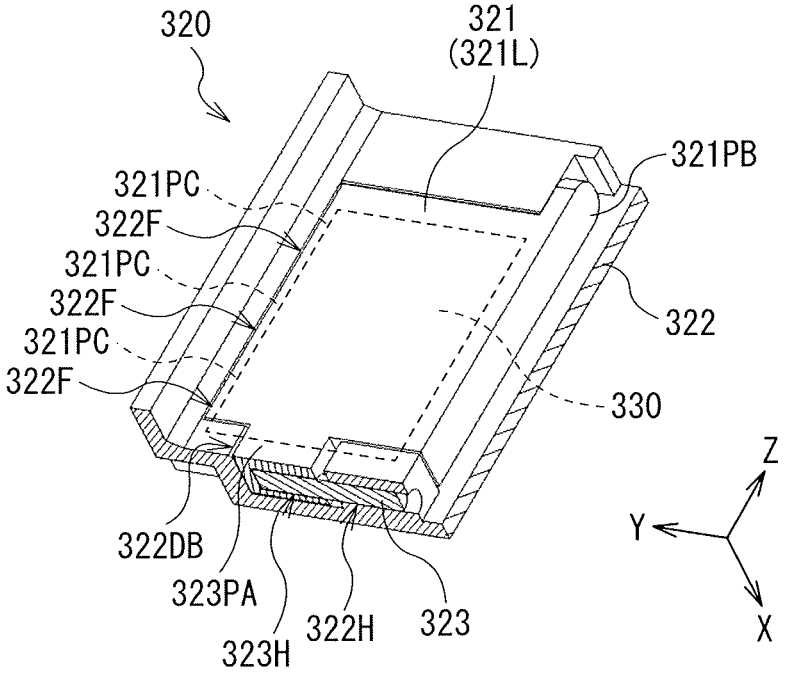
FIG. 27 is a perspective view of a configuration example of a partial cross-section of the toner cartridge illustrated in FIG. 26.
Figure 29:
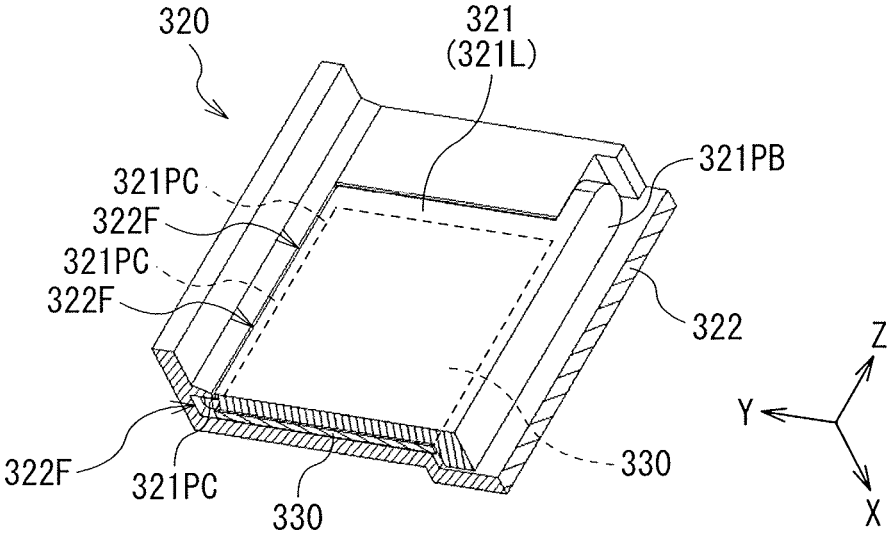
FIG. 29 is a perspective view of a configuration example of a partial cross-section of the toner cartridge illustrated in FIG. 26.
Figure 31:
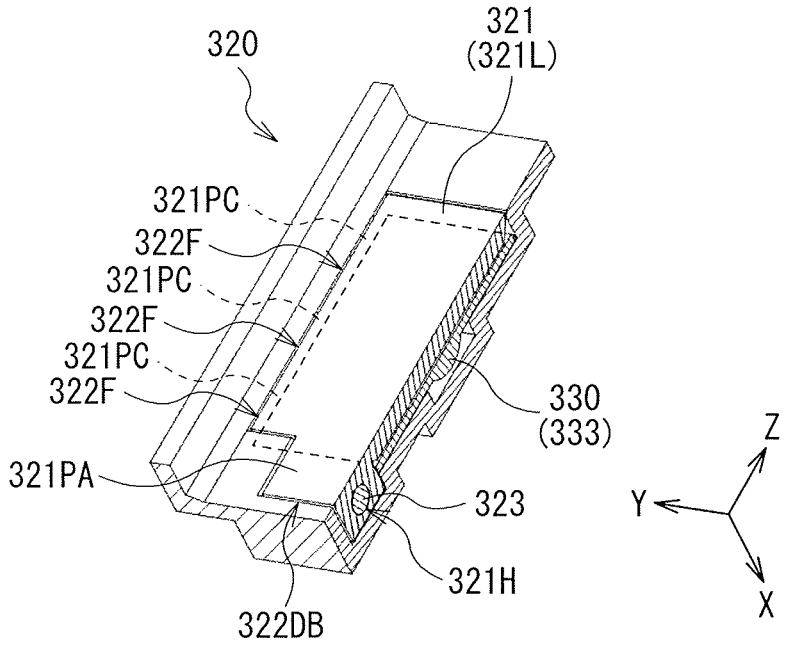
FIG. 31 is a perspective view of a configuration example of a partial cross-section of the toner cartridge illustrated in FIG. 26.

Specifically, each of FIGS. 19 to 23, 25 to 27, 29, and 31 is a perspective view of the configuration of the part of the toner cartridge 300 illustrated in FIG. 18. Further, FIG. 23 is a perspective view of the configuration of part of the toner cartridge 300 including a partial cross-section corresponding to that illustrated in FIG. 22. FIG. 27 is a perspective view of the configuration of part of the toner cartridge 300 including a partial cross-section corresponding to that illustrated in FIG. 26. FIG. 29 is a perspective view of the configuration of part of the toner cartridge 300 including a partial cross-section corresponding to that illustrated in FIG. 26. FIG. 31 is a perspective view of the configuration of part of the toner cartridge 300 including a partial cross-section corresponding to that illustrated in FIG. 26. Each of FIGS. 23 and 31 illustrates a cross-section taken along the X-Z plane. Each of FIGS. 27 and 29 illustrates a cross-section taken along the X-Y plane.

Figure 24:
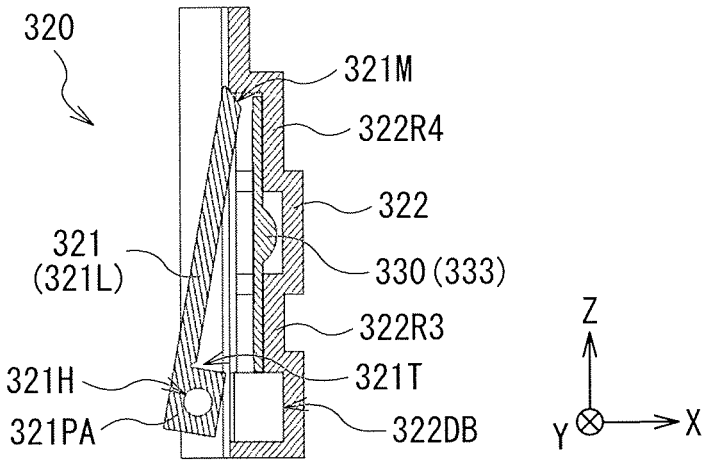
FIG. 24 is a cross-sectional view of the configuration example of the toner cartridge illustrated in FIG. 23.
Figure 28:
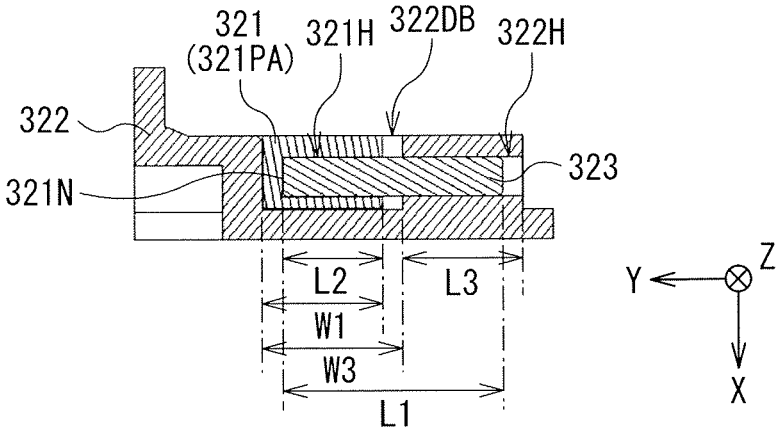
FIG. 28 is a cross-sectional view of the configuration example of the toner cartridge illustrated in FIG. 27.
Figure 30:
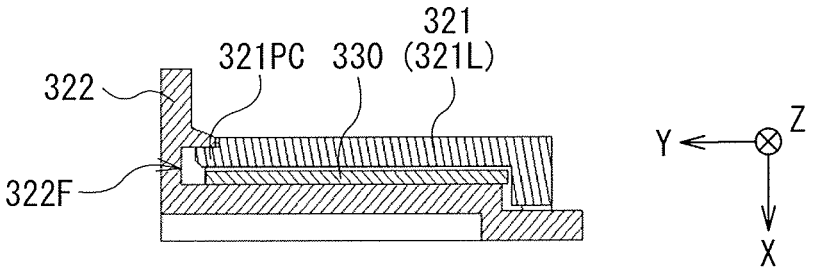
FIG. 30 is a cross-sectional view of the configuration example of the toner cartridge illustrated in FIG. 29.
Figure 32:
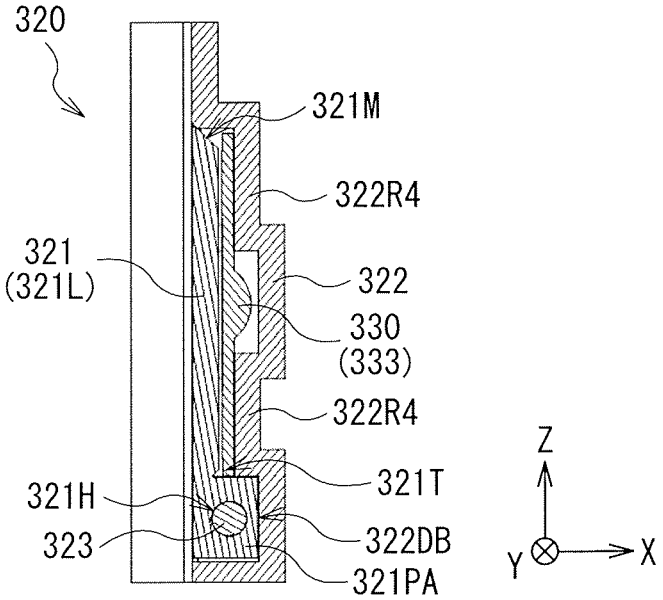
FIG. 32 is a cross-sectional view of the configuration example of the toner cartridge illustrated in FIG. 31.

FIGS. 24, 28, 30, 32, and 35 are cross-sectional views of the configuration of part of the toner cartridge 300 corresponding to that illustrated in FIGS. 23, 27, 29, 31, and 34, respectively. Each of FIGS. 24 and 32 illustrates a cross-section taken along the X-Z plane. Each of FIGS. 28 and 30 illustrates a cross-section taken along the X-Y plane.

Figure 19:
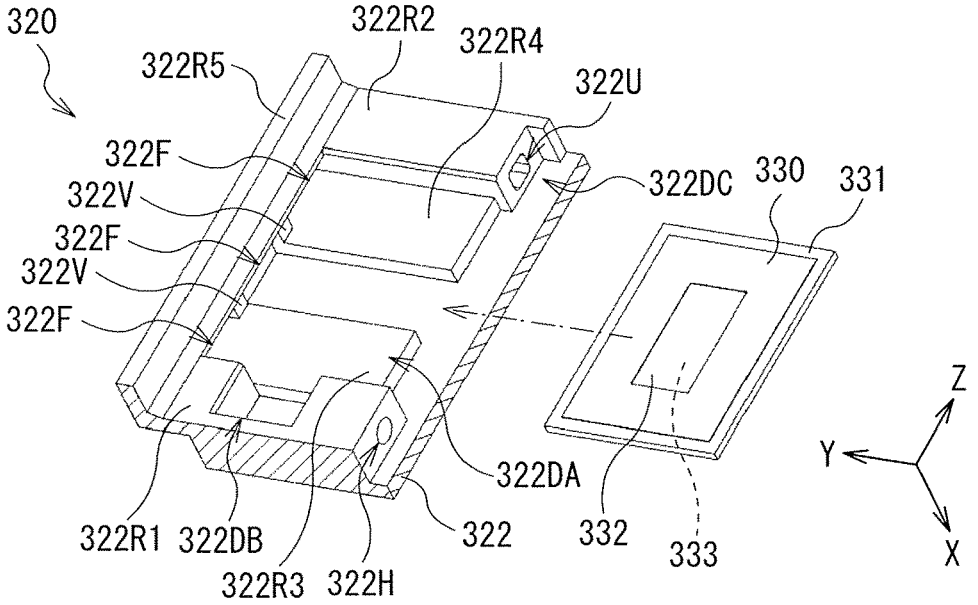
FIG. 19 is an enlarged perspective view of a configuration example of part of the toner cartridge illustrated in FIG. 18.

Referring to FIG. 19, the RFID tag 330 may include a supporting substrate 331, an antenna 332, and a memory 333, for example. The antenna 332 may be provided on one surface of the supporting substrate 331. For example, the antenna 332 may be provided on a front surface of the supporting substrate 331. The antenna 332 may be an antenna line that allows for contactless writing of information on the memory 333 and contactless reading of information from the memory 333. The memory 333 may store information on the toner cartridge 300. Further, the memory 333 may be provided on another surface of the supporting substrate 331. For example, the memory 333 may be provided on a back surface of the supporting substrate 331. The memory 333 may have a projection-like shape, as illustrated in FIGS. 23 and 24, for example. Details of the RFID tag 330 other than those described above may be similar to or the same as the details of the memory substrate 130, for example.

Figure 20:
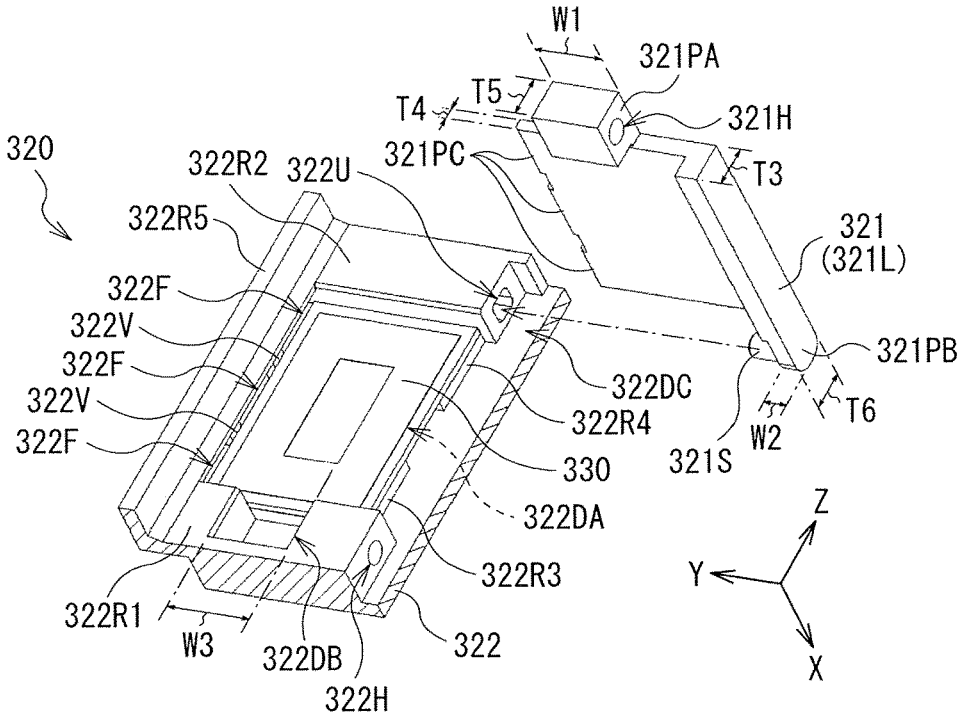
FIG. 20 is an enlarged perspective view of another configuration example of part of the toner cartridge illustrated in FIG. 18.

Referring to FIGS. 18 to 20, the attachment unit 320 may include a cover 321, a support 322 that is part of the containing unit 310 (the container), and an insertion pin 323, for example. The cover 321, the support 322, and the insertion pin 323 may respectively correspond to the "cover member", the "supporting member", and the "insertion member" in one specific but non-limiting embodiment of the technology.

The cover 321 may mainly cover the RFID tag 330 that is placed on the support 322, i.e., one surface of the containing unit 310. The cover 321 may have a three-dimensional shape that is not particularly limited. For example, the three-dimensional shape of the cover 321 may be a substantially-plate-like shape that extends in a direction along a surface (the Y-Z plane) of the support 322. FIG. 19 omits illustration of the cover 321.

Figure 21:
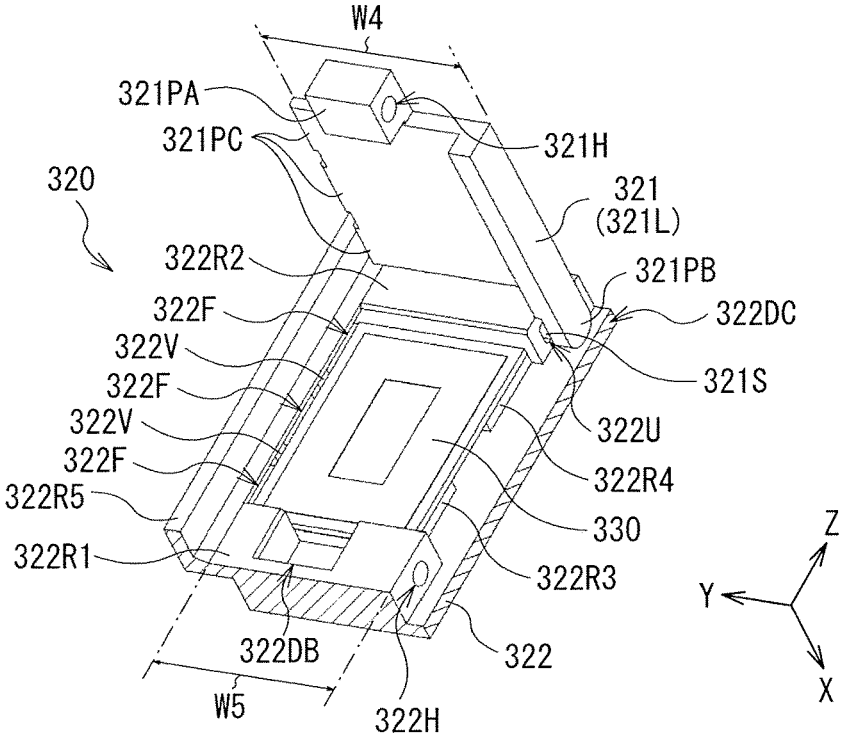
FIG. 21 is an enlarged perspective view of still another configuration example of part of the toner cartridge illustrated in FIG. 18.
Figure 22:
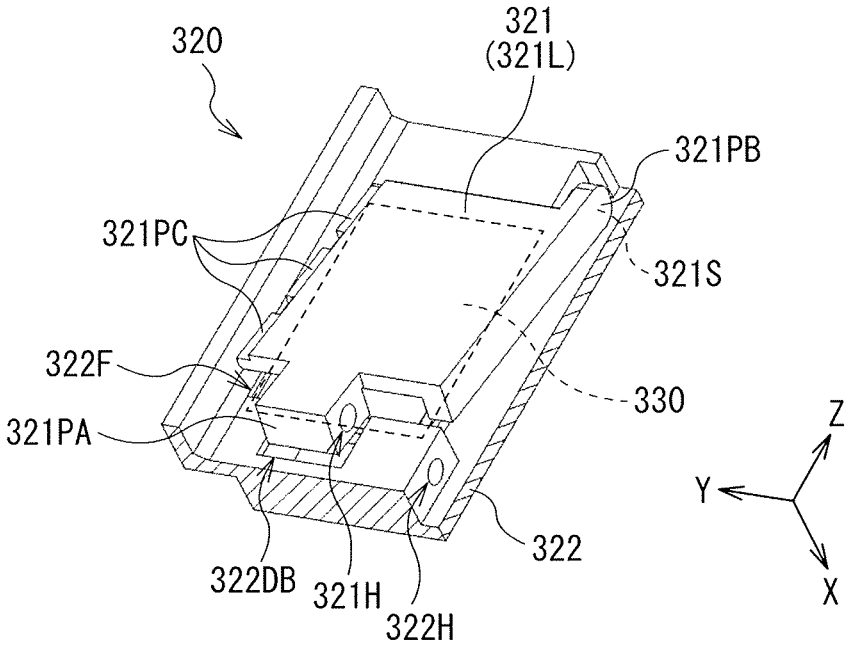
FIG. 22 is an enlarged perspective view of still another configuration example of part of the toner cartridge illustrated in FIG. 18.
Figure 25:
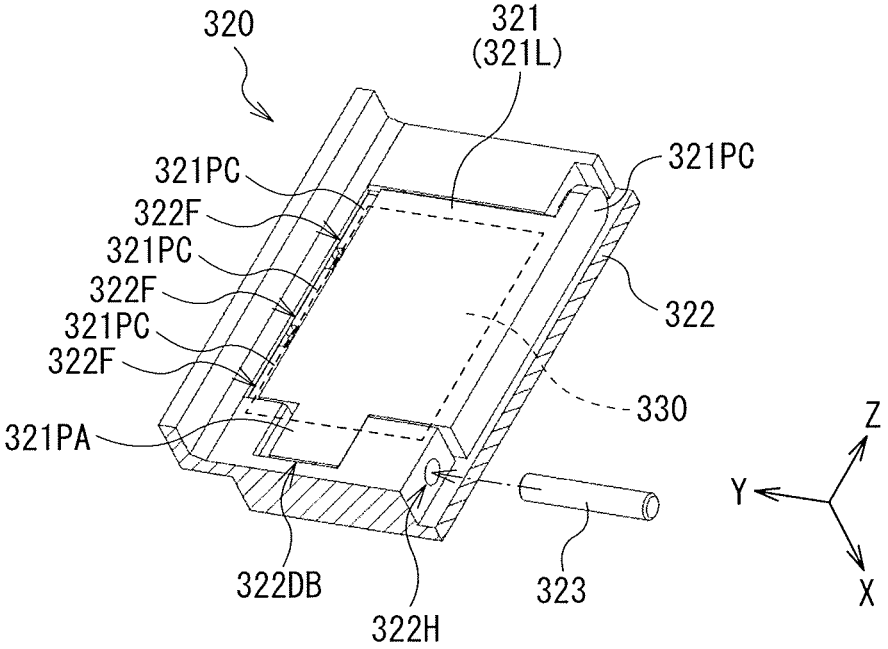
FIG. 25 is an enlarged perspective view of still another configuration example of part of the toner cartridge illustrated in FIG. 18.
Figure 26:
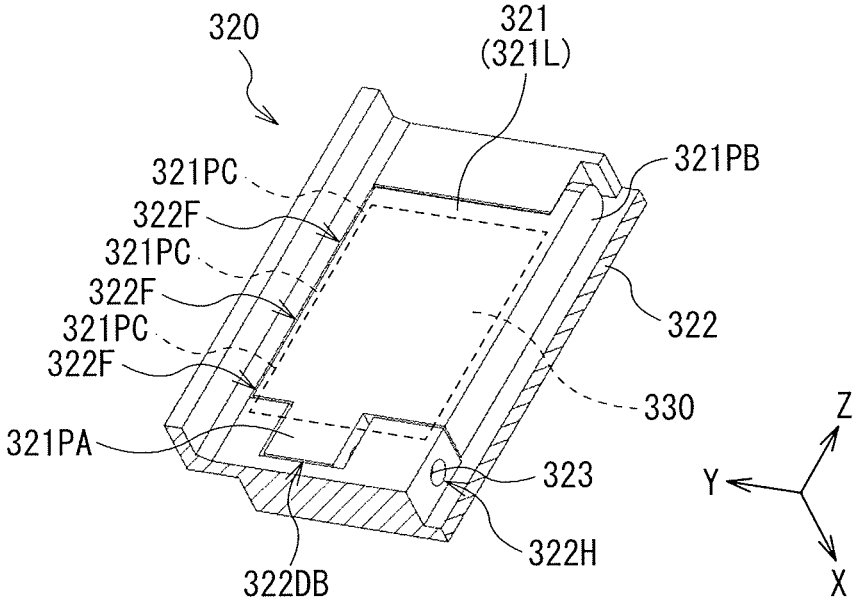
FIG. 26 is an enlarged perspective view of still another configuration example of part of the toner cartridge illustrated in FIG. 18.

Each of FIGS. 20 and 21 illustrates a state where the cover 321 is separated away from the support 322 and the cover 321 has not pivoted yet. The pivoting of the cover 321 may be described later in greater detail. Each of FIGS. 20 and 21 therefore illustrates the cover 321 as a plate-like member that extends in a direction along the X-Y plane. The cover 321 may extend in a direction along the front surface (the Y-Z plane) of the support 322 in a state after the pivoting, as illustrated in FIG. 25.

Referring to FIG. 20, the cover 321 may include a projection 321PA, for example. The projection 321PA may extend in a predetermined direction. Specifically, the projection 321PA may extend in a direction along a surface of the support 322, i.e., the Z-axis direction. The projection 321PA may have a three-dimensional shape that is not particularly limited. For example, the three-dimensional shape of the projection 321PA may be a cuboid shape. The projection 321PA may correspond to the "first projection" in one specific but non-limiting embodiment of the technology. The Z-axis direction may correspond to the "first direction" in one specific but non-limiting embodiment of the technology.

One reason that the cover 321 may include the projection 321PA is that insertion of the projection 321PA into a depression 322DB in the support 322 allows for easier alignment of the cover 321 with respect to the support 322 and easier temporal fixation of the cover 321 to the support 322. The depression 322DB in the support 322 will be described later in greater detail.

Figure 35:
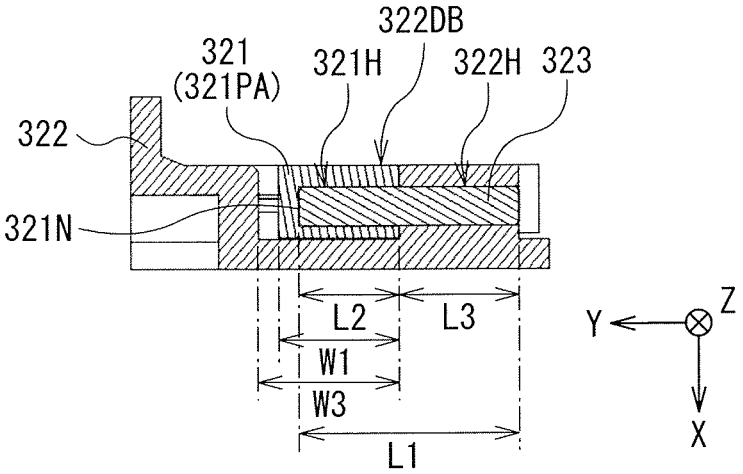
FIG. 35 is a cross-sectional view of the configuration example of the toner cartridge illustrated in FIG. 34.

The projection 321PA may be provided with an insertion opening 321H. The insertion opening 321H described in this example may be a non-through opening, for example. Specifically, the insertion opening 321H may be an opening (a depression) that has one open end and the other end closed with a bottom surface 321N, as illustrated in FIGS. 28 and 35. One reason for this is that an insertion operation of the insertion pin 323 into the insertion opening 321H may be utilized to press the projection 321PA with the inserted insertion pin 323, and the cover 321 may be thereby movable (slidable) in a direction in which the insertion pin 323 is inserted. The insertion opening 321H may extend in a direction (the Y-axis direction) that intersects the direction in which the projection 321PA extends. The insertion opening 321H may correspond to the "insertion opening" in one specific but non-limiting embodiment of the technology. The Y-axis direction may correspond to the "second direction" that intersects the "first direction" in one specific but non-limiting embodiment of the technology.

One reason that the projection 321PA may have the insertion opening 321H is that the insertion of the insertion pin 323 into the insertion opening 321H allows for full fixation of the cover 321 to the support 322, as will be described later in greater detail.

The insertion opening 321H may have an opening shape that is not particularly limited. For example, the opening shape of the insertion opening 321H may be a circular shape. The opening shape of the insertion opening 321H may refer to that viewed from the Y-axis direction in this example.

The insertion opening 321H may have an inner diameter that is not particularly limited. The inner diameter of the insertion opening 321H may be therefore constant or varied in a direction in which the insertion opening 321H extends. In this example, the inner diameter of the insertion opening 321H may be constant in the direction in which the insertion opening 321H extends.

The cover 321 may include a projection 321PB together with the foregoing projection 321PA, for example. The projection 321PB may extend in a direction opposite to the direction in which the projection 321PA extends, for example. The projection 321PB may correspond to an "extension" in one specific but non-limiting embodiment of the technology.

When the cover 321 includes the projections 321PA and 321PB, it may be more difficult for the cover 321 to be rotated. This allows the cover 321 to be aligned more easily and to be temporarily fixed to the support 322 more firmly.

The cover 321 may further include a lid part 321L that covers the RFID tag 330, for example. The lid part 321L may be coupled to the projection 321PA. The lid part 321L may have a three-dimensional shape of a substantially-plate-like shape that covers the RFID tag 330, for example. When the cover 321 includes the projection 321PB, the projection 321PB may also be coupled to the lid part 321L, for example.

The projection 321PA may be coupled to one end of the lid part 321L, for example, whereas the projection 321PB may be coupled to the other end of the lid part 321L, for example. The lid part 321L may be so disposed as to face the RFID tag 330 in a state where the RFID tag 330 is attached to the attachment unit 320, for example. The RFID tag 330 may be therefore disposed between the projections 321PA and 321PB, for example.

The projection 321PA may be located at a position, in a width direction (the Y-axis direction) of the lid part 321L, which is not particularly limited. For example, the position of the projection 321PA may be the middle in the width direction of the lid part 321L, for example. The projection 321PB may be located at a position, in the width direction of the lid part 321L, which is not particularly limited. For example, the position of the projection 321PB may be at one end of the lid part 321L in the width direction of the lid part 321L, for example.

The lid part 321L may have a configuration that is not particularly limited. Specifically, the lid part 321L may have a thickness that is not particularly limited. For example, the lid part 321L may have one end portion, in the width direction of the lid part 321L, which has a thickness T3. The thickness T3 may be greater than a thickness T4 of a portion other than the foregoing one end portion having the thickness T3. The projection 321PA may be coupled to the portion, of the lid part 321L, having the thickness T4, for example. The projection 321PB may be coupled to the portion, of the lid part 321L, having the thickness T3, for example. It is to be noted that the projection 321PA may have a thickness T5 that is greater than the thickness T4, for example. The projection 321PB may have a thickness T6 that is greater than the thickness T4, for example. Further, the thickness T6 of the projection 321PB may be equal to the thickness T3, for example.

Specifically, the lid part 321L may have a three-dimensional shape that allows the lid part 321L to cover an upper part and one side part of the RFID tag 330, for example. More specifically, the three-dimensional shape of the lid part 321L may be a substantially-plate-like shape formed by one top surface and one side surface, for example.

One end of the lid part 321L, specifically, one end, of the lid part 321L, provided with the projection 321PB may be provided with a sloped surface 321M, as illustrated in FIGS. 23 and 24, for example. The sloped surface 321M may be used to remove the RFID tag 330 from the containing unit 310 on an as-needed basis after the completion of the attachment of the RFID tag 330 to the containing unit 310, for example. A procedure of the attachment of the RFID tag 330 with the sloped surface 321M will be described later in greater detail with reference to FIGS. 33 to 40.

The projection 321PB may be provided with a pivoting shaft 321S that extends in a direction intersecting the direction in which the projection 321PB extends, i.e., the width direction (the Y-axis direction), for example. The pivoting shaft 321S may be insertable into a pivoting shaft bearing 322U in the support 322 which will be described later in greater detail, for example. The pivoting shaft 321S may have a three-dimensional shape that is not particularly limited. For example, the three-dimensional shape of the pivoting shaft 321S may be a cylindrical shape. In a state where the pivoting shaft 321S is inserted into the pivoting shaft bearing 322U, the cover 321 may be pivotable around the pivoting shaft 321S so that the lid part 321L covers the RFID tag 330 and the projection 321PA is inserted into the depression 322DB.

The lid part 321L may be provided with a projection 321PC at one end of the lid part 321L in the width direction. The projection 321PC may extend in the width direction, for example. The projection 321PC may not be particularly limited in its number. Therefore, only one projection 321PC may be provided. Alternatively, two or more projections 321PC may be provided. In this example, three projections 321PC may be provided. The projections 321P may be used to fix the cover 321 to the attachment unit 320 more firmly by utilizing a moving (sliding) operation of the cover 321 which will be described later in greater detail, for example. A principle of fixing the cover 321 with the projections 321PC will be described later. The projection 321PC may correspond to a "fifth projection" in one specific but non-limiting embodiment of the technology.

The projection 321PA may have a width W1, i.e., a dimension in the Y-axis direction, that is not particularly limited. It may be preferable, however, that the width W1 of the projection 321PA be sufficiently great. One reason for this is that the sufficiently-great width W1 allows the area in which the insertion pin 323 is brought into contact with an inner wall surface of the insertion opening 321H to be sufficiently great upon the insertion of the insertion pin 323 into the insertion opening 321H, allowing for firm fixation of the cover 321 to the support 322, as will be described later in greater detail.

The cover 321 may have a notch 321T at a position at which the lid part 321L and the projection 321PA are coupled to each other, as illustrated in FIGS. 23 and 24 and will be described later in greater detail, for example. This allows for separation of the projection 321PA from the lid part 321L on an as-needed basis. The notch 321T may be provided on a front surface of the cover 321, on a back surface of the cover 321, or on both, for example. FIGS. 23 and 24 each illustrate an example case where the notch 321T is provided on the back surface of the cover 321.

The projection 321PB may have a width W2 that is not particularly limited. It may be preferable, however, that the width W2 of the projection 321PB be sufficiently small. One reason for this is that the sufficiently-small width W2 leads to an appropriate decrease in physical strength of the projection 321PB, which allows for easier separation of the projection 321PB from the lid part 321L when the cover 321 is to be detached from the support 322 on an as-needed basis after the cover 321 is fixed to the support 322, as will be described later in greater detail with reference to FIGS. 36 and 37.

Referring to FIGS. 19 and 20, the support 322 may have a containing part 322DA, a depression 322DB, and an open part 322DC. Specifically, the support 322 may include five ribs 322R1 to 322R5. The five ribs 322R1 to 322R5 may form the containing part 322DA, the depression 322DB, and the open part 322DC. The containing part 322DA and the depression 322DB may be coupled to each other. The containing part 322DA and the open part 322DC may be coupled to each other. The depression 322DB may correspond to the "first depression" in one specific but non-limiting embodiment of the technology.

The ribs 322R1 and 322R2 may be so disposed as to be separated away from each other and face each other in a direction (the Z-axis direction) intersecting the width direction. The ribs 322R3 and 322R4 may be so disposed between the ribs 322R1 and 322R2 as to be separated away from each other and face each other in the direction (the Z-axis direction) intersecting the width direction. The rib 322R5 may be disposed adjacent to each of the ribs 322R1 to 322R4 in the width direction. The ribs 322R1 and 322R2 may each have a thickness (a dimension in the X-axis direction) that is smaller than a thickness of the rib 322R5, for example. The ribs 322R3 and 322R4 may each have a thickness that is smaller than the thickness of each of the ribs 322R1 and 322R2, for example.

The containing part 322DA may be space in which the RFID tag 330 is to be contained. More specifically, the containing part 322DA may be space surrounded by the ribs 322R1 to 322R5, for example. A range of the containing part 322DA may be defined, for example, by the ribs 322R1, 322R2, and 322R5, by utilizing a difference in thickness between the ribs 322R1 to 322R5 described above. The RFID tag 330 may be placed on each of the ribs 322R3 and 322R4, for example.

The depression 322DB may be provided on the rib 322R1, for example. In other words, the depression 322DB may be formed by a partial depression of the rib 322R1, for example. The depression 322DB may extend in a direction similar to the direction in which the projection 321PA extends. The depression 322DB may allow the projection 321PA to be inserted into the depression 322DB. When the RFID tag 330 is attached to the containing unit 310 by means of the attachment unit 320, the projection 321PA may be inserted into the depression 322DB. The depression 322DB may have an opening shape that is not particularly limited. For example, the opening shape of the depression 322DB may be a rectangular shape or any other shape.

The open part 322DC may be space as a result of non-extension of the rib 322R2. The projection 321PB may be disposed in the open part 322DC when the pivoting shaft 321S is inserted into the pivoting shaft bearing 322U.

When the RFID tag 330 is attached to the containing unit 310 by means of the attachment unit 320, the RFID tag 330 may be covered with the cover 321 in a state where the RFID tag 330 is contained in the containing part 322DA. In this case, the projection 321PA may be inserted into the depression 322DB and the projection 321PB may be disposed in the open part 322DC in accordance with containing of the lid part 321L of the cover 321 in the containing part 322DA.

The rib 322R1 may have a through opening 322H. The through opening 322H may extend in a direction (the Y-axis direction) that intersects the direction in which the projection 321PA extends. Further, the through opening 322H may be in communication with the depression 322DB. In other words, the through opening 322H may be coupled to the depression 322DB, which causes the through opening 322H and the depression 322DB to be joined with each other. The through opening 322H may have an opening shape that is not particularly limited. For example, the opening shape of the through opening 322H may be a circular shape. The through opening 322H may correspond to the "through opening" in one specific but non-limiting embodiment of the technology.

The through opening 322H may have an inner diameter that is not particularly limited. Accordingly, the inner diameter of the through opening 322H may be constant or varied in a direction in which the through opening 322H extends. In this example, the inner diameter of the through opening 322H may be constant in the direction in which the through opening 322H extends.

The rib 322R2 may be provided with the pivoting shaft bearing 322U that extends in a direction (the Y-axis direction) similar to the direction in which the pivoting shaft 321S extends, for example. The pivoting shaft bearing 322U may allow the pivoting shaft 321S to be inserted into the pivoting shaft bearing 322U. The pivoting shaft bearing 322U may have an opening shape that is not particularly limited as long as the opening shape allows the pivoting shaft 321S to be inserted into the pivoting shaft bearing 322U, for example.

It may be preferable, in particular, that the opening shape of the pivoting shaft bearing 322U be longer in a direction (the Z-axis direction) intersecting the direction in which the pivoting shaft 321S is to be inserted. Specifically, the opening shape of the pivoting shaft bearing 322U may be a substantially-oblong shape having four rounded corners or any other shape, for example. One reason for this is that such a shape allows the pivoting shaft 321S to be movable inside the pivoting shaft bearing 322U in the state where the pivoting shaft 321S is inserted into the pivoting shaft bearing 322U, allowing the position of the cover 321 to be adjustable upon the attachment of the cover 321 to the support 322.

The rib 322R5 may have an opening 322F, for example. The opening 322F may allow the projection 321PC to be inserted into the opening 322F. The opening 322F may not be particularly limited in its number. Therefore, only one opening 322F may be provided. Alternatively, two or more openings 322F may be provided. In this example, three openings 322F may be provided corresponding in number to the three projections 321PC described above. The three openings 322F may be separated from each other by two partition ribs 322V, for example. The opening 322F may correspond to a "fourth opening" in one specific but non-limiting embodiment of the technology.

The containing part 322DA may have a width W5 that is not particularly limited. It may be preferable, in particular, that the width W5 of the containing part 322DA be greater than a width W4 of the cover 321, specifically, of the lid part 321L. Further, the depression 322DB may have a width W3 that is not particularly limited. It may be preferable, in particular, that the width W3 of the depression 322DB be greater than the width W1 of the projection 321PA. One reason for this is that such relationships in width may allow the cover 321 to be movable (slidable) in the width direction in a state where the cover 321 is temporarily or fully fixed to the support 322, as will be described later in greater detail.

In particular, it may be preferable that a difference between the width W3 of the depression 322DB and the width W1 of the projection 321PA be equal to or greater than a difference between the width W5 of the containing part 322DA and the width W4 of the cover 321. In other words, it may be preferable that a relationship expressed by $(W3-W1)\geq(W5-W4)$ be established. One reason for this is that such a relationship allows a main part of the cover 321, i.e., the lid part 321L covering the RFID tag 330, to be slidable in a wide range. This makes it easier for the three projections 321PC to be contained in the containing part 322DA together with the lid part 321L when the cover 321 pivots around the pivoting shaft 321S, as will be described later in greater detail.

The insertion pin 323 may be insertable into the through opening 322H and the insertion opening 321H in this order. When the RFID tag 330 is to be attached to the containing unit 310 by means of the attachment unit 320, insertion of the projection 321PA into the depression 322DB may cause the insertion pin 323 to be inserted into the through opening 322H and the insertion opening 321H in this order, in a state where the RFID tag 330 is sandwiched between the cover 321 and the support 322. The insertion pin 323 may include a material details of which are similar to or the same as the details of the material included in the insertion pin 123, for example. Further, the insertion pin 323 may have a three-dimensional shape details of which are similar to or the same as the details of the three-dimensional shape of the insertion pin 123, for example. FIG. 18 illustrates a state where the insertion pin 323 is separated away from the containing unit 310. FIGS. 19 and 20 omit illustration of the insertion pin 323.

The insertion pin 323 may have a length L1, i.e., a dimension in the Y-axis direction, that is not particularly limited. It may be preferable, in particular, that the length L1 of the insertion pin 323 be equal to or smaller than sum of a length L2 of the insertion opening 321H and a length L3 of the through opening 322H, as illustrated in FIG. 28. In other words, it may be preferable that $L1\leq L2+L3$ be established. Moreover, it may be more preferable, in particular, that the length L1 be smaller than the sum of the length L2 and the length L3, i.e., $L1<L2+L3$ be established. One reason for this is that such a relationship allows the insertion pin 323 to be pressed sufficiently into the inside of the through opening 322H. This makes it more difficult for a rear end of the insertion pin 323 to be present outside the through opening 322H. Accordingly, it is more difficult for the insertion pin 323 to be pulled out from the through opening 322H.

The insertion pin 323 may include a material that is not particularly limited. It may be preferable, in particular, that the insertion pin 323 include not a metal material but a polymer material to thereby decrease a possibility of inhibiting wireless communication using the RFID tag 330.

<3-2. Procedure of Attachment of RFID Tag>

A description is given below of a procedure of the attachment of the RFID tag 330 with reference to FIGS. 18 to 32.

The description below is given on the premise that the cover 321 and the insertion pin 323 are not attached to the containing unit 310 as illustrated in FIG. 18 in a state before the attachment of the RFID tag 330 to the containing unit 310 by means of the attachment unit 320, for example.

When the RFID tag 330 is to be attached to the containing unit 310 by means of the attachment unit 320, first, the RFID tag 330 may be placed on the ribs 322R3 and 322R4 as illustrated in FIGS. 19 and 20, and the RFID tag 330 may be thereby contained in the containing part 322DA. In this case, the RFID tag 330 may be so placed on the ribs 322R3 and 322R4 that one end of the RFID tag 330 is brought into contact with the two partition ribs 322V and the projection-shaped memory 333 of the RFID tag 330 is disposed in the space between the ribs 322R3 and 322R4.

Thereafter, referring to FIGS. 20 and 21, the cover 321 may be attached to the rib 322R2. In this case, the projection 321PB may be disposed in the open part 322DC, and the pivoting shaft 321S may be thereby inserted into the pivoting shaft bearing 322U. The cover 321 may be thereby aligned with respect to the support 322.

Thereafter, referring to FIGS. 22 to 25, the cover 321 may pivot around the pivoting shaft 321S, and the RFID tag 330 may be thereby covered with the cover 321. Accordingly, the lid part 321L may be contained in the containing part 322DA, and the projection 321PA may be inserted into the depression 322DB. This may cause the RFID tag 330 to be sandwiched between the cover 321 and the support 322, by which the RFID tag 330 may be temporarily fixed to the containing unit 310.

The width W5 of the containing part 322DA may be greater than the width W4 of the cover 321, specifically, of the lid part 321L, and the width W3 of the depression 322DB may be greater than the width W1 of the projection 321PA, as described above, for example. For this reason, the cover 321 may be slidable in the width direction, i.e., the direction (the Y-axis direction) in which the insertion pin 323 is inserted which will be described later in greater detail, upon pivoting of the cover 321. The position of the cover 321 may be therefore adjustable in the width direction. In this case, the three projections 321PC provided on the lid part 321L may be contained in the containing part 322DA by adjusting the position of the cover 321.

Thereafter, referring to FIGS. 26 to 30, the insertion pin 323 may be inserted into the through opening 322H and the insertion opening 321H in this order. Specifically, the insertion pin 323 may be inserted into the through opening 322H, and thereafter, the insertion pin 323 may be inserted into the insertion opening 321H.

Upon the insertion of the insertion pin 323 into the through opening 322H and the insertion opening 321H in this order, the insertion pin 323 may be pressed sufficiently into the inside of the insertion opening 321H. Specifically, the insertion pin 323 may be so pressed sufficiently enough for the front end of the insertion pin 323 to be brought into contact with the bottom surface 321N and for the rear end of the insertion pin 323 to be prevented from being present outside the opening 322H. In this case, the cover 321 may be slid in the direction in which the insertion pin 323 is inserted, by utilizing the operation of pressing the insertion pin 323 and thereby pressing the projection 321PA with the insertion pin 323.

Accordingly, referring to FIGS. 31 and 32, the insertion pin 323 may be inserted into the through opening 322H and the insertion opening 321H in this order, and the three projections 322PC may be inserted into the respective three openings 322F, in the state where the RFID tag 330 is sandwiched between the cover 321 and the support 322. Accordingly, the RFID tag 330 may be fully fixed to the containing unit 310. The attachment of the RFID tag 330 by means of the attachment unit 320 may be thus completed.

<3-3. Procedure of Detachment of RFID Tag>

In a state where the attachment of the RFID tag 330 is completed, the RFID tag 330 may be fixed to the containing unit 310. The RFID tag 330 may be therefore more difficult to fall off upon the use of the toner cartridge 300. In addition, it may be difficult to pull out the insertion pin 323 from the through opening 322H with a tool such as pliers owing to the insertion of the insertion pin 323 into each of the insertion opening 321H and the through opening 322H. This may make it difficult to remove the insertion pin 323 inserted into each of the insertion opening 321H and the through opening 322H.

However, for example, in some cases such as a case where the RFID tag 330 which has not been intended to be attached is attached mistakenly, the mistakenly-attached RFID tag 330 may be collected by a procedure described below after the completion of its attachment on an as-needed basis.

FIGS. 33 to 40 are each a perspective view or a cross-sectional view of the configuration that describes a procedure of detachment of the RFID tag 330, and correspond to FIGS. 19 to 32.

Figure 33:
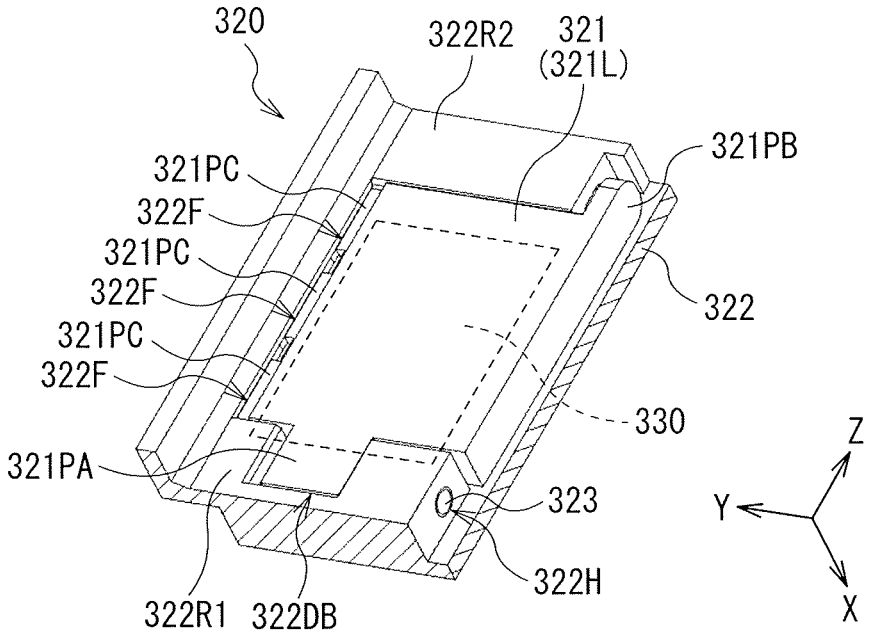
FIG. 33 is a perspective view of another configuration example of the toner cartridge illustrated in FIG. 26.
Figure 34:
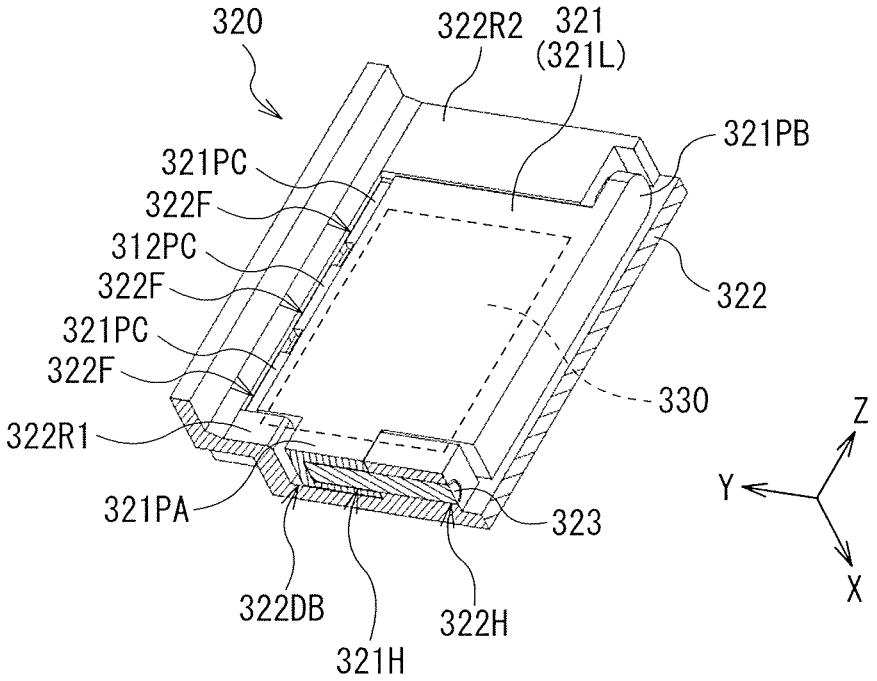
FIG. 34 is a perspective view of a configuration example of a partial cross-section of the toner cartridge illustrated in FIG. 33.
Figure 36:
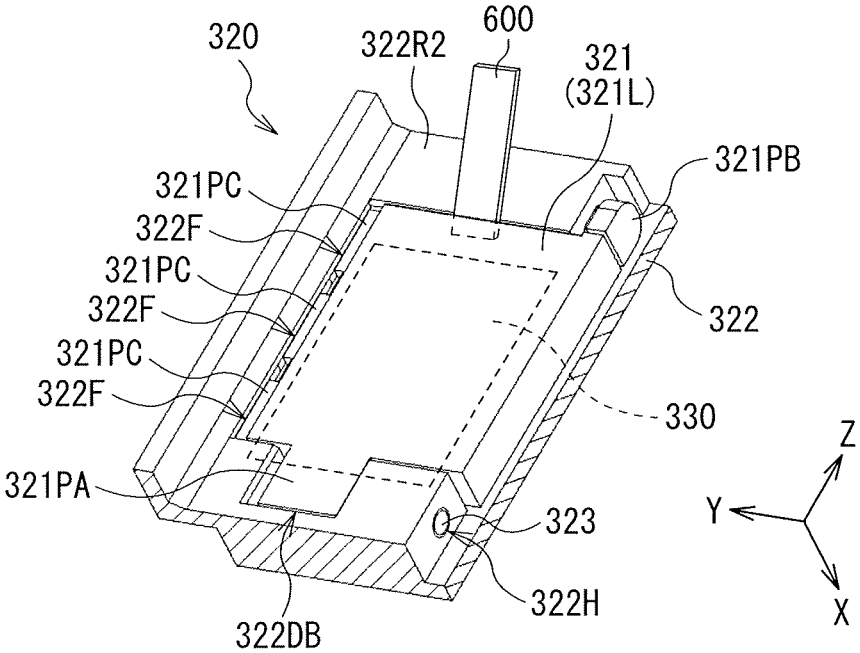
FIG. 36 is a perspective view of another configuration example of the toner cartridge illustrated in FIG. 26.
Figure 37:
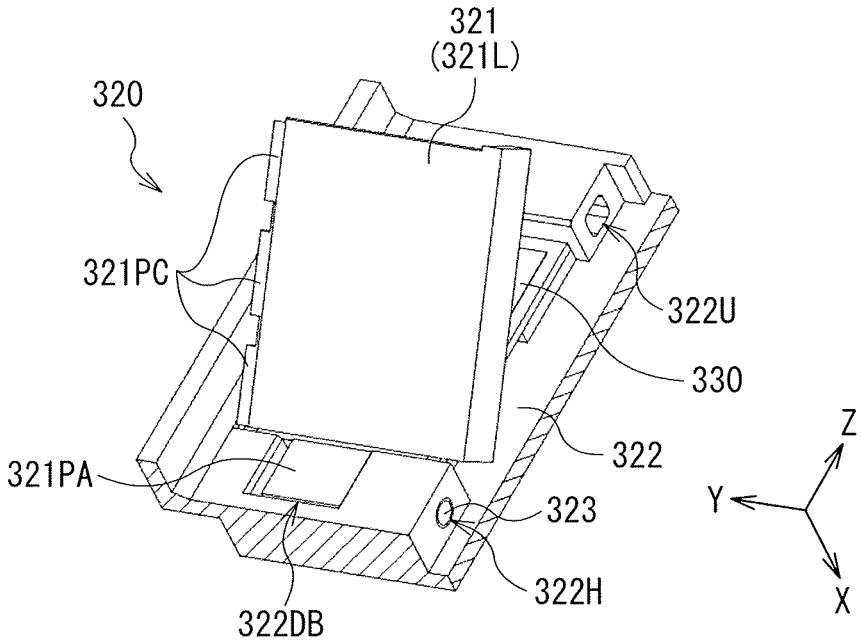
FIG. 37 is a perspective view of another configuration example of the toner cartridge illustrated in FIG. 26.
Figure 38:
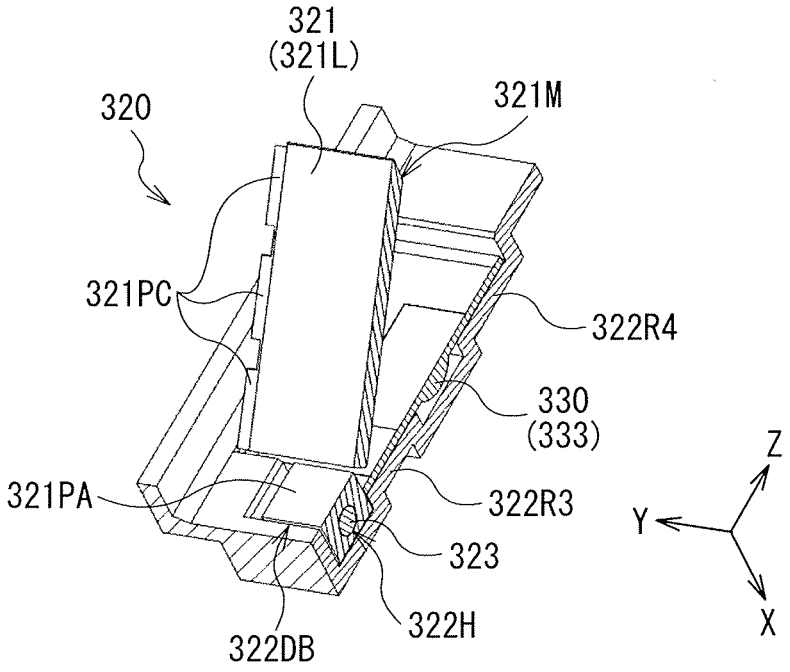
FIG. 38 is a perspective view of a configuration example of a partial cross-section of the toner cartridge illustrated in FIG. 37.

Specifically, FIGS. 33, 34, 36 to 38, and 40 are each a perspective view of the configuration of the toner cartridge 300. FIG. 34 is a perspective view of the configuration of the toner cartridge 300 including a partial cross-section corresponding to that illustrated in FIG. 33. FIG. 38 is a perspective view of the configuration of the toner cartridge 300 including a partial cross-section corresponding to that illustrated in FIG. 37. FIG. 34 illustrates the cross-section taken along the X-Y plane. FIG. 38 illustrates the cross-section taken along the X-Z plane.

Figure 39:
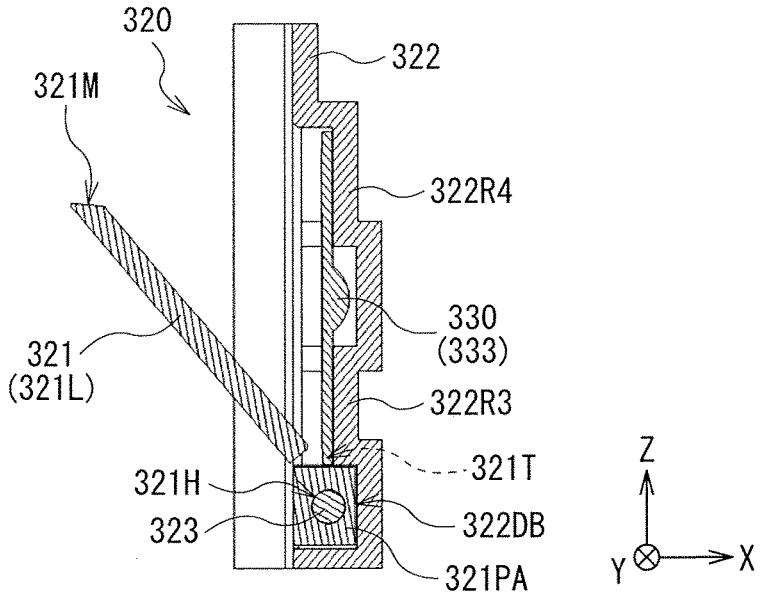
FIG. 39 is a cross-sectional view of the configuration example of the toner cartridge illustrated in FIG. 38.

FIG. 35 is a cross-sectional view of the configuration of the toner cartridge 300 corresponding to that illustrated in FIG. 34. FIG. 39 is a cross-sectional view of the configuration of the toner cartridge 300 corresponding to that illustrated in FIG. 38. FIG. 35 illustrates the cross-section taken along the X-Y plane. FIG. 39 illustrates the cross-section taken along the X-Z plane.

When the RFID tag 330 is to be detached from the containing unit 310, first, the cover 321 may be caused to slide in a state where the insertion pin 323 is inserted into each of the insertion opening 321H and the through opening 322H, as illustrated in FIGS. 33 to 35. Accordingly, the three projections 321PC may be pulled out from the respective three openings 322F.

Thereafter, referring to FIG. 36, a tool 600 may be inserted into a gap between the cover 321 and the rib 322R2, following which a first end of the tool 600 may be pressed downward and a second end of the tool 600 may be pressed upward by utilizing the principle of leverage. In this case, owing to the provision of the sloped surface 321M at one end of the cover 321, a tip of the tool 600 may be brought into contact with the sloped surface 321M upon using the tool 600.

The tool 600 may not be particularly limited in its type. For example, the tool 600 may be a tool such as a screw driver and nippers that is insertable into the gap between the cover 321 and the rib 322R2. In particular, the tool 600 may preferably be a tool such as a flat head screwdriver that has a tip of a plate-like shape, for example. One reason for this is that the tip of the tool 600 may be inserted into the gap between the cover 321 and the rib 322R2 more easily and the tip of the plate-like shape may be brought into contact with the sloped surface 321M more easily. FIG. 36 illustrates the tool 600 as that having the plate-like shape in a simple manner.

In the foregoing manner, referring to FIGS. 37 to 39, the cover 321 (the lid part 321L) may be so lifted up by the second end of the tool 600 as to be away from the RFID tag 330 in the state where the pivoting shaft 321S is inserted into the pivoting shaft bearing 321U. In this case, the cover 321 may be broken intentionally in accordance with the force that lifts up the lid part 321L. This may cause the projection 321PB to be separated from the lid part 321L. Further, the cover 321 may be bent at the position where the notch 321T is provided. For this reason, only the lid part 321L that has covered the RFID tag 330 may be lifted up in a state where the projection 321PA is inserted into the depression 322DB. This may cause the RFID tag 330 to be exposed. In an alternative example, the lid part 321L may be removed by separating the projection 321PA from the lid part 321L after bending the cover 321.

Figure 40:
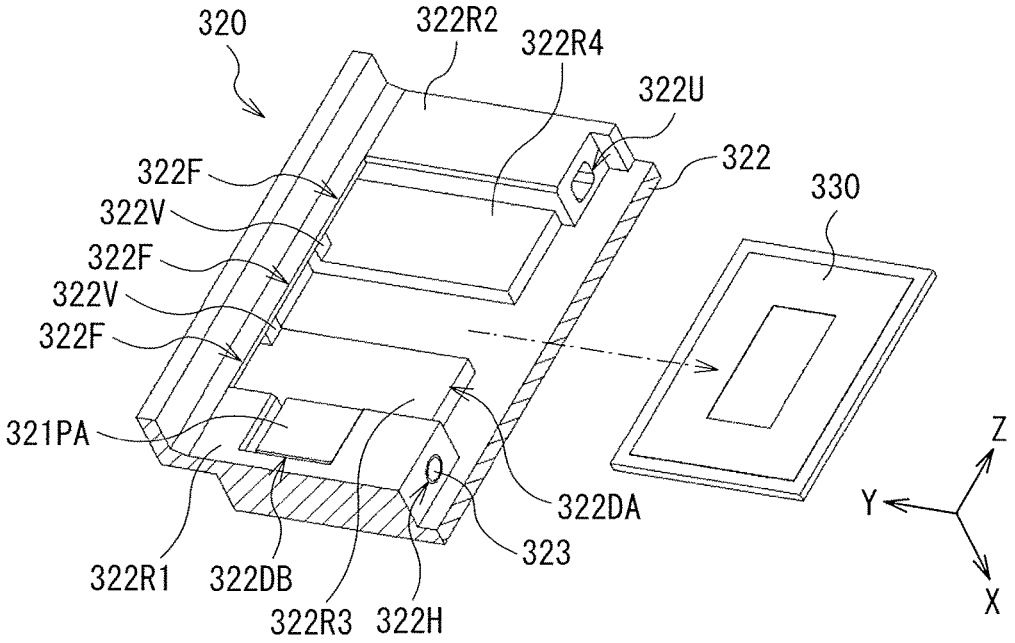
FIG. 40 is a perspective view of another configuration example of the toner cartridge illustrated in FIG. 26.

Lastly, referring to FIG. 40, the RFID tag 330 may be collected from the containing part 322DA. FIG. 40 illustrates a state where the lid part 321L is removed. The detachment of the RFID tag 330 may be thereby completed.

<3-4. Example Workings and Example Effects>

In the foregoing toner cartridge 300, the insertion pin 323 may be inserted into the through opening 322H and the insertion opening 321H in this order in the state where the projection 321PA is inserted into the depression 322DB and the RFID tag 330 is thereby sandwiched between the cover 321 and the support 322 in the attachment unit 320. In this case, the cover 321 may be fixed to the support 322 in a state where the RFID tag 330 is contained inside the cover 321 as described above. The RFID tag 330 may be therefore fixed to the support 322. This makes it more difficult for the RFID tag 330 to fall off after the completion of the attachment of the RFID tag 330. Hence, it is possible to prevent the RFID tag 330 from falling off.

In particular, when the cover 321 includes the pivoting shaft 321S, and the cover 321 is pivotable around the pivoting shaft 321S, it may be easier to align the cover 321 with respect to the support 322 with the pivoting shaft 321S, and it may be possible to cover the RFID tag 330 easily by utilizing the pivoting operation of the cover 321. Hence, it is possible to easily perform the attachment of the RFID tag 330 to the containing unit 310.

Further, when the width W3 of the depression 322DB is greater than the width W1 of the projection 321PA, the cover 321 may be slidable in the width direction in the state where the projection 321PA is inserted into the depression 322DB. This allows for easier alignment of the cover 321 with respect to the support 322. Hence, it is possible to easily perform the attachment of the RFID tag 330 to the containing unit 310.

In addition, when the insertion opening 321H is the non-through opening, the projection 321PA may be pressed by utilizing the insertion operation of the insertion pin 323 into the insertion opening 321H. The cover 321 may be thereby allowed to slide more easily. Hence, it is possible to easily perform the attachment of the RFID tag 330 to the containing unit 310.

Moreover, when the cover 321 includes the three projections 321PC and the rib 322R5 has the three openings 322F, the three projections 321PC may be inserted into the respective three openings 322F by utilizing the sliding operation of the cover 321 described above. The cover 321 may be thereby fixed to the support 322 more firmly. Hence, it is possible to prevent the RFID tag 330 from falling off more effectively.

Further, when the length L1 of the insertion pin 323 is equal to or smaller than the sum of the length L2 of the insertion opening 321H and the length L3 of the through opening 322H, the rear end of the insertion pin 323 may be made more difficult to be present outside the through opening 322H by sufficiently pressing the insertion pin 323 into the inside of the through opening 322H. This makes it more difficult for the insertion pin 323 to be pulled out from the through opening 322H. Hence, it is possible to achieve higher effects.

Further, when the cover 321 includes the projection 321PB, and the projection 321PB is allowed to be separated from the lid part 321L in accordance with the force that lifts up the lid part 321L with the tool 600, the RFID tag 330 may be exposed on an as-needed basis after the completion of the attachment of the RFID tag 330. Hence, it is possible to collect the RFID tag 330.

In addition, when the cover 321 is bendable in accordance with the force that lifts up the lid part 321L with the tool 600, owing to the provision of the notch 321T in the cover 321 at a position where the projection 321PA and the lid part 321L are coupled to each other, the RFID tag 330 may be exposed more easily. Hence, it is possible to collect the RFID tag 330 more easily.

Example workings and example effects related to the toner cartridge 300 other than those described above may be similar to or the same as the example workings and the example effects related to the toner cartridge 100 described above.

4. Image Forming Unit

A description is given below of an image forming unit according to one example embodiment of the technology.

An image forming unit described below may perform a development process with a toner, and include a toner cartridge 410, an attachment unit 500, or both. The toner cartridge 410 may correspond to the toner cartridge 100 described above. The attachment unit 500 may correspond to the attachment unit 120 described above.

<4-1. Configuration>

A description is given first of a configuration of the image forming unit 400. The image forming unit 400 may correspond to an "image forming unit" in one specific but non-limiting embodiment of the technology. The components of the toner cartridge 100 described above will be referred to in the description below where appropriate.

Examples of the configuration of the image forming unit 400 may include three types of configuration examples (Configuration examples 1 to 3) described below. The components of the toner cartridge 100 described above will be referred to in the description below where appropriate.

<4-1-1. Configuration Example 1>

Figure 41:
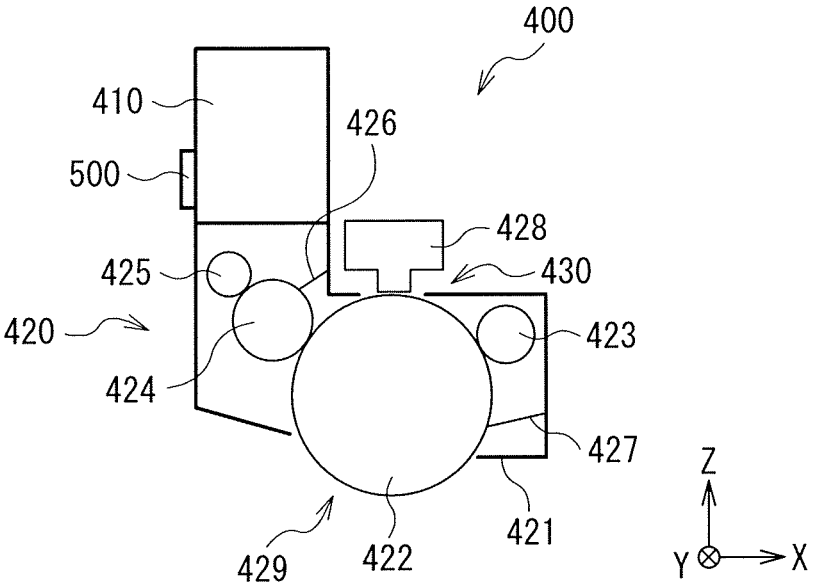
FIG. 41 is a plan view of a configuration example (Configuration example 1) of an image forming unit according to one example embodiment of the technology.

FIG. 41 schematically illustrates a planar configuration of the image forming unit 400 according to Configuration example 1.

The image forming unit 400 may include a toner cartridge 410 and a development processor 420 that performs a development process with a toner contained in the toner cartridge 410. The toner cartridge 410 may correspond to the "toner container" or the "toner containing unit" in one specific but non-limiting embodiment of the technology.

[Toner Cartridge]

The toner cartridge 410 may have a configuration that is similar to the configuration of the toner cartridge 100 described above, except that the toner cartridge 410 may include the attachment unit 500 instead of the attachment unit 120. Specifically, the memory substrate 130 may be attached by means of the attachment unit 500. The toner cartridge 410 may be attached to the development processor 420 detachably, for example. The attachment unit 500 may have a configuration that is similar to or the same as the configuration of the attachment unit 120. FIG. 41 does not illustrate the configuration of the attachment unit 500 in detail for schematic illustration purpose of the attachment unit 500.

[Development Processor]

The development processor 420 may form a latent image, specifically, an electrostatic latent image, and attach the toner to the formed electrostatic latent image.

Referring to FIG. 41, the development processor 420 may include, inside a housing 421, a photosensitive drum 422, a charging roller 423, a developing roller 424, a feeding roller 425, a developing blade 426, a cleaning blade 427, and a light source 428, for example.

The photosensitive drum 422 may be an organic photoreceptor that includes a cylindrical electrically-conductive supporting body and a photoconductive layer, for example. The photoconductive layer may cover an outer peripheral surface of the electrically-conductive supporting body. The photosensitive drum 422 may be rotatable with a drive source such as a motor. The electrically-conductive supporting body may be a metal pipe that includes one or more of metal materials such as aluminum, for example. The photoconductive layer may be a stack that includes an electric charge generating layer and an electric charge transfer layer, for example. The photosensitive drum 422 may be partially exposed from an opening 429 provided on the housing 421.

The charging roller 423 may include a metal shaft and an electrically-semiconductive epichlorohydrin rubber layer that covers an outer peripheral surface of the metal shaft, for example. The charging roller 423 may be so pressed against the photosensitive drum 422 as to be in contact with the photosensitive drum 422, thereby charging the photosensitive drum 422.

The developing roller 424 may include a metal shaft and an electrically-semiconductive urethane rubber layer that covers an outer peripheral surface of the metal shaft, for example. The developing roller 424 may support the toner that is fed from the feeding roller 425, and attach the fed toner onto a latent image, specifically, an electrostatic latent image, formed on a surface of the photosensitive drum 422.

The feeding roller 425 may include a metal shaft and an electrically-semiconductive foamed silicone sponge layer that covers an outer peripheral surface of the metal shaft, for example. The feeding roller 425 may be a so-called sponge roller, for example. The feeding roller 425 may feed the toner to the surface of the photosensitive drum 422 while being in contact with the developing roller 424 in a slidable manner.

The developing blade 426 may control a thickness of the toner fed on the surface of the developing roller 424. The developing blade 426 may be disposed at a position away from the developing roller 424 with a predetermined distance in between, for example. The thickness of the toner may be controlled on the basis of the distance (spacing) between the developing roller 424 and the developing blade 426. The developing blade 426 may include one or more of metal materials such as stainless steel, for example.

The cleaning blade 427 may scrape off unnecessary remains of the toner that are present on the surface of the photosensitive drum 422. The cleaning blade 427 may extend in a direction substantially parallel to a direction in which the photosensitive drum 422 extends, for example. The cleaning blade 427 may be so pressed against the photosensitive drum 422 as to be in contact with the photosensitive drum 422. Further, the cleaning blade 427 may include one or more of polymer materials such as urethane rubber, for example.

The light source 428 may be an exposure unit that performs exposure of the surface of the photosensitive drum 422 through an opening 430 provided on the housing 421, and thereby forms an electrostatic latent image on the surface of the photosensitive drum 422. The light source 428 may be a light-emitting diode (LED) head, and include members such as an LED device and a lens array, for example. The LED device and the lens array may be so disposed that light (application light) outputted from the LED device is imaged on the surface of the photosensitive drum 422. It is to be noted that, in an alternative example, the image forming unit 400 may not include the light source 428, for example. In this case, the light source 428 may be attached to the image forming unit 400 in a separated manner, for example.

<4-1-2. Configuration Example 2>

Figure 42:
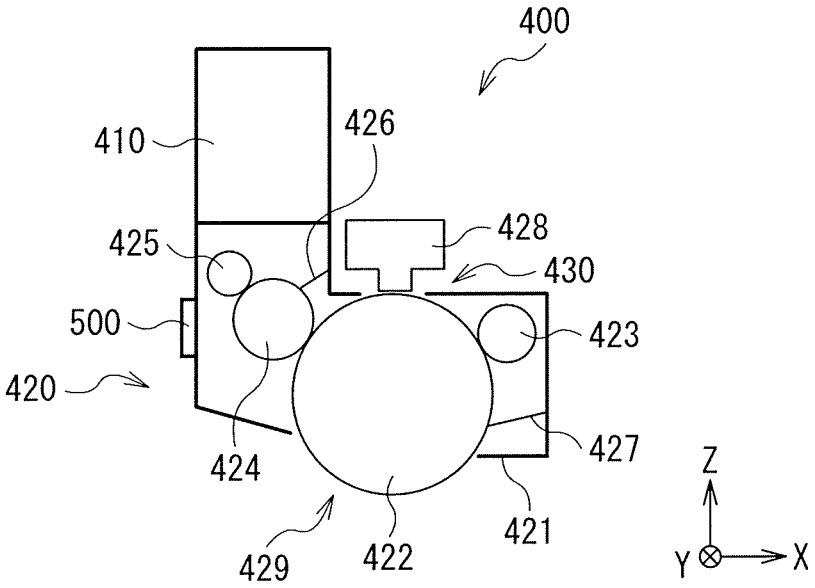
FIG. 42 is a plan view of another configuration example (Configuration example 2) of the image forming unit according to one example embodiment of the technology.

FIG. 42 schematically illustrates a planar configuration of the image forming unit 400 according to Configuration example 2, and corresponds to FIG. 41.

The image forming unit 400 according to Configuration example 2 may have a configuration that is similar to the configuration of the image forming unit 400 illustrated in FIG. 41 according to Configuration example 1, except that the attachment unit 500 may be provided in the development processor 420 instead of the toner cartridge 410. Accordingly, the toner cartridge 410 may have a configuration that is similar to the configuration of the toner cartridge 100 except that the toner cartridge 410 according to Configuration example 2 does not include the attachment unit 120 corresponding to the attachment unit 500. The development processor 420 may have a configuration that is similar to the configuration of the development processor 420 in the image forming unit 400 according to Configuration example 1, except that the development processor 420 according to Configuration example 2 may include the attachment unit 500. The attachment unit 500 may be provided at a position that is not particularly limited, for example.

<4-1-3. Configuration Example 3>

Figure 43:
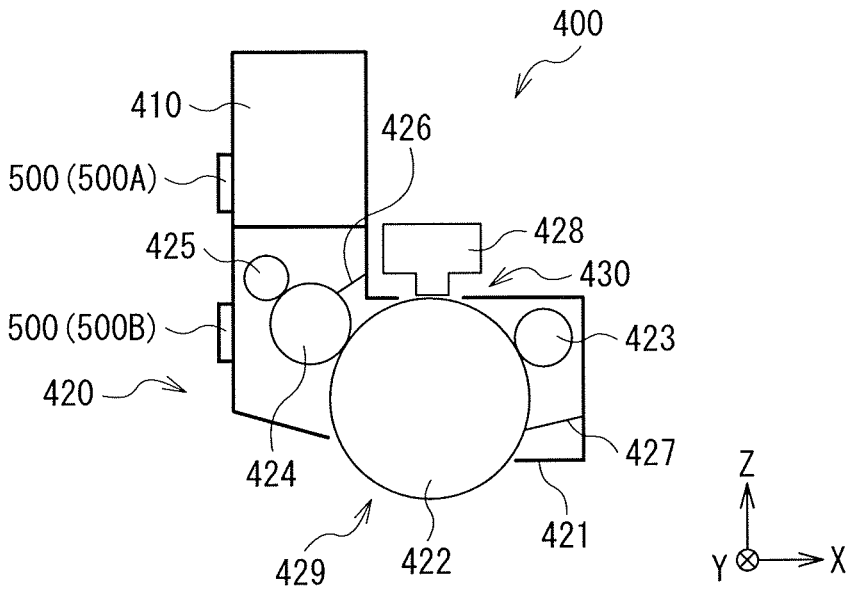
FIG. 43 is a plan view of still another configuration example (Configuration example 3) of the image forming unit according to one example embodiment of the technology.

FIG. 43 schematically illustrates a planar configuration of the image forming unit 400 according to Configuration example 3, and corresponds to FIG. 41.

The image forming unit 400 according to Configuration example 3 may have a configuration that is similar to the configuration of the image forming unit 400 illustrated in each of FIGS. 41 and 42 according to the corresponding one of Configuration examples 1 and 2, except that two attachment units 500, i.e., an attachment unit 500A and an attachment unit 500B, may be provided instead of the single attachment unit 500. Specifically, the attachment unit 500A may be provided in the toner cartridge 410, and the attachment unit 500B may be provided in the development processor 420. In other words, the toner cartridge 410 including the attachment unit 500 (500A) may have a configuration that is similar to or the same as the configuration of the toner cartridge 410 in the image forming unit 400 according to Configuration example 1. In contrast, the development processor 420 including the attachment unit 500 (500B) may have a configuration that is similar to or the same as the configuration of the development processor 420 in the image forming unit 400 according to Configuration example 2.

When the two attachment units 500 (500A and 500B) are provided, the memory substrate 130 attached by means of the attachment unit 500A and the memory substrate 130 attached by means of the attachment unit 500B may store pieces of information that are common to each other, or store pieces of information that are different from each other.

In the latter case, the memory substrate 130 attached by means of the attachment unit 500A may store information such as information on the toner cartridge 410 and information on the toner, for example, whereas the memory substrate 130 attached by means of the attachment unit 500B may store information such as information on a color of the toner and information on a volume of the toner, for example.

<4-2. Operation>

A description is given below of an operation of the image forming unit 400.

The procedure of the attachment of the memory substrate 130 is not further described below, since the procedure of the attachment of the memory substrate 130 has been already described above.

In the image forming unit 400, first, the charging roller 423 may apply a direct-current voltage to the surface of the photosensitive drum 422 while rotating in accordance with the rotation of the photosensitive drum 422 in the development processor 420. The surface of the photosensitive drum 422 may be thereby charged evenly.

Thereafter, the light source 428 may apply light to the surface of the photosensitive drum 422 on the basis of image data supplied to the image forming unit 400 from outside. A surface potential in a part, of the surface of the photosensitive drum 422, on which the light is applied may be thereby attenuated. In other words, optical attenuation may occur in the part, of the surface of the photosensitive drum 422, on which the light is applied. An electrostatic latent image may be thereby formed on the surface of the photosensitive drum 422.

The toner contained in the toner cartridge 410 may be released toward the development processor 420.

Thereafter, the feeding roller 425 may rotate after receiving application of a voltage. The toner may be thereby fed onto the surface of the feeding roller 425.

Thereafter, the developing roller 424 may rotate while being so pressed against the feeding roller 425 as to be in contact with the feeding roller 425, after receiving application of a voltage. The toner fed onto the surface of the feeding roller 425 may be thereby adsorbed onto the surface of the developing roller 424, whereby the toner may be conveyed by utilizing the rotation of the developing roller 424. In this case, the toner adsorbed onto the surface of the developing roller 424 may be partially removed by the developing blade 426, whereby the toner adsorbed onto the surface of the developing roller 424 may be caused to have an even thickness.

Lastly, after the photosensitive drum 422 rotates while being so pressed against the developing roller 424 as to be in contact with the developing roller 424, the toner adsorbed onto the surface of the developing roller 424 may be transferred onto the surface of the photosensitive drum 422. The toner may be thereby attached to the surface of the photosensitive drum 422, i.e., to the electrostatic latent image. This may complete the development process.

<4-3. Example Workings and Example Effects>

In the image forming unit 400, the memory substrate 130 may be attached by means of the attachment unit 500 owing to the provision of the attachment unit 500 having a configuration that is similar to or the same as the configuration of the attachment unit 120. Hence, it is possible to prevent the memory substrate 130 from falling off owing to reasons similar or the same as to those described for the toner cartridge 100.

Example workings and example effects related to the image forming unit 400 other than those described above may be similar to or the same as the example workings and the example effects related to the toner cartridge 100 described above.

It is to be noted that, although the description has been given of an example case where the toner cartridge 100 is applied to the image forming unit 400, the toner cartridge 200 may be applied, instead of the toner cartridge 100, to the image forming unit 400. Specifically, the image forming unit may include the toner cartridge 410 corresponding to the toner cartridge 200 and the attachment unit 500 corresponding to the attachment unit 220. In this case, it is possible to prevent the memory substrate 230 from falling off. It is to be also noted that the image forming unit 400 according to Configuration example 3 may include both the toner cartridges 100 and 200.

Moreover, the toner cartridge 300 may be applied, instead of the toner cartridge 100, to the image forming unit 400. Specifically, the image forming unit may include the toner cartridge 410 corresponding to the toner cartridge 300 and the attachment unit 500 corresponding to the attachment unit 320. In this case, it is possible to prevent the RFID tag 330 from falling off. It is to be also noted that the image forming unit 400 according to Configuration example 3 may include both the toner cartridges 100 and 300.

5. Image Forming Apparatus

A description is given below of an image forming apparatus according to one example embodiment of the technology.

The image forming apparatus described below may form an image on a surface of a medium M with a toner, for example, and may be a so-called full-color printer using an electrophotographic scheme, for example. The medium M may be described later in greater detail with reference to FIGS. 44 and 45. The medium M may include a material that is not particularly limited. For example, the material included in the medium M may be one or more of materials such as paper and a film.

The image forming apparatus may include the foregoing image forming unit 400. The components of the image forming unit 400 described above will be referred to in the description below where appropriate.

<5-1. Configuration>

A description is given first of a configuration of the image forming apparatus. Examples of the configuration of the image forming apparatus may include two types of configuration examples (Configuration examples 1 and 2) described below.

<5-1-1. Configuration Example 1>

Figure 44:
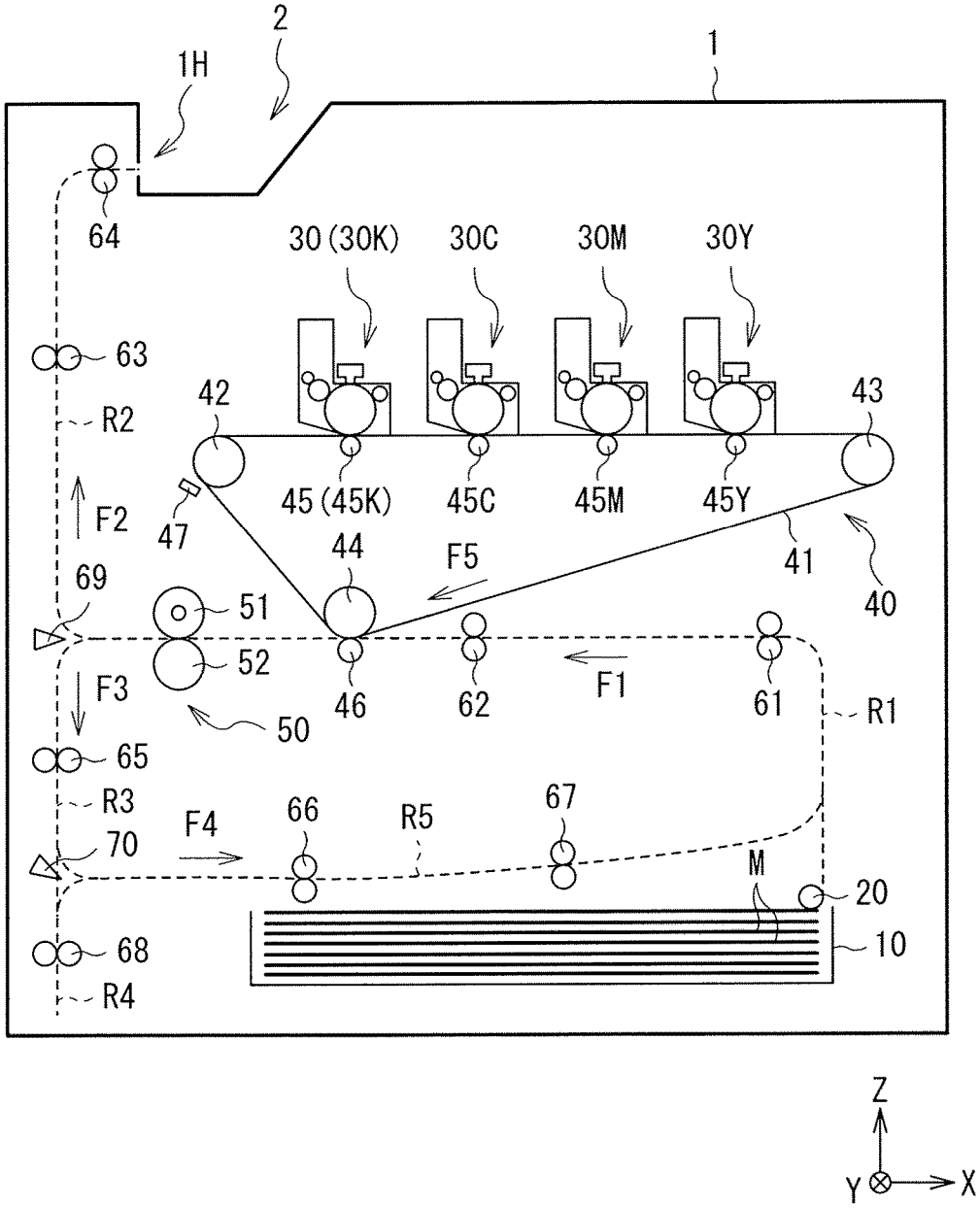
FIG. 44 is a plan view of a configuration example (Configuration example 1) of an image forming apparatus according to one example embodiment of the technology.

FIG. 44 illustrates a planar configuration of an image forming apparatus according to Configuration example 1. The image forming apparatus according to Configuration example 1 may include a developing unit 30 to which one or both of the toner cartridges 100 and 200 are applied. The developing unit 30 will be described later in greater detail. This image forming apparatus may allow the medium M to be conveyed along conveyance routes R1 to R5. Each of the conveyance routes R1 to R5 is illustrated by a dashed line in FIG. 44.

Referring to FIG. 44, the image forming apparatus may specifically include, inside a housing 1, a tray 10, a feeding roller 20, one or more developing units 30, a transferring unit 40, a fixing unit 50, conveying rollers 61 to 68, and conveyance path switching guides 69 and 70, for example.

[Housing]

The housing 1 may include one or more of materials such as a metal material and a polymer material, for example. The housing 1 may be provided with a stacker 2 to which the medium M provided with a formed image is to be discharged. The medium M provided with the formed image may be discharged from a discharge opening 1H provided on the housing 1.

[Tray and Feeding Roller]

The tray 10 may be attached detachably to the housing 1, for example. The tray 10 may contain the medium M, for example. The feeding roller 20 may extend in the Y-axis direction and be rotatable around the Y-axis, for example. Each of the members referred to by the name including the term "roller" within a series of members described below may extend in the Y-axis direction and be rotatable around the Y-axis, as with the feeding roller 20.

The tray 10 may contain a plurality of media M in a stacked state, for example. The media M contained in the tray 10 may be picked out one by one from the tray 10 by the feeding roller 20, for example.

Each of the tray 10 and the feeding roller 20 may not be particularly limited in its number. Therefore, one tray 10 may be provided, or two or more trays 10 may be provided. Further, one feeding roller 20 may be provided, or two or more feeding rollers 20 may be provided. FIG. 44 illustrates an example case where one tray 10 and one feeding roller 20 may be provided.

[Developing Unit]

The one or more developing units 30 may each have a configuration that is similar to or the same as the configuration of the image forming unit 400 described above, and may perform the development process with the toner. Specifically, the one or more developing units 30 each may mainly form an electrostatic latent image and attach the toner to the formed electrostatic latent image by utilizing Coulomb force. The image forming unit 400 may have a configuration corresponding to any of Configuration examples 1 to 3. It is to be also noted that the configuration of the image forming unit 400 may be a combination of any two or more of Configuration examples 1 to 3. Further, the toner cartridge 100 may be applied to the image forming unit 400, or the toner cartridge 200 may be applied to the image forming unit 400. It is to be also noted that both of the toner cartridges 100 and 200 may be applied to the image forming unit 400.

In this example, the image forming apparatus may include four developing units 30, i.e., developing units 30K, 30C, 30M, and 30Y, for example.

The developing units 30K, 30C, 30M, and 30Y may each be attached detachably to the housing 1, and may be arranged along a traveling path of an intermediate transfer belt 41 which will be described later in greater detail, for example. In this example, the developing units 30K, 30C, 30M, and 30Y may be disposed in order from upstream toward downstream in a traveling direction, illustrated by an arrow F5, in which the intermediate transfer belt 41 travels, for example.

The developing units 30K, 30C, 30M, and 30Y may have respective configurations similar to each other except for having toners, contained in respective toner cartridges, different in type (color) from each other, for example. The developing unit 30K may include a toner cartridge that contains the black toner, for example. The developing unit 30C may include a toner cartridge that contains the cyan toner, for example. The developing unit 30M may include a toner cartridge that contains the magenta toner, for example. The developing unit 30Y may include a toner cartridge that contains the yellow toner, for example.

[Transferring Unit]

The transferring unit 40 may perform a transfer process with the use of the toners that have been subjected to the development process by the respective developing units 30. Specifically, the transferring unit 40 may mainly transfer, onto the medium M, the toner attached to the electrostatic latent image by each of the developing units 30.

The transferring unit 40 may include the intermediate transfer belt 41, a driving roller 42, a driven roller (an idle roller) 43, a backup roller 44, one or more primary transfer rollers 45, a secondary transfer roller 46, and a cleaning blade 47, for example.

The intermediate transfer belt 41 may be a medium (an intermediate transfer medium) onto which the toner is temporarily transferred before the toner is transferred onto the medium M. The intermediate transfer belt 41 may be an elastic endless belt, for example. The intermediate transfer belt 41 may include one or more of polymer materials such as polyimide, for example. The intermediate transfer belt 41 may be movable in response to rotation of the driving roller 42 while lying on the driving roller 42, the driven roller 43, and the backup roller 44.

The driving roller 42 may be rotatable with a drive source such as a motor. Each of the driven roller 43 and the backup roller 44 may be rotatable in response to the rotation of the driving roller 42, for example.

The one or more primary transfer rollers 45 each may transfer the toner attached to the electrostatic latent image onto the intermediate transfer belt 41. In other words, the one or more primary transfer rollers 45 each may perform primary transfer. The one or more primary transfer rollers 45 each may be so pressed against the corresponding developing unit 30, specifically, the photosensitive drum 422 in the corresponding developing unit 30, as to be in contact with the corresponding developing unit 30, specifically, the photosensitive drum 422 in the corresponding developing unit 30, with the intermediate transfer belt 41 in between. The one or more primary transfer rollers 45 each may be rotatable in accordance with the traveling of the intermediate transfer belt 41.

In this example, the transferring unit 40 may include four primary transfer rollers 45, i.e., primary transfer rollers 45K, 45C, 45M, and 45Y, corresponding to the four developing units 30, i.e., the developing units 30K, 30C, 30M, and 30Y described above, for example. The transferring unit 40 may also include one secondary transfer roller 46 corresponding to the one backup roller 44.

The secondary transfer roller 46 may transfer, onto the medium M, the toner that has been transferred onto the intermediate transfer belt 41. In other words, the secondary transfer roller 46 may perform secondary transfer. The secondary transfer roller 46 may be so pressed against the backup roller 44 as to be in contact with the backup roller 44.

The secondary transfer roller 46 may include a core member and an elastic layer, for example. The core member may include metal, for example. The elastic layer may include a foamed rubber layer that covers an outer peripheral surface of the core member, for example. The secondary transfer roller 46 may be rotatable in accordance with the traveling of the intermediate transfer belt 41.

The cleaning blade 47 may be so pressed against the intermediate transfer belt 41 as to be in contact with the intermediate transfer belt 41. The cleaning blade 47 may scrape off unnecessary remains of the toner on the surface of the intermediate transfer belt 41.

[Fixing Unit]

The fixing unit 50 may perform a fixing process with the use of the toner that has been transferred onto the medium M by the transferring unit 40. Specifically, the fixing unit 50 may apply pressure on the toner that has been transferred onto the medium M by the transferring unit 40 while applying heat to the toner. The fixing unit 50 may thereby fix the toner onto the medium M.

The fixing unit 50 may include a heating roller 51 and a pressurizing roller 52, for example.

The heating roller 51 may apply heat to the toner. The heating roller 51 may include a metal core and a resin coating, for example. The metal core may have a hollow cylindrical shape, for example. The resin coating may cover the surface of the metal core. The metal core may include one or more of metal materials such as aluminum, for example. The resin coating may include one or more of polymer materials such as a copolymer (PFA) of tetrafluoroethylene and perfluoroalkylvinylether and polytetrafluoroethylene (PTFE), for example.

The heating roller 51 may be provided with a heater that is disposed inside the metal core of the heating roller 51, for example. Non-limiting examples of the heater may include a halogen lamp. A thermistor may be provided in the vicinity of the heating roller 51, for example. For example, the thermistor may be so disposed as to be separated away from the heating roller 51. The thermistor may measure the surface temperature of the heating roller 51, for example.

The pressurizing roller 52 may be so pressed against the heating roller 51 as to be in contact with the heating roller 51. The pressurizing roller 52 may apply a pressure to the toner. The pressurizing roller 52 may be a metal rod, for example. The metal rod may include one or more of metal materials such as aluminum, for example.

[Conveying Roller]

Each of the conveying rollers 61 to 68 may include a pair of rollers that face each other with corresponding one of the conveyance routes R1 to R5 of the medium M in between. Each of the conveying rollers 61 to 68 may convey the medium M that has been taken out by the feeding roller 20.

In an example case where an image is to be formed only on single surface of the medium M, the medium M may be conveyed by the conveying rollers 61 to 64 along the conveyance routes R1 and R2. In another example case where images are to be formed on both surfaces of the medium M, the medium M may be conveyed by the conveying rollers 61 to 68 along the conveyance routes R1 to R5.

[Conveyance Path Switching Guide]

The conveyance path switching guides 69 and 70 each may switch a conveyance direction, of the medium M, in which the medium M is to be conveyed, depending on conditions such as a manner in which an image is formed on the medium M. The conditions on the manner in which the image is formed on the medium M may include whether the image is to be formed only on one surface of the medium M and whether the images are to be formed on both surfaces of the medium M, for example.

<5-1-2. Configuration Example 2>

Figure 45:
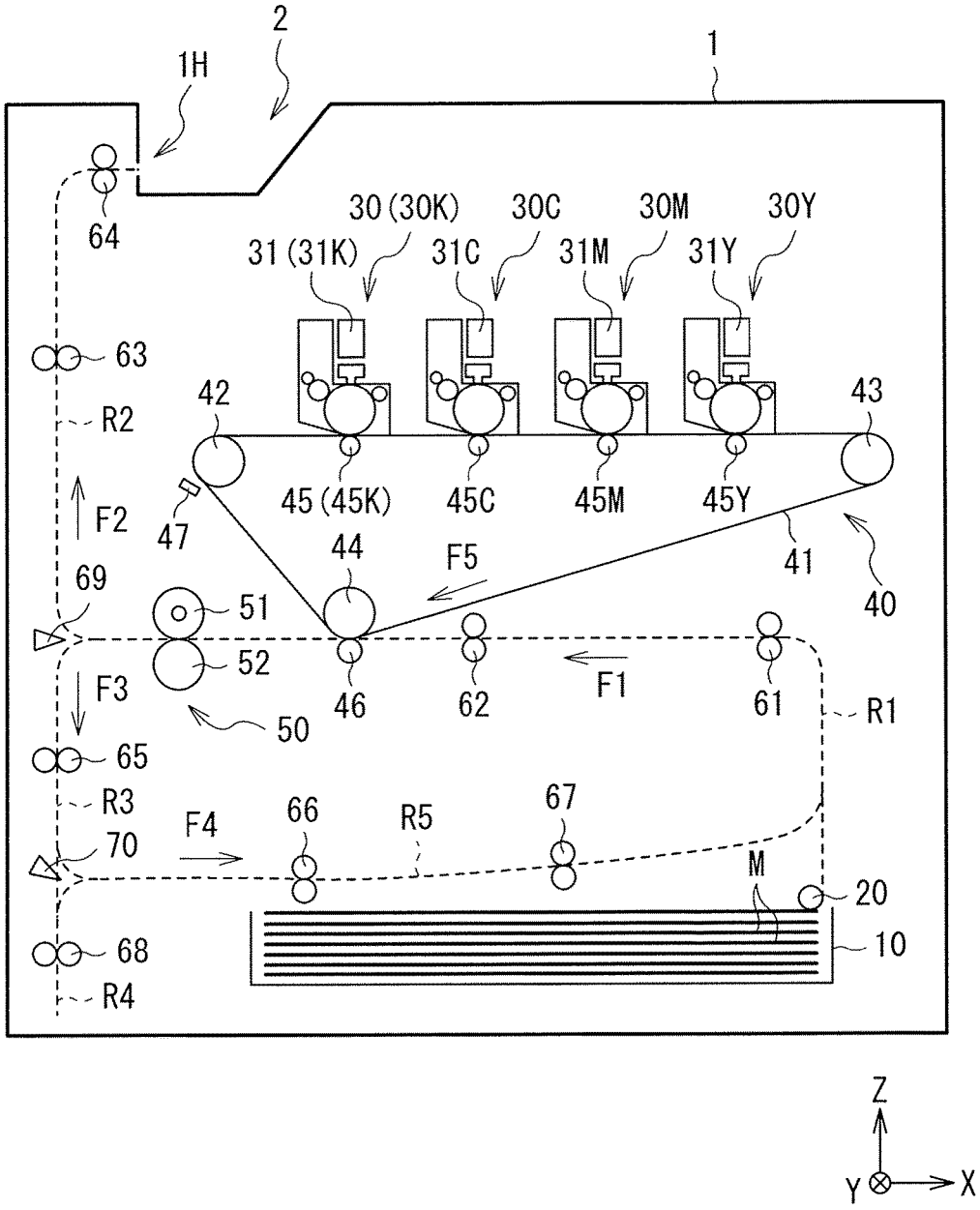
FIG. 45 is a plan view of another configuration example (Configuration example 2) of the image forming apparatus according to one example embodiment of the technology.

FIG. 45 illustrates a planar configuration of an image forming apparatus according to Configuration example 2. The image forming apparatus according to Configuration example 2 may include the one or more developing units 30 to each which the toner cartridge 300 is applied.

Specifically, the image forming apparatus according to Configuration example 2 may have a configuration that is similar to the configuration of the image forming apparatus according to Configuration example 1, except that the one or more developing units 30 each may further include a wireless communicator 31, as illustrated in FIG. 45, for example. The wireless communicator 31 may mainly perform wireless communication with the RFID tag 330. The wireless communicator 31 may thereby read the information stored in the RFID tag 330 and write information on the memory 333 of the RFID tag 330.

In this example, the image forming apparatus may include four wireless communicators 31, i.e., wireless communicators 31K, 31C, 31M, and 31Y in accordance with the provision of the four developing units 30, i.e., the developing units 30K, 30C, 30M, and 30Y, for example. The wireless communicator 31K may perform wireless communication with the RFID tag 330 mounted on the developing unit 30K. The wireless communicator 31C may perform wireless communication with the RFID tag 330 mounted on the developing unit 30C. The wireless communicator 31M may perform wireless communication with the RFID tag 330 mounted on the developing unit 30M. The wireless communicator 31Y may perform wireless communication with the RFID tag 330 mounted on the developing unit 30Y.

<5-2. Operation>

A description is given below of an operation of the image forming apparatus. The components of the image forming unit 400 described above will be referred to in the description below where appropriate.

In a case of forming an image on the surface of the medium M, the image forming apparatus may perform the development process, a primary transfer process, a secondary transfer process, and the fixing process in order, and further perform a cleaning process on an as-needed basis, as described below, for example.

[Development Process]

First, the medium M contained in the tray 10 may be picked up by the feeding roller 20. The medium M picked up by the feeding roller 20 may be conveyed by the conveying rollers 61 and 62 along the conveyance route R1 in a direction indicated by an arrow F1.

The developing unit 30K may perform an operation that is similar to or the same as the operation of the image forming unit 400 described above, thereby attaching the black toner onto an electrostatic latent image.

[Primary Transfer Process]

In the transferring unit 40, when the driving roller 42 rotates, the driven roller 43 and the backup roller 44 may rotate in response to the rotation of the driving roller 42. This may cause the intermediate transfer belt 41 to travel in a direction indicated by an arrow F5.

The primary transfer process may involve application of a voltage to the primary transfer roller 45K. The primary transfer roller 45K may be so pressed against the photosensitive drum 422 as to be in contact with the photosensitive drum 422 with the intermediate transfer belt 41 in between. Hence, the black toner that has been attached to the surface, i.e., the electrostatic latent image, of the photosensitive drum 422 in the foregoing development process may be transferred onto the surface of the intermediate transfer belt 41.

Thereafter, the intermediate transfer belt 41 onto which the black toner has been transferred may continue to travel in the direction indicated by the arrow F5. This may allow each of the set of the developing unit 30C and the primary transfer roller 45C, the set of the developing unit 30M and the primary transfer roller 45M, and the set of the developing unit 30Y and the primary transfer roller 45Y to perform the development process and the primary transfer process in order by a procedure similar to the foregoing procedure performed by the developing unit 30K and the primary transfer roller 45K. The cyan toner, the magenta toner, and the yellow toner may be thus transferred onto the surface of the intermediate transfer belt 41.

Specifically, the developing unit 30C and the primary transfer roller 45C may transfer the cyan toner onto the surface of the intermediate transfer belt 41. Thereafter, the developing unit 30M and the primary transfer roller 45M may transfer the magenta toner onto the surface of the intermediate transfer belt 41. Thereafter, the developing unit 30Y and the primary transfer roller 45Y may transfer the yellow toner onto the surface of the intermediate transfer belt 41.

It is to be noted that whether each of the development process and the primary transfer process is actually performed by the respective developing units 30K, 30C, 30M, and 30Y and the primary transfer rollers 45K, 45C, 45M, and 45Y may be determined depending on the color or the combination of colors that is necessary for forming the image.

[Secondary Transfer Process]

The medium M may pass between the backup roller 44 and the secondary transfer roller 46 upon being conveyed along the conveyance route R1.

The secondary transfer process may involve application of a voltage to the secondary transfer roller 46. The secondary transfer roller 46 may be so pressed against the backup roller 44 as to be in contact with the backup roller 44 with the medium M in between. Hence, the toner that has been transferred onto the intermediate transfer belt 41 in the foregoing primary transfer process may be transferred onto the medium M. The term "toner" used in the description of this example collectively refers to the black toner, the cyan toner, the magenta toner, and the yellow toner described above. The meaning of the term "toner" is similarly applicable to the description below.

[Fixing Process]

After the toner has been transferred onto the medium M in the secondary transfer process, the medium M may be continuously conveyed along the conveyance route R1 in the direction indicated by the arrow F1. The medium M may be thus conveyed to the fixing unit 50.

The fixing process may involve a control that is so performed as to cause the surface temperature of the heating roller 51 to be a predetermined temperature. When the pressurizing roller 52 rotates while being so pressed against the heating roller 51 as to be in contact with the heating roller 51, the medium M may be so conveyed as to pass between the heating roller 51 and the pressurizing roller 52.

The toner that has been transferred onto the surface of the medium M may be thereby applied with heat, which may cause the toner to be molten. Further, the molten toner may be so pressed against the medium M as to be in contact with the medium M. This may allow the toner to be firmly attached to the medium M.

As a result, the toner may be fixed to a specific region on the surface of the medium M on the basis of the image data supplied to the image forming apparatus from the outside. The image may be thus formed.

The medium M on which the image has been formed may be conveyed by the conveying rollers 63 and 64 along the conveyance route R2 in a direction indicated by an arrow F2. The medium M may be thus discharged from the discharge opening 1H to the stacker 2.

It is to be noted that the procedure of conveying the medium M may be varied in accordance with the manner by which the image is to be formed on the surface of the medium M.

For example, in a case where the images are to be formed on both surfaces of the medium M, the medium M that has passed the fixing unit 50 may be conveyed by the conveying rollers 65 to 68 along the conveyance routes R3 to R5 in directions indicated by respective arrows F3 and F4, and be thereafter conveyed again by the conveying rollers 61 and 62 along the conveyance route R1 in the direction indicated by the arrow F1. In this case, the direction in which the medium M is to be conveyed may be controlled by the conveyance path switching guides 69 and 70. This may allow the back surface of the medium M to be subjected to the development process, the primary transfer process, the secondary transfer process, and the fixing process. The back surface of the medium M may be a surface, of the medium M, on which an image is not yet formed.

[Cleaning Process]

Unnecessary remains of the toner may sometimes be present on the surface of the photosensitive drum 422 in each of the developing units 30K, 30C, 30M, and 30Y. The unnecessary remains of the toner may be part of the toner that has been used in the primary transfer process, which may be the toner that has remained on the surface of the photosensitive drum 422 without being transferred onto the intermediate transfer belt 41, for example.

To address this, the photosensitive drum 422 may rotate while being so pressed against the cleaning blade 427 as to be in contact with the cleaning blade 427 in each of the developing units 30K, 30C, 30M, and 30Y. This may cause the remains of the toner present on the surface of the photosensitive drum 422 to be scraped off by the cleaning blade 427. As a result, the unnecessary remains of the toner may be removed from the surface of the photosensitive drum 422.

Further, in the transferring unit 40, part of the toner that has been transferred onto the surface of the intermediate transfer belt 41 in the primary transfer process may sometimes not be transferred onto the surface of the medium M in the secondary transfer process and may remain on the surface of the intermediate transfer belt 41.

To address this, the cleaning blade 47 may scrape off the remains of the toner present on the surface of the intermediate transfer belt 41 in the transferring unit 40 upon traveling of the intermediate transfer belt 41 in the direction indicated by the arrow F5. As a result, unnecessary remains of the toner may be removed from the surface of the intermediate transfer belt 41.

<5-3. Example Workings and Example Effects>

The image forming apparatus may include the developing units 30, i.e., the developing units 30K, 30C, 30M, and 30Y, that each have the configuration similar to the configuration of the image forming unit 400. Each of the memory substrates 130 and 230 and the RFID tag 330 may be therefore attached by means of the attachment unit 500. Hence, it is possible to prevent each of the memory substrates 130 and 230 and the RFID tag 330 from falling off owing to reasons similar to or the same as those described for the image forming unit 400.

Example workings and example effects related to the image forming apparatus other than those described above may be similar to or the same as the example workings and the example effects related to the image forming unit 400.

6. Modification Examples

Each of the configuration of the toner cartridge 100 illustrated in FIGS. 1 to 8, the configuration of the toner cartridge 200 illustrated in FIGS. 9 to 15, and the configuration of the toner cartridge 300 illustrated in FIGS. 16 to 40 may be modifiable where appropriate.

Modification Example 1

Specifically, factors such as presence or absence, the number, the position, and the three-dimensional shape of the projection 121PB are not particularly limited, and therefore may be varied optionally. This is not only applicable to the projection 121PB but may be applicable to the members such as the rib 122R, the wall 122W, and the projection 122P. Specifically, factors such as presence or absence, the number, the position, and the three-dimensional shape of the members such as the rib 122R, the wall 122W, and the projection 122P are not particularly limited, and therefore be varied optionally. The memory substrate 130 may be prevented from falling off also in these cases. Hence, it is possible to achieve similar or the same effects.

Similarly, factors such as presence or absence, the number, the position, and the three-dimensional shape of the projection 221PB are not particularly limited, and therefore may be varied optionally. This is not only applicable to the projection 221PB but may be applicable to the members such as the projection 222P. Specifically, factors such as presence or absence, the number, the position, and the three-dimensional shape of the members such as the projection 222P are not particularly limited, and therefore be varied optionally. The memory substrate 230 may be prevented from falling off also in this case. Hence, it is possible to achieve similar or the same effects.

Modification Example 2

In the example case illustrated in FIGS. 2 and 3, the cover 121 may have the opening 121FA, and the memory substrate 130 may be lifted up by utilizing the projection 122P. In this case, the cover 121 may have the opening 121FB and the wall 122WA may have the opening 122F to allow the memory substrate 130 to be collected on an as-needed basis after the attachment of the memory substrate 130.

When the projection 122P is broken unintentionally, for example, due to a shock applied to the toner cartridge 100, however, the memory substrate 130 may be possibly released to the outside through the opening 121FA in the example case illustrated in FIGS. 2 and 3. In this case, the memory substrate 130 may be possibly taken out through the opening 121FA by a person such as a user. For example, the person such as the user may break the projection 122P intentionally for fraudulent purpose such as a purpose other than proper collection.

To address this, the opening 121FB may not be provided on the cover 121, or the opening 122F may not be provided on the wall 122WA, to thereby prevent the memory substrate 130 from being released or taken out as described above. The memory substrate 130 may be prevented from falling off also in this case. Hence, it is possible to achieve similar or the same effects.

Modification Example 3

In the example case illustrated in FIGS. 1 to 6, only one attachment unit 120 may be provided. Accordingly, only one memory substrate 130 may be attached to the toner cartridge 100.

The memory substrate 130 to be attached to the toner cartridge 100, however, may not be particularly limited in its number. Therefore, two or more memory substrates 130 may be attached with two or more attachment units 120, for example. This is similarly applicable to the image forming unit 400 and the image forming apparatus. Specifically, attachment of two or more memory substrates 130 may be performed in each of the image forming unit 400 and the image forming apparatus. The memory substrate 130 may be prevented from falling off also in such cases. Hence, it is possible to achieve similar or the same effects.

It is to be noted that the memory substrate 230 to be attached to the toner cartridge 200 may not be particularly limited in its number also in the example case illustrated in FIGS. 9 to 15. Therefore, two or more memory substrates 230 may be attached with two or more attachment units 220, for example. Further, the RFID tag 330 to be attached to the toner cartridge 300 may not be particularly limited in its number in the example case illustrated in FIGS. 16 to 40. Therefore, two or more RFID tags 330 may be attached with two or more attachment units 320, for example.

Modification Example 4

In the example case illustrated in FIGS. 7 and 8, the insertion pin 123 may include a material such as a polymer material that is modified easily in accordance with external force. In contrast, each of the cover 121 having the through opening 121H and the support 122 having the constant inner diameter part 122HB may include a material such as a metal material that is more difficult to be modified than the material included in the insertion pin 123, for example.

Each of the cover 121 and the support 122 may include, however, a material such as a polymer material that is easily modified in accordance with external force. In contrast, each of the insertion pin 123, the cover 121, and the support 122 may include a material such as a metal material that is more difficult to be modified. The insertion pin 123 and each of the cover 121 and the support 122 may be closely attached to each other more firmly also in this case. Hence, it is possible to achieve similar or the same effects.

It is to be also noted that each of the cover 121, the support 122, and the insertion pin 123 may include a material such as a polymer material that is modified easily in accordance with external force, as long as the insertion pin 123 and each of the cover 121 and the support 122 are closely and firmly attached to each other.

The description given above related to the insertion pin 123 illustrated in FIGS. 7 and 8 may be applicable to the insertion pin 223 illustrated in FIGS. 14 and 15 and the insertion pin 323 illustrated in FIGS. 28 and 35.

Modification Example 5

In the example case illustrated in FIG. 8, the insertion pin 123 may have the even outer diameter D2. In contrast, each of the through opening 121H and the constant inner diameter part 122HB may have two types of inner diameters, i.e., the diameters D3 and D4, that are different from each other.

The insertion pin 123, however, may have two types of outer diameters corresponding to the two types of inner diameters, i.e., the inner diameters D3 and D4 described above. In contrast, each of the through opening 121H and the constant inner diameter part 122HB may have an inner diameter corresponding to the foregoing outer diameter D2. The insertion pin 123 and each of the cover 121 and the support 122 may be closely and firmly attached to each other owing to the insertion of the insertion pin 123 into each of the through opening 121H and the constant inner diameter part 122HB. Hence, it is possible to achieve similar or the same effects.

It is to be also noted that the insertion pin 123 may have two types of outer diameters different from each other and each of the through opening 121H and the constant inner diameter part 122HB may have two types of inner diameters different from each other, as long as the insertion pin 123 and each of the cover 121 and the support 122 are closely and firmly attached to each other.

The description given above related to the through opening 121H, the constant inner diameter part 122HB, and the insertion pin 123 may be applicable to the through openings 221H and 222H and the insertion pin 223, and be applicable to the insertion opening 321H, the through opening 322H, and the insertion pin 323, for example.

Modification Example 6

Figure 46:
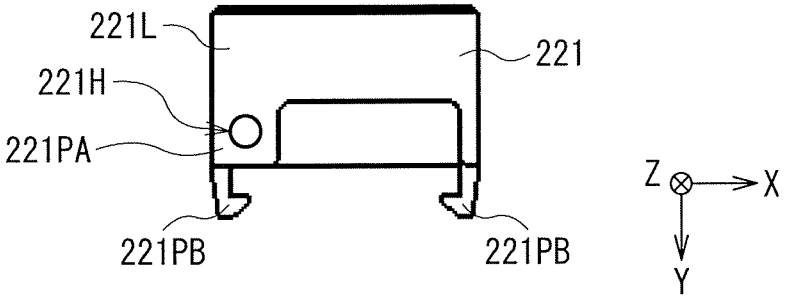
FIG. 46 is a plan view describing a modification example of the configuration of the cover.

The through opening 221H illustrated in FIG. 13 may have an opening shape that is not particularly limited. Therefore, the opening shape of the through opening 221H is not limited to the rectangular shape with four rounded corners, but may be a rectangular shape with four corners that are not rounded, for example. Further, the opening shape of the through opening 221H may have a circular shape as illustrated in FIG. 46 which corresponds to FIG. 13, for example. It is to be also noted that the opening shape of the through opening 221H may be any other shape that has not been described above, for example. It is possible to achieve similar or the same effects also in such a case.

Modification Example 7

In the example case illustrated in FIG. 28, the insertion opening 321H may be a non-through opening that is closed with the bottom surface 321N. The insertion opening 321H, however, may be a through opening, for example. It is possible to achieve similar or the same effects also in this case, owing to insertion of the insertion pin 323 into the through opening 322H and the insertion opening 321H in this order. It may be preferable, however, that the insertion opening 321H be a non-through opening in order to allow the cover 321 to slide by utilizing the insertion operation of the insertion pin 323 into the insertion opening 321H. One reason for this is that the projection 321PA may be pressed by the insertion pin 323, which makes it easier for the cover 321 to slide.

Although some preferred example embodiments of the technology have been described in the foregoing by way of example with reference to the accompanying drawings, the technology is by no means limited to the example embodiments described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

Specifically, for example, the image forming scheme of the image forming apparatus according to one embodiment of the technology is not limited to the intermediate transfer scheme with the use of the intermediate transfer belt, and may be any other image forming scheme. Another image forming scheme may be, for example, an image forming scheme not involving the use of the intermediate transfer belt. In the image forming scheme not involving the use of the intermediate transfer belt, the toner attached to the latent image is transferred onto the medium not indirectly with the intermediate transfer belt in between, but the toner attached to the latent image may be directly transferred onto the medium.

Moreover, the image forming apparatus according to one example embodiment of the technology is not limited to a printer, and may be an apparatus such as a copier, a facsimile, and a multi-function peripheral.

Furthermore, the technology encompasses any possible combination of some or all of the various embodiments and the modifications described herein and incorporated herein.

It is possible to achieve at least the following configurations from the above-described example embodiments of the technology.

(1)

A toner container including:

a containing unit that contains a toner;

a storage device that stores information; and an attachment unit that allows the storage device to be attached to the containing unit, the attachment unit including a cover member having a first projection and an insertion opening, the first projection extending in a first direction, the insertion opening being provided on the first projection and extending in a second direction that intersects the first direction, a supporting member having a first depression and a through opening, the first depression extending in the first direction and allowing the first projection to be inserted into the first depression, the through opening extending in the second direction and being in communication with the first depression, and an insertion member that is inserted into the through opening and the insertion opening in a state where the storage device is positioned between the cover member and the supporting member.

(2)

The toner container according to (1), in which the through opening includes a decreasing inner diameter part in which an inner diameter of the through opening is decreased gradually toward the insertion opening, and a constant inner diameter part in which the inner diameter of the through opening is constant, the decreasing inner diameter part being provided farther from the insertion opening than the constant inner diameter part.

(3)

The toner container according to (2), in which the insertion member has a first end that is closer to the through opening than the insertion opening and is located inside the constant inner diameter part.

(4)

The toner container according to any one of (1) to (3), in which the insertion member includes, in order from front in a direction in which the insertion member is inserted into the through opening and the insertion opening, an increasing outer diameter part in which an outer diameter of the insertion member is increased gradually, and a constant outer diameter part in which the outer diameter of the insertion member is constant.

(5)

The toner container according to any one of (1) to (4), in which the insertion opening is a through opening, and the insertion member has a second end that is closer to the insertion opening than the first end and is located outside the insertion opening.

(6)

The toner container according to (5), in which the increasing outer diameter part is located outside the insertion opening.

(7)

The toner container according to any one of (1) to (6), in which the insertion member is modifiable by contraction in accordance with external force, and the insertion member has one of an outer diameter that is, as a whole, greater than an inner diameter of each of the insertion opening and the through opening and an outer diameter that is partially greater than the inner diameter of each of the insertion opening and the through opening.

(8)

The toner container according to any one of (1) to (7), in which the cover member further includes a second projection that extends in the first direction, and the supporting member further has a second depression that extends in the first direction and allows the second projection to be inserted into the second depression.

(9)

The toner container according to (8), in which the storage device is disposed between the first depression and the second depression.

(10)

The toner container according to any one of (1) to (9), in which the supporting member further includes one or more third projections that are each disposed in a region other than a region in which the storage device is to be disposed.

(11)

The toner container according to (10), in which the supporting member includes the third projection that includes two third projections, and the storage device is disposed between the two third projections.

(12)

The toner container according to any one of (1) to (11), in which the cover member further includes a lid part, the lid part covering the storage device and being coupled to the first projection, and the lid part has a thickness that is smaller on side closer to the first projection than on side farther from the first projection.

(13)

The toner container according to any one of (1) to (12), in which the supporting member further includes one or more walls that are each provided along the cover member.

(14)

The toner container according to (13), in which the one or more walls include a first wall that is disposed along an external wall surface of the cover member, and a second wall that is disposed along an internal wall surface of the cover member.

(15)

The toner container according to any one of (1) to (14), in which the cover member has a first opening that allows the storage device to be exposed partially in the first direction.

(16)

The toner container according to (15), in which the supporting member further includes one or more fourth projections that are each provided in a region overlapping a region in which the storage device is to be disposed.

(17)

The toner container according to (16), in which the cover member has a second opening at a position that overlaps the one or more fourth projections in the second direction.

(18)

The toner container according to (16) or (17), in which the supporting member further includes one or more walls that are each provided along the cover member, and the one or more walls each have a third opening at a position that overlaps the fourth projection in the second direction.

(19)

The toner container according to any one of (1) to (18), in which the insertion opening has an inner diameter that is greater than each of an inner diameter of the through opening and an outer diameter of the insertion member.

(20)

The toner container according to any one of (1) to (7), in which the cover member further includes a pivoting shaft, and performs pivoting around the pivoting shaft, the pivoting shaft extending in the second direction, the cover member performing the pivoting to thereby cover the storage device and allow the first projection to be inserted into the first depression.

(21)

The toner container according to (20), in which the first depression has a dimension in the second direction that is greater than a dimension of the first projection in the second direction, and the cover member moves in the second direction in a state where the first projection is inserted into the first depression.

(22)

The toner container according to (21), in which the insertion opening is a non-through opening.

(23)

The toner container according to (21) or (22), in which the cover member further includes one or more fifth projections that each extend in the second direction, and the supporting member has one or more fourth openings that allow the respective one or more fifth projections to be inserted into the respective one or more fourth openings.

(24)

The toner container according to any one of (20) to (23), in which the insertion member has a dimension in the second direction that is equal to or smaller than sum of a dimension of the insertion opening in the second direction and a dimension of the through opening in the second direction.

(25)

The toner container according to any one of (20) to (24), in which the cover member further includes an extension coupled to the pivoting shaft, and a lid part that covers the storage device and is coupled to the first projection and the extension, and in which the extension is separable from the lid part in accordance with force that lifts up the lid part in a direction in which the lid part is separated away from the storage device.

(26)

The toner container according to (25), in which the cover member has a notch at a position at which the first projection and the lid part are coupled to each other, the notch extending in the second direction, and the cover member is bendable at the position at which the notch is provided, in accordance with the force that lifts up the lid part in the direction in which the lid part is separated away from the storage device.

(27)

An image forming unit including:

a toner containing unit that contains a toner; and a development processor that forms a latent image and attaches the toner to the latent image, one or both of the toner containing unit and the development processor including a storage device that stores information, and an attachment unit that allows the storage device to be attached, the attachment unit including a cover member having a first projection and an insertion opening, the first projection extending in a first direction, the insertion opening being provided on the first projection and extending in a second direction that intersects the first direction, a supporting member having a first depression and a through opening, the first depression extending in the first direction and allowing the first projection to be inserted into the first depression, the through opening extending in the second direction and being in communication with the first depression, and an insertion member that is inserted into the through opening and the insertion opening in a state where the storage device is positioned between the cover member and the supporting member.

(28)

An image forming apparatus including:

a developing unit including a toner containing unit and a development processor, the toner containing unit containing a toner, the development processor forming a latent image and attaching the toner to the latent image;

a transferring unit that transfers, onto a medium, the toner attached to the latent image; and a fixing unit that fixes, to the medium, the toner transferred onto the medium, one or both of the toner containing unit and the development processor including a storage device that stores information, and an attachment unit that allows the storage device to be attached, the attachment unit including a cover member having a first projection and an insertion opening, the first projection extending in a first direction, the insertion opening being provided on the first projection and extending in a second direction that intersects the first direction, a supporting member having a first depression and a through opening, the first depression extending in the first direction and allowing the first projection to be inserted into the first depression, the through opening extending in the second direction and being in communication with the first depression, and an insertion member that is inserted into the through opening and the insertion opening in a state where the storage device is positioned between the cover member and the supporting member.

According to the toner container, the image forming unit, and the image forming apparatus each according to one example embodiment of the technology, the insertion member is inserted into the through opening provided on the supporting member and the insertion opening provided on the cover member in the attachment unit, in a state where the first projection of the cover member is inserted into the first depression of the supporting member, and the storage device is thereby sandwiched between the cover member and the supporting member. Hence, it is possible to prevent the storage device from falling off.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A toner container comprising:

a containing unit that contains a toner;

a storage device that stores information; and an attachment unit that allows the storage device to be attached to the containing unit, the attachment unit including a cover member having a first projection and an insertion opening, the first projection extending in a first direction, the insertion opening being provided on the first projection and extending in a second direction that intersects the first direction, a supporting member having a first depression and a through opening, the first depression extending in the first direction and allowing the first projection to be inserted into the first depression, the through opening extending in the second direction and being in communication with the first depression, and an insertion member that is inserted into the through opening and the insertion opening in a state where the storage device is positioned between the cover member and the supporting member, wherein the cover member further includes a second projection that extends in the first direction, wherein the supporting member further has a second depression that extends in the first direction and allows the second projection to be inserted into the second depression, the cover member further includes a lid part, the lid part covering the storage device and being coupled to the first projection, and the lid part has a thickness that is smaller on a side closer to the first projection than on a side farther from the first projection.

2. The toner container according to claim 1, wherein the through opening includes a decreasing inner diameter part in which an inner diameter of the through opening is decreased gradually toward the insertion opening, and a constant inner diameter part in which the inner diameter of the through opening is constant, the decreasing inner diameter part being provided farther from the insertion opening than the constant inner diameter part.

3. The toner container according to claim 1, wherein the insertion member includes, in order from front in a direction in which the insertion member is inserted into the through opening and the insertion opening, an increasing outer diameter part in which an outer diameter of the insertion member is increased gradually, and a constant outer diameter part in which the outer diameter of the insertion member is constant.

4. The toner container according to claim 1, wherein the insertion opening penetrates through the first projection, and the insertion member has a first end and a second end, the second end being closer to the insertion opening than the first end and being located outside the insertion opening.

5. The toner container according to claim 1, wherein the storage device is disposed between the first depression and the second depression.

6. The toner container according to claim 1, wherein the supporting member further includes one or more third projections that are each disposed in a region other than a region in which the storage device is to be disposed.

7. The toner container according to claim 1, wherein the insertion opening has an inner diameter that is greater than each of an inner diameter of the through opening and an outer diameter of the insertion member.

8. An image forming unit comprising:

a toner container according to claim 1; and a development processor that forms a latent image and attaches the toner from the toner container to the latent image.

9. An image forming apparatus comprising:

a developing unit including a toner container according to claim 1, and a development processor, the development processor forming a latent image and attaching the toner to the latent image;

a transferring unit that transfers, onto a medium, the toner attached to the latent image; and a fixing unit that fixes, to the medium, the toner transferred onto the medium.

10. A toner container comprising:

a containing unit that contains a toner;

a storage device that stores information; and an attachment unit that allows the storage device to be attached to the containing unit, the attachment unit including a cover member having a first projection and an insertion opening, the first projection extending in a first direction, the insertion opening being provided on the first projection and extending in a second direction that intersects the first direction, a supporting member having a first depression and a through opening, the first depression extending in the first direction and allowing the first projection to be inserted into the first depression, the through opening extending in the second direction and being in communication with the first depression, and an insertion member that is inserted into the through opening and the insertion opening in a state where the storage device is positioned between the cover member and the supporting member, wherein the cover member further includes a pivoting shaft, and performs pivoting around the pivoting shaft, the pivoting shaft extending in the second direction, the cover member performing the pivoting to thereby cover the storage device and allow the first projection to be inserted into the first depression.

11. The toner container according to claim 10, wherein the first depression has a dimension in the second direction that is greater than a dimension of the first projection in the second direction, and the cover member moves in the second direction in a state where the first projection is inserted into the first depression.

12. The toner container according to claim 10, wherein the cover member further includes an extension coupled to the pivoting shaft, and a lid part that covers the storage device and is coupled to the first projection and the extension, and wherein the extension is separable from the lid part in accordance with force that lifts up the lid part in a direction in which the lid part is separated away from the storage device.

13. The toner container according to claim 12, wherein the cover member has a notch at a position at which the first projection and the lid part are coupled to each other, the notch extending in the second direction, and the cover member is bendable at the position at which the notch is provided, in accordance with the force that lifts up the lid part in the direction in which the lid part is separated away from the storage device.

14. An image forming unit comprising:

a toner container according to claim 10; and a development processor that forms a latent image and attaches the toner from the toner container to the latent image.

15. An image forming apparatus comprising:

a developing unit including a toner container according to claim 10, and a development processor, the development processor forming a latent image and attaching the toner to the latent image;

a transferring unit that transfers, onto a medium, the toner attached to the latent image; and a fixing unit that fixes, to the medium, the toner transferred onto the medium.

* * * * *